US011274538B2

(12) United States Patent
Mohamed et al.

(10) Patent No.: US 11,274,538 B2
(45) Date of Patent: Mar. 15, 2022

(54) METHODS AND SYSTEMS FOR BALLOONED HYDRAULIC FRACTURES AND COMPLEX TOE-TO-HEEL FLOODING

(71) Applicant: Texas Tech University System, Lubbock, TX (US)

(72) Inventors: Ahmed Mohamed, Marietta, OH (US); Mohamed Yousef Soliman, Cypress, TX (US); Lloyd Heinze, Lubbock, TX (US)

(73) Assignee: TEXAS TECH UNIVERSITY SYSTEM, Lubbock, TX (US)

( * ) Notice: Subject to any disclaimer, the term of this patent is extended or adjusted under 35 U.S.C. 154(b) by 0 days.

(21) Appl. No.: 16/629,943

(22) PCT Filed: Jul. 9, 2018

(86) PCT No.: PCT/US2018/041204

§ 371 (c)(1),
(2) Date: Jan. 9, 2020

(87) PCT Pub. No.: WO2019/014090

PCT Pub. Date: Jan. 17, 2019

(65) Prior Publication Data

US 2021/0148211 A1 May 20, 2021

Related U.S. Application Data

(60) Provisional application No. 62/530,386, filed on Jul. 10, 2017.

(51) Int. Cl.

| | |
|---|---|
| ***E21B 43/26*** | (2006.01) |
| ***E21B 43/30*** | (2006.01) |
| ***E21B 43/267*** | (2006.01) |

(52) U.S. Cl.
CPC ..... *E21B 43/267* (2013.01); *E21B 43/305* (2013.01)

(58) Field of Classification Search
CPC ..... E21B 43/26; E21B 43/267; E21B 43/305; E21B 41/00
See application file for complete search history.

(56) References Cited

U.S. PATENT DOCUMENTS

| | | | |
|---|---|---|---|
| 6,167,966 | B1 | 1/2001 | Ayasse et al. |
| 7,328,743 | B2 | 2/2008 | Turta et al. |

(Continued)

OTHER PUBLICATIONS

PCT/US2018/041204. Int'l Search Report & Written Opinion (dated Dec. 21, 2018). 12 pages.

*Primary Examiner* — Zakiya W Bates
(74) *Attorney, Agent, or Firm* — Loza & Loza LLP; Kevin L. Soules

(57) ABSTRACT

Improved methods and systems for hydrocarbon production, including operations involving ballooned hydraulic fractures and complex toe-to-heel flooding. The recovery of ballooned hydrocarbons via ballooned hydraulic fractures can include the use of an OZF (Optimized Modified Zipper Frac) that recovers hydrocarbons. OZF can be implemented as a fracturing technique with respect to organic shale reservoirs to maximize near-wellbore complexity and overall permeability and hydrocarbon recovery. Additionally, Complex toe-to-heel flooding (CTTHF) can be applied to horizontal wells. CTTHF uses one or more barriers and an injector hydraulic fracture, and facilitates the control of early water production.

12 Claims, 23 Drawing Sheets

(56) References Cited

U.S. PATENT DOCUMENTS

| | | | |
|---|---|---|---|
| 8,307,893 | B2 | 11/2012 | Sierra et al. |
| 10,480,289 | B2 * | 11/2019 | Alzahabi ..... E21B 43/26 |
| 2003/0054962 | A1 | 3/2003 | England et al. |
| 2008/0142224 | A1 | 6/2008 | Wilson |
| 2011/0209868 | A1 | 9/2011 | Dusterhoft et al. |
| 2014/0048270 | A1 | 2/2014 | Soliman et al. |
| 2014/0305638 | A1 | 10/2014 | Kresse et al. |
| 2016/0003020 | A1 | 1/2016 | Sharma |
| 2016/0298435 | A1 | 10/2016 | Mendell |
| 2017/0122086 | A1 | 5/2017 | Sheng |

* cited by examiner

Case 7: Additional Fluid Viscosity and Proppant Concentration

Case 8: Additional Fluid Volume and Proppant Concentration

Case 9: Additional Fluid Volume and Viscosity, and Proppant Concentration

METHODS AND SYSTEMS FOR BALLOONED HYDRAULIC FRACTURES AND COMPLEX TOE-TO-HEEL FLOODING

CROSS REFERENCE TO RELATED PATENT APPLICATIONS

This application, which was filed under the PCT (Patent Cooperation Treaty), claims a right of priority under 35 U.S.C. § 365(b) and the benefit under 35 U.S.C. § 119(a) to U.S. Provisional Patent Application Ser. No. 62/530,386 entitled "Methods and Systems for Ballooned Hydraulic Fractures and Complex Toe-to-Heel Flooding," filed on Jul. 10, 2017. U.S. Provisional Patent Application Ser. No. 62/530,386 is incorporated herein by reference in its entirety.

TECHNICAL FIELD

Embodiments are related to the field of hydrocarbon production. Embodiments further relate to techniques for increasing hydrocarbon production rate and hydrocarbon recovery factor in conventional and unconventional hydrocarbon reservoirs. Embodiments further relate to complex toe-to-heel flooding methods, systems and applications to the field of hydrocarbon production. Embodiments further relate to methods, systems and applications for ballooned hydraulic fractures.

BACKGROUND

In certain subterranean formations, fluid is injected into the reservoir to displace or sweep the hydrocarbon out of the reservoir. This method of production is generally referred to as a method of "Improved Oil Recovery" or "Enhanced Oil Recovery" which may involve water-flooding, gas injection, steam injection, etc. For the purpose of this specification, the general process can be defined as injecting a fluid (e.g., gas or liquid) into a reservoir in order to displace the existing hydrocarbons into a producing well or a producing zone if the injection is, for example, from a part of the same producing well.

One of the primary issues with injecting fluid to enhance oil recovery is how to sweep the reservoir of the hydrocarbon in the most efficient manner possible. Because of geological differences in a reservoir, the permeability may not be homogenous. Because of such permeability differences between the vertical and horizontal directions or the existence of higher permeability streaks, the injecting fluid may bypass some of the reservoir fluid and create a path into the producing well. Even with homogenous reservoirs, the tendency of the injected fluid is to breakthrough into the producing well and consequently leave a large volume of the reservoir un-swept by the injecting fluid. This problem generally worsens as the mobility ratio between the fluids becomes unfavorable, such as when the mobility of the injected fluid is significantly higher than the reservoir fluid.

The industry has come up with numerous methods to improve the sweep efficiency and the overall reservoir that is swept by individual wells. These methods include fracturing or so-called "fracking" operations and the use of horizontal wells. The industry currently uses horizontal wells as injectors in an attempt to expose more of the reservoir to the injecting fluid. The goal is to create a movement of injection fluid evenly across the reservoir. This is done to emulate the highly efficient line drive. The industry also uses horizontal wells as producers, again the goal being to evenly produce the reservoir to form a line drive.

Conventional waterflooding utilizes vertical wells for injection and production. Sweep efficiency is the ratio of oil produced to water injected, and maximizing sweep efficiency is important to the success of any waterflooding project. To this end, numerous waterflooding patterns have been designed to suit specific reservoir conditions. In addition, the use of polymers, surfactants, micro-foams and other chemicals is common to prevent water channeling, which results from reservoir heterogeneity, water/oil segregation due to gravity, density contrasts, and high vertical permeability.

One conventional technique of Improved Oil Recovery is referred to as Toe-to-Heel Waterflooding (TTHW). It was developed by Alberta Innovates-Technology Futures (AITF) to increase recovery from reservoirs containing either light or light-heavy oils. TTHW is a gravity-stable, short-distance displacement process that uses at least one vertical water injector perforated near the lower part of the reservoir and a horizontal producer placed at the upper part of the reservoir with its toe close to the vertical injector. As water is injected via the vertical injector, an early breakthrough is induced between the injector and the toe of the horizontal producer. The consequent drop in the pressure between the toe and the injector allows gravity to create oil-water segregation in the reservoir, which slowly pushes the oil upward for production.

These contributors to water channeling are aggravated by thick pay zones and unfavorable oil/water mobility ratios, however, any solutions that rely on the injection of chemicals are expensive. Fortunately, Toe-To-Heel Waterflooding (TTHW) offers a more complete approach to solving these problems. TTHW reduces the importance of the mobility ratio while utilizing the gravity segregation effect.

The process for recovering oil, mostly hydrocarbons, from a reservoir can be very difficult. Normally, the oil is trapped in shale or rocks and is not easily pumped out. Therefore, the concept of fracking was produced where fractures are made in the rocks so oil could flow out and then be retrieved. However, only about a third of the reservoir's oil is easy to retrieve, even with fracking, because the rest is trapped in a more dense substance that cannot easily flow through the fractures. Therefore, the leaders in the industry are creating many different ways to improve fracking and oil recovery.

Increasing overall permeability of organic shale is the key to increase its hydrocarbon recovery. The nano-darcy permeability of organic shale currently precludes the field application of all proposed methods to increase hydrocarbon recovery by gas or liquid flooding. A new technique developed by the present inventors and named "Optimized Modified Zipper Frac" (OMZF) or "Optimized Zipper Frac" (OZF) avoids this limitation by using stress shadowing to lessen the magnitude difference between horizontal stresses in the stimulated reservoir volume (SRV) before it becomes fractured, thereby maximizing the SRV's complexity and overall permeability.

In an example embodiment, when OZF is used to recover hydrocarbons from shale, a stage of hydraulic fractures (preferably fat-propped fractures) is first created near the toe of a horizontal well. A second stage is then created and ballooned on the same well at a designed distance from the first stage. Then, a third stage is created along an adjacent well midway and staggered between stages one and two. This operational sequence is then repeated. The first two stages (along the first well) are ballooned to produce a stress shadow strong enough to maximize the complexity of the third stage (along the second well) when it is fractured. A detailed design process is presented and includes different scenarios to optimize zipper fracturing.

Reservoir simulations and field applications confirm that Texas Two-Step and Modified Zipper Frac will in fact increase the complexity and permeability of nearby fractured zones. OZF can maximize these increases by optimizing the net pressure and fracture dimensions, thereby strengthen the stress shadow on zones before fractured. This will increase near wellbore complexity, overall permeability, hydrocarbon recovery, and may also allow gas injection as an EOR application. These simulations strongly suggest that, unlike experimental methods that propose flooding shale cores with different fluids, OZF is field applicable. Any increased production resulting from this work will help the petroleum industry to meet its ever-increasing demand.

BRIEF SUMMARY

The following summary is provided to facilitate an understanding of some of the innovative features unique to the disclosed embodiments and is not intended to be a full description. A full appreciation of the various aspects of the embodiments disclosed herein can be gained by taking the entire specification, claims, drawings, and abstract as a whole.

It is therefore one aspect of the disclosed embodiments to provide for improved methods and systems for hydrocarbon production.

It is another aspect of the disclosed embodiments to provide for increasing hydrocarbon production rate and hydrocarbon recovery factor in hydrocarbon reservoirs.

It is yet another aspect of the disclosed embodiments to provide for methods and systems for increasing hydrocarbon recovery from shale reservoirs through ballooned hydraulic fracture.

It is also an aspect of the disclosed embodiments to provide for increasing hydrocarbon production in conventional and non-conventional reservoirs.

It is a further aspect of the disclosed embodiments to provide for Complex Toe-to-Heel Flooding (CTTHF) methods and systems for use in increasing hydrocarbon production rate and recovery in hydrocarbon reservoirs especially but not limited to sandstone reservoirs.

The aforementioned aspects and other objectives and advantages can now be achieved as described herein. In one example embodiment, an OZF approach can be implemented that uses stress shadowing to lessen the magnitude difference between horizontal stresses in the stimulated reservoir volume (SRV) before it becomes fractured, thereby maximizing the SRV's complexity and overall permeability. When OZF is used to recover hydrocarbons from shale, a stage of hydraulic fractures (preferably fat-propped fractures) are first created near the toe of a horizontal well. A second stage is then created and ballooned on the same well at a designed distance from the first stage. Then, a third stage is created along an adjacent well midway and staggered between stages one and two. This operational sequence is then repeated. The first two stages (along the first well) are ballooned to produce a stress shadow strong enough to maximize the complexity of the third stage (along the second well) when it is fractured.

In other example embodiments, methods and systems can be implemented for recovering hydrocarbons and increasing hydrocarbon production from conventional and unconventional reservoirs. For conventional reservoirs, Complex Toe-to-Heel Flooding (CTTHF) comprises a completion strategy designed to increase the hydrocarbon recovery from both conventional reservoirs. For sandstone reservoirs (conventional reservoir), the completion design can be implemented by first drilling horizontal wells parallel to the minimum horizontal stress direction and spaced to increase flood efficiency. The toes are placed on the same plane, which is perpendicular to the minimum horizontal stress direction. The perforations close to the toes are used to inject a high viscous batch to form a non-permeable barrier along the reservoir, and a proper plug is then set to separate the barrier from the rest of the horizontal section. The remaining section is then perforated, and a suitable packer is set and sealed at a designed distance from the plug. The perforations between the plug and the packer are used for flood injection, and the perforations between the packer and the heel are used in production. Whenever the flooding material to hydrocarbon ratio increases significantly, the packer is pulled a designed distance back to the heel. The hydrocarbon is produced through the annulus, produced through the dual tubing, or produced by any other convenient technique.

In some experimental embodiments, a simulation study was conducted to confirm the feasibility of CTTHF by comparing it to conventional water flooding and Toe-to-Heel water flooding (TTHW). Commercial reservoir simulators (Eclipse and CMG) were used to perform this comparison, and a sensitivity study was completed to determine the optimum injection rate and "flood material/hydrocarbon ratio" for CTTHF. The distance between the horizontal wells and the spacing between the hydraulic fractures was also optimized. The results of the study show that, sandstone formation is a favorable candidate of CTTHF, especially when it has good porosity, permeability, and large formation thickness. Also, CTTHF has more advantages over conventional waterflooding and Toe-to-Heel waterflooding. Namely, CTTHF completion strategy has been feasibly confirmed as a production rate and recovery increase application.

The novelties of the disclosed CTTHF embodiments are that the non-permeable barrier results in better sweep efficiency by focusing the flooding material into exact volume of the reservoir. Also, dividing the sandstone reservoir into semi pressure isolated zones is a better reservoir management practice. Finally, the capability of changing the location of the packer minimizes the production of the flooding material as much as possible. Any production increase results from this work will help the petroleum industry answer the ever-increasing demands for energy fuels.

For an unconventional reservoir (e.g., organic shale), the organic shale's nano-darcy permeability currently precludes the field application of all proposed methods to increase hydrocarbon recovery by gas or liquid flooding. A new technique developed by the authors and named "Complex Toe-to-Heel Flooding" (CTTHF) avoids this limitation by manipulating stress dependent permeability.

When used to recover hydrocarbons from shale, CTTHF begins with the hydraulic fracturing of the horizontal section of a well. Then, a packer is set and sealed a short distance from the toe to divide the horizontal section into two portions. The portion between the heel and the packer is allocated for "producing fractures," which draw hydrocarbons from the formation. The portion between the toe and the packer is allocated for "ballooning fractures," into which are injected cyclic batches of a high viscous fluid. The ballooned fractures increase the horizontal stress gradient, squeezing additional hydrocarbons out of the formation by opening the shale micro fractures for longer periods of time. A detailed design process is presented, including an optimization for the injection schedule (used to avoid the stress sink problem) and a method for changing the location of ballooning fractures.

Complex Toe-to Heel Flooding is so named because it combines the functions of TTHWs two wells into one horizontal well with two or more transverse fractures. Though its setup is more complex than that of TTHW, CTTHF is more efficient and economic.

CTTHF replaces TTHWs vertical injector with at least two transverse hydraulic fractures placed at the toe of the horizontal lateral. The first fracture is a non-conductive barrier used to better manage the influx of injected water and to help this water, through the effect of gravity, settle down and spread at the bottom of the reservoir (starts pushing the oil upward to the producing section). The second fracture is an injector fracture that serves the same function as TTHW's vertical injector well.

CTTHF cannot be efficiently applied without the application of water production control techniques. These techniques include but are not limited to changing the packer location, adding more barriers heel-ward from the injector side, injecting in batches (injecting for a designed period of time then producing for a designed period of time), and using inflow control devices (ICDs) and inflow control valves (ICVs).

Predicting the location of the water front using reservoir simulations is important to designing water production control techniques. For every CTTHF reservoir, the results of simulations should recommend one or a combination of water control techniques.

A highly conductive injector fracture is critical to the successful application of CTTHF. Designing for proppant settling is very important because proppant settling ensures that injector fractures are very thin and relatively nonconductive at the top and fat and very conductive at the bottom. Controlling the injection rate is also critical to applying CTTHF successfully: the slower the rate (within a designed range), the better the segregation of oil and water by gravity.

Using one or more water production control techniques with an injector fracture that is highly conductive at the bottom minimizes the upward movement of injected water due to the lower pressure near the producing perforations.

Because CTTHF's barrier fracture allows it to focus more of the injected volume toward the heel than does TTHW, if a water production control technique is not used with CTTHF, it will produce more water than TTHW.

Because CTTHF creates a small difference in water pressure (AP) between the barrier fracture and the injector fracture, it encourages water to settle below the oil due to its higher density. The water spreads across the bottom of the producing well as it settles, pushing the oil upward to be produced by the producing section.

Oil can be produced via any convenient technique, including dual tubing and producing from the annulus.

Monitoring the pressures of the production tubes, the injection tubes, and the annulus is important in tracking malfunctions.

When CTTHF is applied, produced water can be reinjected into the reservoir as a part of the flooding operation design.

Defined fracability and hydraulic fracture geometry are key to optimizing multistage fracturing design. No single equation to quantify fracability and brittleness has been agreed upon. Fracability and resulting hydraulic fracture geometry, however, can be quantified using stress anisotropy and the brittleness indices of organic shale and tight reservoir formations.

A major disadvantage of MZF is that it does not attain the stress shadow magnitude necessary to achieve maximized near wellbore complexity. MZF is optimized, therefore, by calculating the horizontal stresses and the mechanical properties of the target zone then ballooning fractures to reach this magnitude of stress shadowing.

The magnitude of the minimum horizontal stress is increased by the compression in the formation caused by increases in fracture dimensions. Because increases in fracture widths are especially pronounced, increases in minimum horizontal stress are larger than increases in other principal stresses. When a fracture is ballooned, its net pressure increases until the difference between the horizontal stresses is minimized, after which point the minimum horizontal stress becomes the maximum horizontal stress.

Using stress shadowing to increase an SRV's complexity and overall permeability is a good approach to increase recovery from unconventional reservoirs. Though the Texas Two-Step and Modified Zipper Frac are good examples of this approach, the effect can be maximized through the use of the disclosed Optimized Zipper Frac (OZF) methods and systems.

Like the Zipper Frac technique, OZF decreases the operation cycle time significantly by allowing two teams (plug and perf and fracturing) to work simultaneously. OZF, however, requires a slightly longer cycle time than zipper frac, particularly if a decision is made for fracturing two stages at a time (i.e., this will require more preparation and more horsepower). In this scenario, the near wellbore complexity will increase and the operation efficiency will decrease (longer cycle time). Because ballooning fracture stages to achieve the desired net pressure and fracture dimensions may require fluids with higher viscosity and additional time, OZF may require some additional operational expenses.

To apply OZF in the field, an estimate of maximum horizontal stress magnitude should be known to design for the required stress shadows magnitude required to optimize complexity. Wellbore failure analysis is needed for few vertical wells in the area.

Ballooned hydraulic fracturing is a technique that optimizes near wellbore complexity by employing stress shadows. When two fracturing stages spaced a designed distance apart on the same horizontal well are ballooned, a stress shadow can be generated with a magnitude pre-designed to minimize the difference between the horizontal stresses. When this difference is minimized, initiating a third hydraulic fracture stage between the first two stages but on a neighboring well creates better near wellbore complexity than does either the modified zipper frac or Texas Two-Step approaches. A second application of ballooned hydraulic fracturing involves breaking weak planes and influencing the desorption rate in unconventional gas formations by inflating and deflating selected fractures.

Optimized Zipper Frac (OZF) applies the general principle of Texas Two-Step to a modified zipper frac, and includes ballooning selected fractures to optimize stress shadow magnitude which is capable of achieving a higher near wellbore complexity. The stress shadow necessary to optimize complexity near the wellbore in organic shale is estimated, and then the fracturing treatment, including ballooned fractures, is designed. Required net pressure and fluid viscosity are important parameters for ballooned fracture design.

In general, the disclosed OZF approach increases contact area and production rates by maximizing complexity near the wellbore. OZF also saves time by allowing two teams (e.g., plug and perf and fracturing) to work simultaneously. OZF also increases the overall permeability of organic shale, which is a key to increasing its hydrocarbon recovery capabilities. The nano-darcy permeability of organic shale currently precludes the field application of all proposed methods to increase hydrocarbon recovery by gas or liquid flooding. OZF avoids this limitation by using stress shadowing to lessen the magnitude difference between horizontal stresses in the stimulated reservoir volume (SRV) before it gets fractured, thereby maximizing the SRV's complexity and overall permeability.

When OZF is used to recover hydrocarbons from shale, a stage of hydraulic fractures (preferably fat-propped fractures) are first created near the toe of a horizontal well. A second stage is then created and ballooned on the same well at a designed distance from the first stage. Then, a third stage is created along an adjacent well midway and staggered between stages one and two. This operational sequence is then repeated. The first two stages (along the first well) are ballooned to produce a stress shadow strong enough to maximize the complexity of the third stage (along the second well) when it is fractured. A detailed design process is presented and includes different scenarios to optimize zipper fracturing.

Reservoir simulations and field applications confirm that the Texas Two-Step and Modified Zipper Frac will in fact increase the complexity and permeability of nearby fractured zones. OZF maximizes these increases by optimizing the net pressure and fracture dimensions, and thereby strengthen the stress shadow on zones before fractured. This will increase near wellbore complexity, overall permeability, hydrocarbon recovery, and may also allow gas injection as an EOR application. These simulations strongly suggest that unlike experimental methods that propose flooding shale cores with different fluids, OZF is field applicable. Any increased production resulting from this work will help the petroleum industry to meet its ever-increasing demand.

BRIEF DESCRIPTION OF THE DRAWINGS

The accompanying figures, in which like reference numerals refer to identical or functionally-similar elements throughout the separate views and which are incorporated in and form a part of the specification, further illustrate the disclosed embodiments and, together with the detailed description of the disclosed embodiments, serve to explain the principles of the present invention.

DETAILED DESCRIPTION

Figure 1:
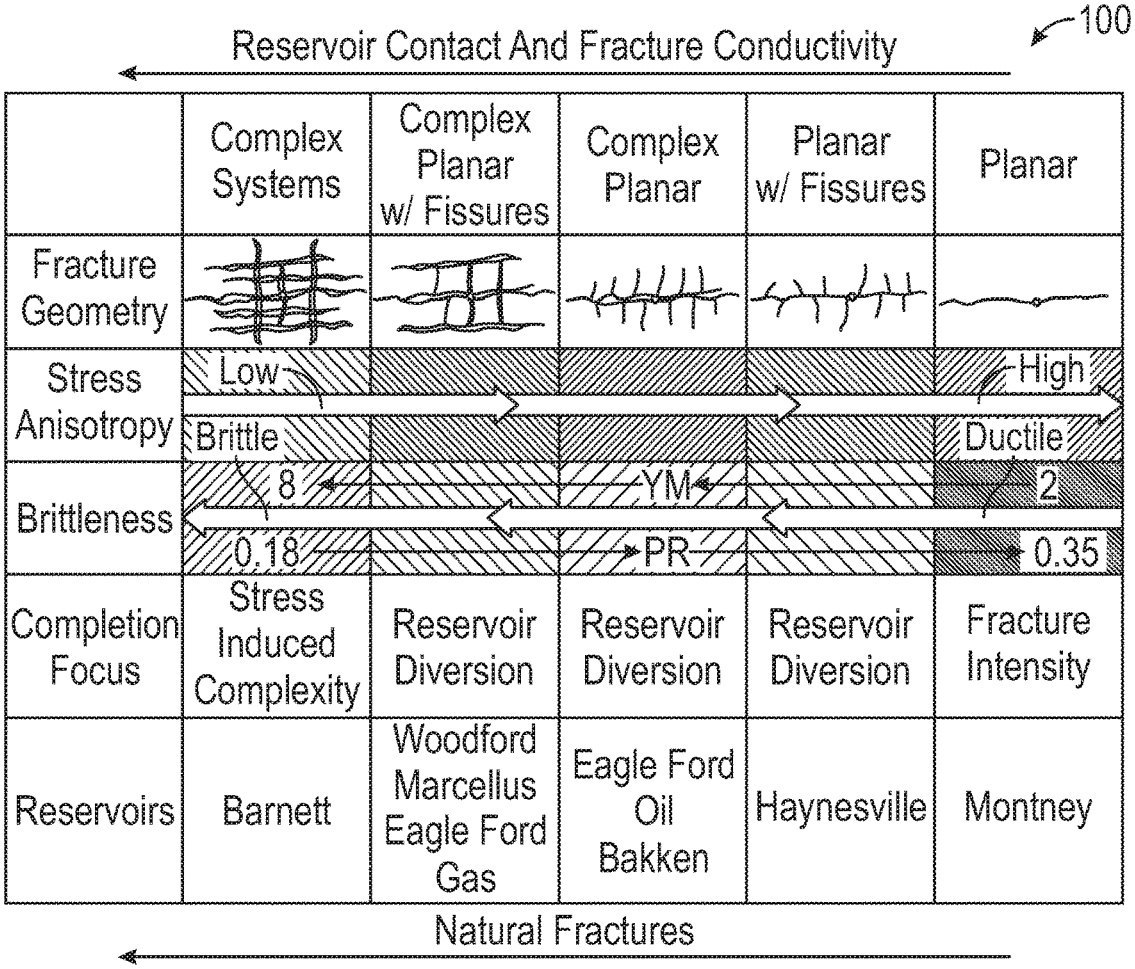
FIG. 1 illustrates a chart depicting hydraulic fracture geometry based on the stress anisotropy and brittleness of organic shale and tight reservoir formations.

The particular values and configurations discussed in these non-limiting examples can be varied and are cited merely to illustrate at least one embodiment and are not intended to limit the scope thereof.

The embodiments will now be described more fully hereinafter with reference to the accompanying drawings, in which illustrative embodiments of the invention are shown. The embodiments disclosed herein can be embodied in many different forms and should not be construed as limited to the embodiments set forth herein; rather, these embodiments are provided so that this disclosure will be thorough and complete, and will fully convey the scope of the invention to those skilled in the art. Like numbers refer to identical, like or similar elements throughout, although such numbers may be referenced in the context of different embodiments. As used herein, the term "and/or" includes any and all combinations of one or more of the associated listed items.

The terminology used herein is for the purpose of describing particular embodiments only and is not intended to be limiting of the invention. As used herein, the singular forms "a", "an", and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Subject matter will now be described more fully hereinafter with reference to the accompanying drawings, which form a part hereof, and which show, by way of illustration, specific example embodiments. Subject matter may, however, be embodied in a variety of different forms and, therefore, covered or claimed subject matter is intended to be construed as not being limited to any example embodiments set forth herein; example embodiments are provided merely to be illustrative. Likewise, a reasonably broad scope for claimed or covered subject matter is intended. Among other things, for example, subject matter may be embodied as methods, devices, components, or systems. Accordingly, embodiments may, for example, take the form of hardware, software, firmware or any combination thereof (other than software per se). The following detailed description is, therefore, not intended to be taken in a limiting sense.

Throughout the specification and claims, terms may have nuanced meanings suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. It is intended, for example, that claimed subject matter include combinations of example embodiments in whole or in part.

In general, terminology may be understood at least in part from usage in context. For example, terms, such as "and", "or", or "and/or," as used herein may include a variety of meanings that may depend at least in part upon the context in which such terms are used. Typically, "or" if used to associate a list, such as A, B or C, is intended to mean A, B, and C, here used in the inclusive sense, as well as A, B or C, here used in the exclusive sense. In addition, the term "one or more" as used herein, depending at least in part upon context, may be used to describe any feature, structure, or characteristic in a singular sense or may be used to describe combinations of features, structures or characteristics in a plural sense. Similarly, terms, such as "a," "an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context. Additionally, the term "at least one" may be understood to convey "one or more".

Methods and Applications of Ballooned Hydraulic Fractures

Increasing the overall permeability of organic shale is a key to increasing its hydrocarbon recovery. The nano-darcy permeability of organic shale currently precludes the field application of all proposed methods to increase hydrocarbon recovery by gas or liquid flooding. A new technique developed by the present inventors and named "Optimized Modified Zipper Frac" (OMZF) or "Optimized Zipper Frac" (OZF) avoids this limitation by using stress shadowing to lessen the magnitude difference between horizontal stresses in the stimulated reservoir volume (SRV) before it gets fractured, thereby maximizing the SRV's complexity and overall permeability. Note that the terms "Optimized Modified Zipper Frac" (OMZF) and "Optimized Zipper Frac" (OZF) as utilized herein can be utilized interchangeably to refer to the same technique.

When OZF is used to recover hydrocarbons from shale, a stage of hydraulic fractures (i.e., preferably fat-propped fractures) are first created near the toe of a horizontal well. A second stage can be then created or configured and ballooned on the same well at a designed distance from the first stage. Then, a third stage is created along an adjacent well midway and staggered between stages one and two. This operational sequence is then repeated. The first two stages (e.g., along the first well) are ballooned to produce a stress shadow strong enough to maximize the complexity of the third stage (e.g., along the second well) when it is fractured. A detailed design process is presented herein with respect to different scenarios for optimizing zipper fracturing.

Reservoir simulations and field applications confirm that the so-called "Texas Two-Step" and Modified Zipper Frac can in fact increase the complexity and permeability of nearby fractured zones. The OZF approach/system can maximize these increases by optimizing the net pressure and fracture dimensions, thereby strengthening the stress shadow with respect zones previously fractured. This in turn increases near wellbore complexity, overall permeability, hydrocarbon recovery, and can also allow for the use of gas injection as an EOR application. These simulations strongly suggest that unlike experimental methods that propose flooding shale cores with different fluids, OZF is field applicable. Any increased production resulting from this work will help the petroleum industry to meet its ever-increasing demand.

There are two major problems associated with organic shale development. The first problem is that only a relatively small percentage of the hydrocarbon in organic shale formation (5% to 10%) can currently be recovered. The second problem is that less than one third of the hydraulic fractures created in organic shale reservoirs actually produce. To overcome these problems, it is important to develop better completion strategies that increase recovery and avoid wasting effort and money on fracturing zones that will never produce.

Zipper Frac (ZF), Alternating Fracturing (Texas Two-Step), and Modified Zipper Frac (MZF) are recent successful completion strategies that employ stress shadowing to increase complexity near the wellbore. As complexity increases from planar to complex system, reservoir contact and non-propped fracture conductivity increase.

The major factors that control "fracability" (the ease with which rocks can be fractured) and consequent fracture geometry are in-situ stresses and rock mechanical properties. Although, fracability is not a well-defined (quantified) term but it can be described in terms of stress anisotropy (e.g., see FIG. 1). Geomechanical analyses can more easily calculate the combined effects of in-situ stresses by calculating the stress anisotropy (Equation 1):

$$HSAI = \frac{\sigma H - \sigma h}{\sigma h} \tag{1}$$

Where HSAI is the horizontal stress anisotropy index, aH is the maximum horizontal stress and ah is the minimum horizontal stress. Also, "Fracability" can be defined in terms of brittleness. The term "brittleness" has not yet been fully defined or quantified, though it is commonly represented using the brittleness index, which is a combination of Young's modulus and Poisson's ratio (e.g., see FIG. 1). A rock with a higher Young's modulus and a lower Poisson's ratio is more brittle (has a higher brittleness index). A higher brittleness index means hydraulic fractures have more tendency to grow complex network fractures. FIG. 1 illustrates a chart 100 depicting hydraulic fracture geometry based on the stress anisotropy and brittleness of organic shale and tight reservoir formations.

Figure 2:
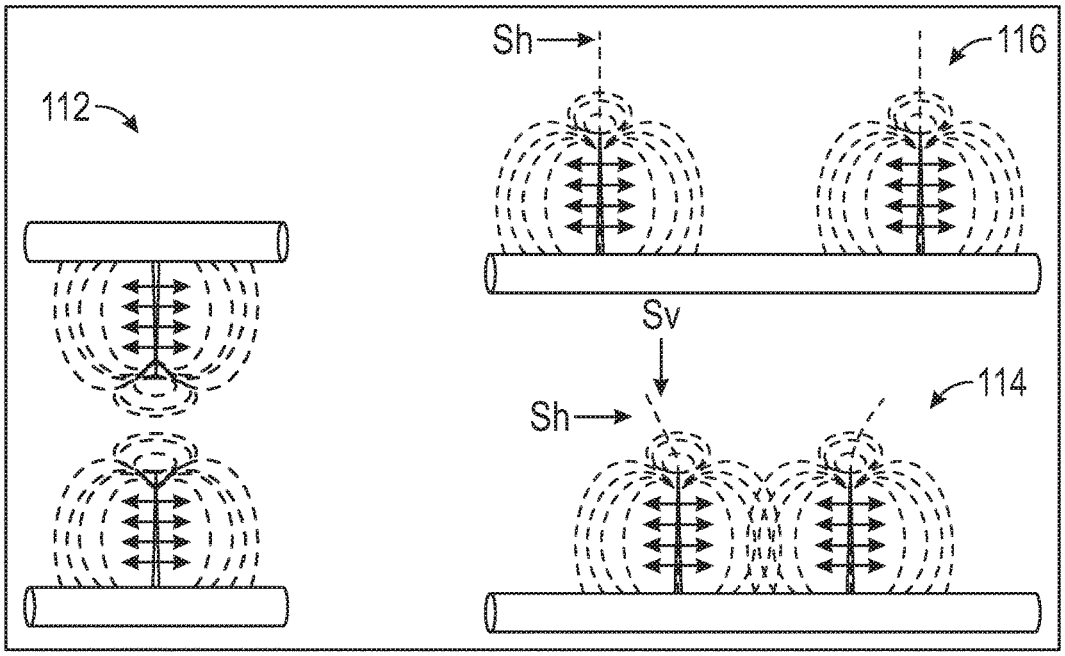
FIG. 2 illustrates schematic diagrams depicting hydraulic fractures tip attraction and the effect of fracture interaction on fracture geometry.

The creation of a hydraulic fracture alters the stresses around it. The region around the fracture tip, rock is under tensile stress (rock is pulled apart); thus, creates tensile conditions within that region (e.g., see the black dotted zones in FIG. 2). At the same time, as fracture width increases with fracture size, the fracture walls are being pushed against the rock around it; this generates a zone of increased compression (e.g., see red dotted zones in FIG. 2). FIG. 2 illustrates respective schematic diagrams 112, 114, and 116 depicting hydraulic fractures tip attraction and the effect of fracture interaction on fracture geometry. Diagram 112 illustrates hydraulic fractures tip attraction. Diagrams 114 and 116 illustrate the effect of fracture interaction on fracture geometry. The top diagram 116 depicts non interaction and the bottom diagram 114 illustrates fracture bending.

Horizontal wells are drilled parallel to the minimum horizontal stress direction. When they are hydraulically fractured and these fractures are far apart, no overlapping of the altered stress zone occurs. There is no interaction between the neighbored fractures. As a result, fracture propagation is most likely planar and affected by the magnitude of the stress perpendicular to them (minimum horizontal stress).

Interaction between simultaneously propagating neighbored fractures starts to occur when there is overlap of altered stress zones associated to different fractures. When compressive zones overlap, fractures start pushing on each other, making fracture propagation more difficult; fractures bend away from each other trying to find the path of least resistance for propagation (e.g., see FIG. 2). Since fractures bend, the stress acting perpendicular to them and controlling their growth is now a combination of the minimum horizontal stress (Sh) and the overburden stress (Sv). When fractures tips are close together, tensile zones may overlap, creating a stress sink that would facilitate fracture propagation. As a result, fractures would tend to propagate toward this sink and may merge together.

Figure 3:
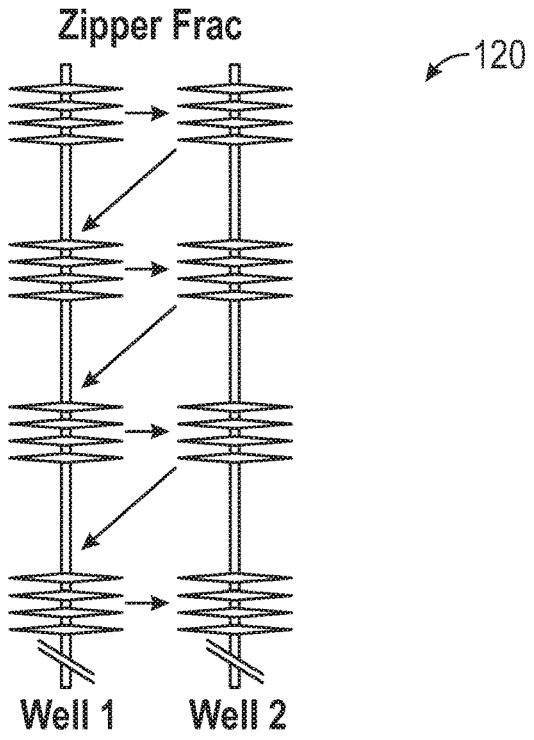
FIG. 3 illustrates a schematic diagram of a Zipper Frac operation sequence.

Zipper Frac (ZF or zippering technique) is a successful completion strategy for organic shale (e.g., see FIG. 3). Many companies have reported increased production rates after employing zipper frac technique, even though it was designed to reduce cycle times between frac stages and to enhance general operational efficiency. The zippering technique is used on multi well pads in horizontal well plug and perf completion. During the pumping operations of a frac stage, crew rig up wireline running in a hole on the offset well to set a plug and perforate the casing. At the end of the hydraulic fracturing job, crew rig down wireline from the offset well and move to the next well on the pad to prepare it for pumping operation. The crew then isolate the well that have a completed stage and redirect the pumps to frac the well that was just prepared using the wireline. The sequence is reminiscent of a zipper closing: one by one, stages are completed in an alternating sequence.

FIG. 3 illustrates a schematic diagram of an example Zipper Frac operation sequence 120 with respect to two wells—Well 1 and Well 2. Advantages of the Zipper Frac (also referred to as "zipper frac" or "Zipper frac") approach include a reduction in the cycle time and increase in the overall operation efficiency, along with an increase in production rate. Disadvantages of the Zipper frac approach include the fact that reasons for production rate increase are not well understood (e.g., some companies reported no increase in production by using zipper frac). In addition, Hydraulic fractures, when they are close enough, bend away and add more pressure drop inside the fracture.

Figure 4:
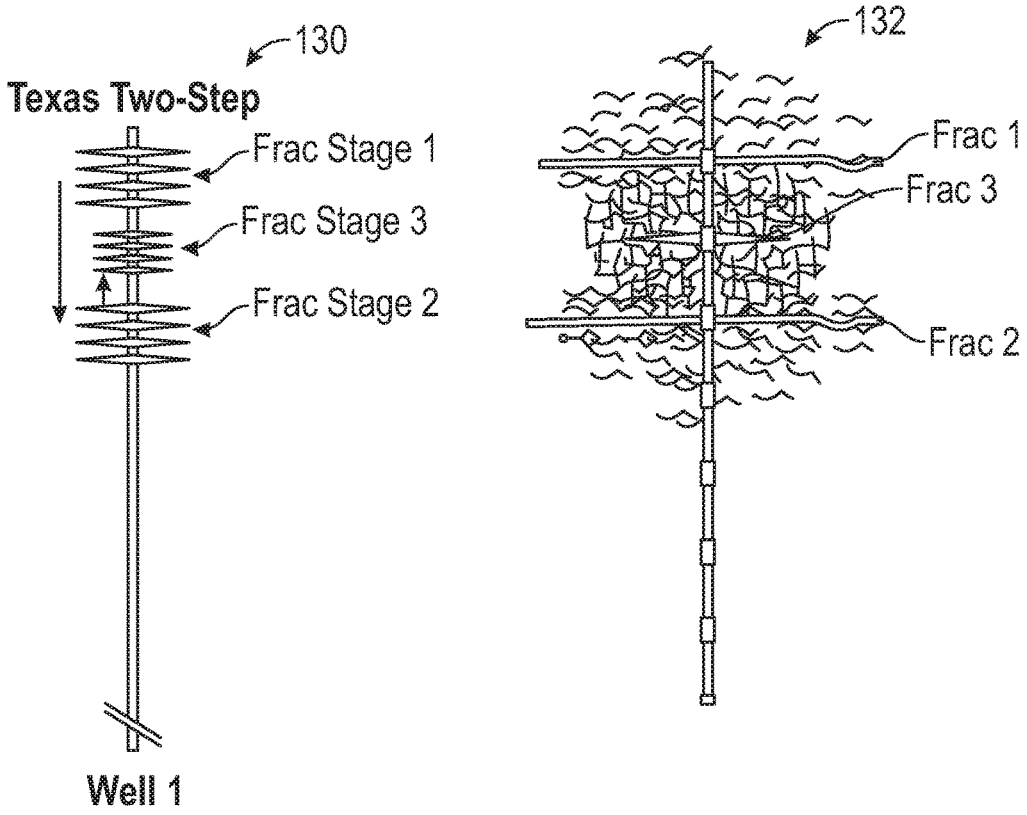
FIG. 4 illustrates a schematic diagram of a Texas Two-Step.

Alternate fracturing, or the so-called "Texas Two-Step", is a completion strategy for fracturing one well at a time. In alternate fracturing, an initial zone is hydraulically fractured close to the toe and a second zone is fractured a designed distance closer to the heel. Then, a third zone is fractured in the middle of the previous two zones (e.g., see FIG. 4). Zones continue to be fractured in this pattern until the entire horizontal section has been fractured. FIG. 4 illustrates a schematic diagram of a Texas Two-Step operation 130 and an additional diagram depicting an operation 132 wherein fracture complexity results from low-stress anisotropy. As indicated in the schematic diagram of operation 130 shown at the right in FIG. 4, the first fracture (Frac 1) is made near the toe, the second fracture (Frac 2) is made designed distance closer to the heel, and the third fracture (Frac 3) is made in the middle.

Fracturing two stages close together in the same well lessen the difference between horizontal stresses. The stress shadowing effect is stronger in this scenario because it depends on time, distance between fractures, net pressure, principle stresses, and fracture dimensions.

Advantages of the Texas Two-Step operation (referred to simply as the "Texas Two-Step" include the fact it offers a good example of lessening the difference between horizontal stresses to increase complexity and permeability near the wellbore after fracturing. Other advantages include the fact that near wellbore complexity is higher than a zipper frac and a modified zipper frac. In addition, the Texas Two-Step offers an expectation of higher production rates than the zipper frac and modified zipper frac. Disadvantages of the Texas Two-Step include operationally it is more complicated and needs special equipment. Another disadvantage is that fracturing horizontal wells take longer time compared to zipper frac and modified zipper frac.

Figure 5:
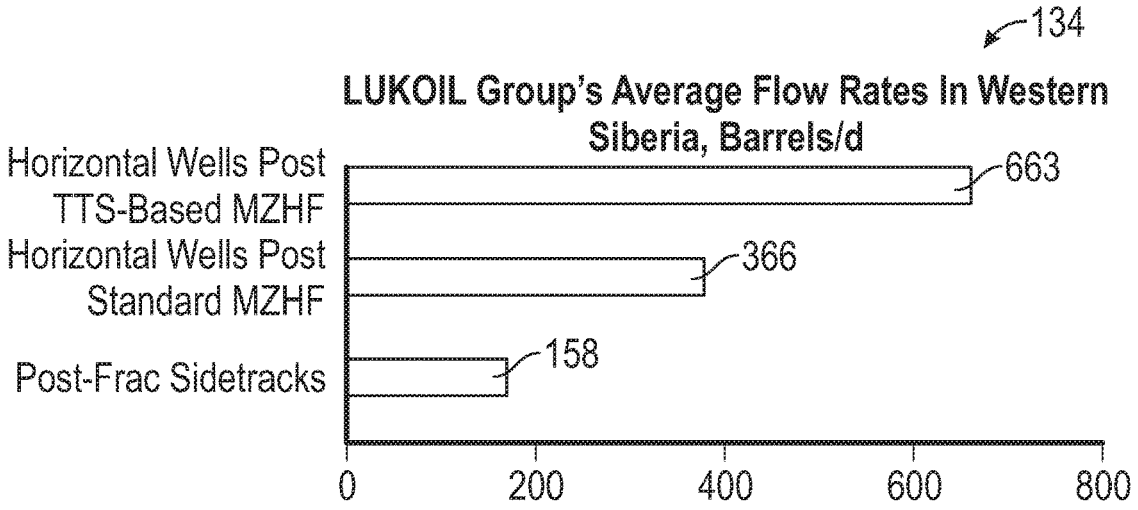
FIG. 5 illustrates a chart depicting data indicative of the Texas Two-Step versus other completion techniques.

LUKOIL was the first Russian company to implement Texas Two-Step (US) hydraulic fracturing technology on sidetracks. In its 2014 annual report, LUKOIL claimed that technology enables multi-zone hydraulic fracturing (MZHF) to be carried out on a horizontal well in a certain order, thereby increasing flow rate. In 2013 and 2014, LUKOIL drilled 8 horizontal wells in western Siberia using the Texas Two-Step technology. The horizontal wells that used TTS-based MZHF had flow rates that were four times higher than those that used frac sidetracks and two times higher than those that used standard MZHF (e.g., see FIG. 5). FIG. 5 illustrates a chart 134 depicting data indicative of the Texas Two-Step versus other completion techniques.

Figure 6:
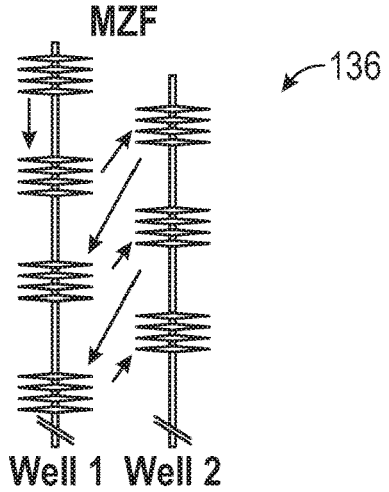
FIG. 6 illustrates a schematic diagram of an MZF (Modified Zipper Frac) operation sequence.

FIG. 6 illustrates a schematic diagram of an MZF (Modified Zipper Frac) operation sequence 136. A Modified Zipper Frac (MZF) does nothing more than arrange the frac stages of two or more adjacent wells so that the frac stages of each well face the middle zones between the frac stages of the other wells (i.e., see FIG. 6). This technique improves production rate by increasing near wellbore complexity, thereby increasing overall permeability. This complexity results from successive fracturing stages along the same horizontal well lessening the difference between the two principal horizontal stresses in the formation, especially in the middle zone by the effect of stress shadowing. The smaller the difference between horizontal stresses the maximum the complexity near the wellbore at that zone when it gets hydraulically fractured.

Typically, modified zipper frac improves contact area with the reservoir and increases the effective stimulated reservoir volume. For example, enhancing fracture complexities in shale gas resources is critical to improve stimulation treatment and well production performance.

A major disadvantage of modified zipper frac is lack of optimization of stress shadows magnitude needed to maximize near wellbore complexity. It is better to estimate the magnitude of horizontal stresses and the mechanical properties of the target zone, then design for the hydraulic fracturing treatment that makes optimum stress shadows that creates maximum complexity near the wellbore after fracturing.

Thus, advantages of MZF include higher production rates due to more complexity near the wellbore and more contact area with the reservoir compared to zipper frac, and minimization of the operation cycle time (slightly longer than zipper frac). A disadvantage of MZF includes the fact that the concept of lessening the difference between the magnitude of horizontal stresses lacks optimization. In addition, it takes a slightly longer time to complete an operation than, for example, a zipper frac. Additionally, not all the horizontal lateral is hydraulically fractured (i.e., the evaluation remains "ambiguous").

Ballooned hydraulic fracturing is a technique that optimizes near wellbore complexity by employing stress shadows. When two fracturing stages spaced a designed distance apart on the same horizontal well are ballooned, a stress shadow can be generated with a magnitude pre-designed to minimize the difference between the horizontal stresses. When this difference is minimized, initiating a third hydraulic fracture stage between the first two stages but on a neighboring well creates better near wellbore complexity than does either modified zipper frac or Texas Two-Step. A second application of ballooned hydraulic fracturing is to break weak planes and influence the desorption rate in unconventional gas formations by inflating and deflating selected fractures, but this application is not within the scope of this paper.

Figure 7:
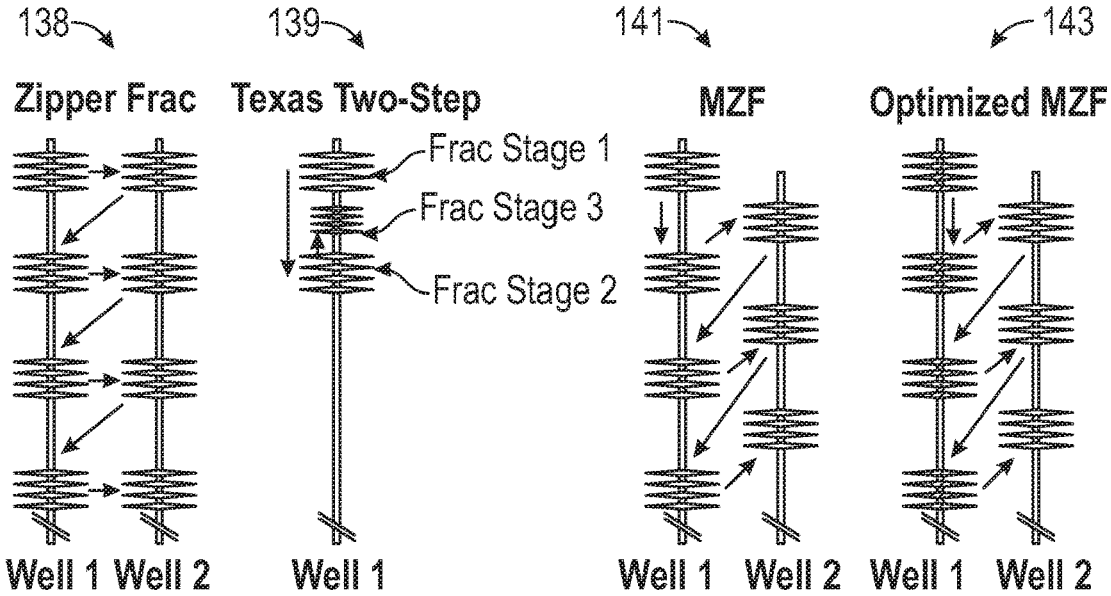
FIG. 7 illustrates schematic diagrams of a Zipper Frac, Texas Two-Step, an MZF, and an OMZF (Optimized Modified Zipper Frac), in accordance with an example embodiment.

Optimized Modified Zipper Frac (OMZF) applies the general principle of Texas Two-Step to modified zipper frac, ballooning selected fractures to optimize stress shadow magnitude and achieve higher near wellbore complexity. The stress shadow necessary to optimize complexity near the wellbore in organic shale is estimated, and then the fracturing treatment, including ballooned fractures, is designed. Required net pressure and fluid viscosity are important parameters for ballooned fracture design. FIG. 7 illustrates respective schematic diagrams 138, 139, 141, and 143 of zipper frac, Texas Two-Step, modified zipper frac (MZF), and optimized modified zipper frac (OMZF) operations.

Figure 8:
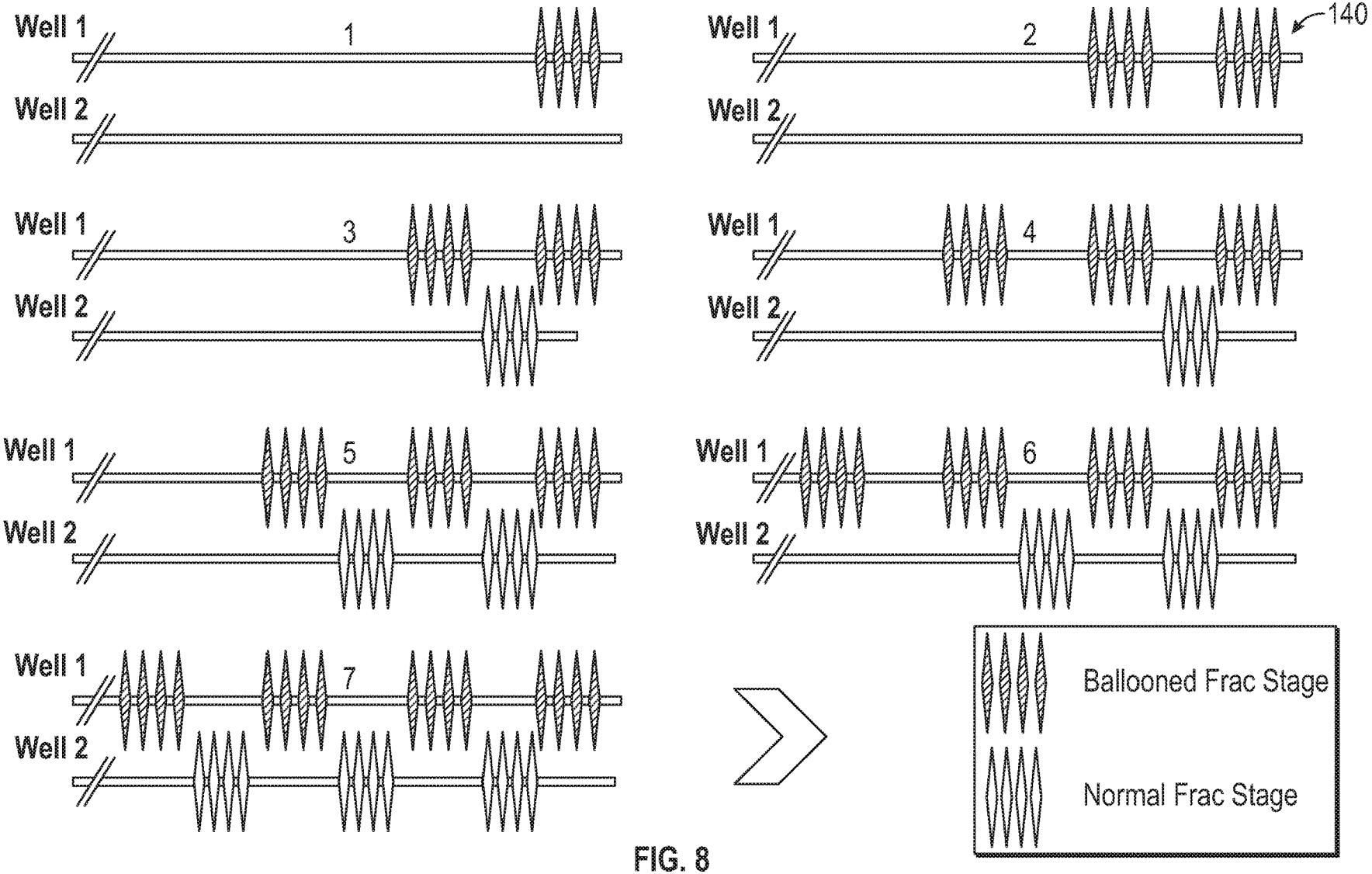
FIG. 8 illustrates a schematic diagram outlining an operation sequence of an OMZF, in accordance with an example embodiment.

FIG. 8 illustrates a schematic diagram 140 outlining an operation sequence of an OMZF, in accordance with an example embodiment. FIG. 8 thus illustrates the sequence of a typical OMZF operation. OMZF starts with a stage of hydraulic fractures (preferably fat-propped fractures) created near the toe of a horizontal well (step 1). A second stage is then created and ballooned on the same well at a designed distance from the first stage (step 2). Then, a third stage is created along an adjacent well midway and staggered between stages one and two (step 3). The same pattern is repeated until the whole horizontal section is fractured (steps 4, 5, 6, 7, . . . ). When wells 1 and 2 have been fractured, crews move to wells 3 and 4 and repeat the operation. When the difference between the magnitudes of the horizontal stresses is minimized and the shale is brittle enough, complexity and permeability are maximally improved.

Advantages of OMZF include an increase in the contact area and product rates by maximizing complexity near the wellbore, and the fact that OMZF saves time allowing two teams (plug and perf and fracturing) to work simultaneously. Disadvantages of OMZF include the fact that it requires a slightly longer cycle time than a zipper frac for completion, and may require more preparation and more horsepower if two stages are to be completed in a short sequence. Additional disadvantages are that ballooned fracture stages may require fluids with higher viscosity (which cost extra) to maintain the desired net pressure and fracture dimensions. In addition, precisely estimating the magnitude of the maximum horizontal stress is difficult and requires an analysis of vertical wellbore failure.

Figure 9:
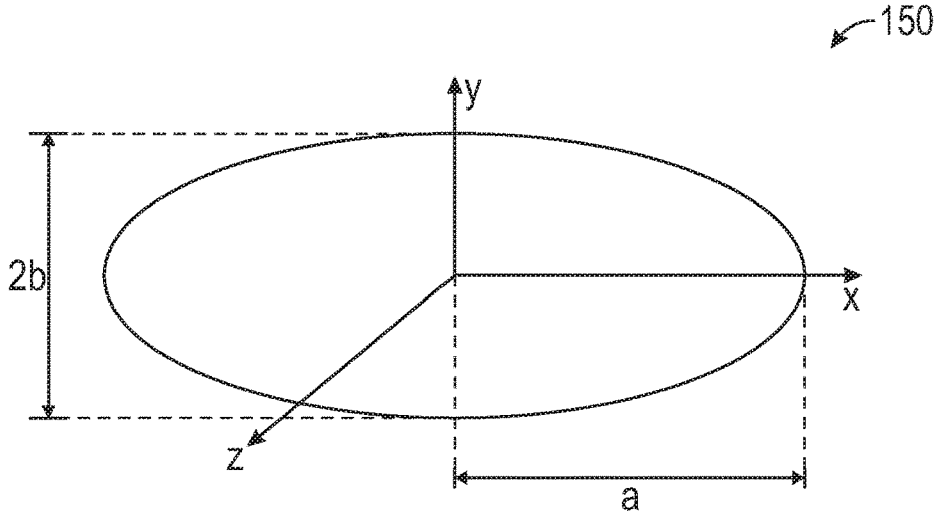
FIG. 9 illustrates a schematic diagram of a 3D elliptic crack, in accordance with an example embodiment.

Sneddon (1946) and Sneddon and Elliot (1946) introduced solutions to calculate the stresses around semi-infinite, penny-shaped, and arbitrarily shaped fractures. In 1950, Green and Sneddon developed an analytical solution for elliptical fractures. For simplicity, this solution is presented for a fracture in a homogeneous elastic medium with a constant internal pressure. The geometry of an elliptical fracture is shown in the schematic diagram 150 in FIG. 9.

The solution can be directly calculated as the following (Warpinski 2004):

$$\sigma_x - \sigma_y = -8G\left[(1-2v_r)\left(\frac{\partial^2 \phi}{\partial Z^2} + \frac{\partial^2 \phi}{\partial Z^3}\right)\right] \tag{2}$$

$$\sigma_x - \sigma_y + 2i\tau_{xy} = 32G\frac{\partial^2}{\partial z^{-2}}\left[(1-2v_r)\phi + Z\frac{\partial \phi}{\partial z}\right] \tag{3}$$

$$\sigma z = -8G\frac{\partial^2 \phi}{\partial Z^2} + 8GZ\frac{\partial^2 \phi}{\partial z^3} \tag{4}$$

$$\tau_{xz} - i\tau_{yz} = 16GZ\frac{\partial^3 \phi}{\partial_z \partial z^2} \tag{5}$$

where $\sigma_x$ is effective stress in the x direction, psi, $\sigma_y$ is effective stress in the y direction, psi, $\sigma_z$ is effective stress in the z direction, psi, $\tau_{xy}$ is shear stress in the xy plane, psi, $\tau_{xz}$ is shear stress in the xz plane. $\tau_{yz}$ is shear stress in the yz plane, psi, G is shear modulus, psi, Z (capital) is the coordinate axis normal to the fracture plane, z (small) is complex variable, $\phi$ is the potential function, and $v_r$ is Poisson's ratio.

Sneddon (1946) developed a solution to calculate the stresses around a penny-shaped fracture (e.g., see FIG. 7). It is clear from this solution that the magnitude of change to the minimum horizontal stress is always greater than the magnitude of change to both the maximum horizontal stress and the vertical stress. Because penny-shaped fractures are symmetrical, changes in stress on the line of symmetry in the directions parallel to the plane of the fracture ($\sigma_x$, $\sigma_y$) are equal. Stress shadowing has a much stronger impact on the minimum horizontal stresses of subsequent fractures than it does on their other principal stresses, especially when these fractures are close together (i.e. in short spacing). "Aspect ratio" refers to the ratio of fracture spacing (L) to fracture height (H).

Figure 10:
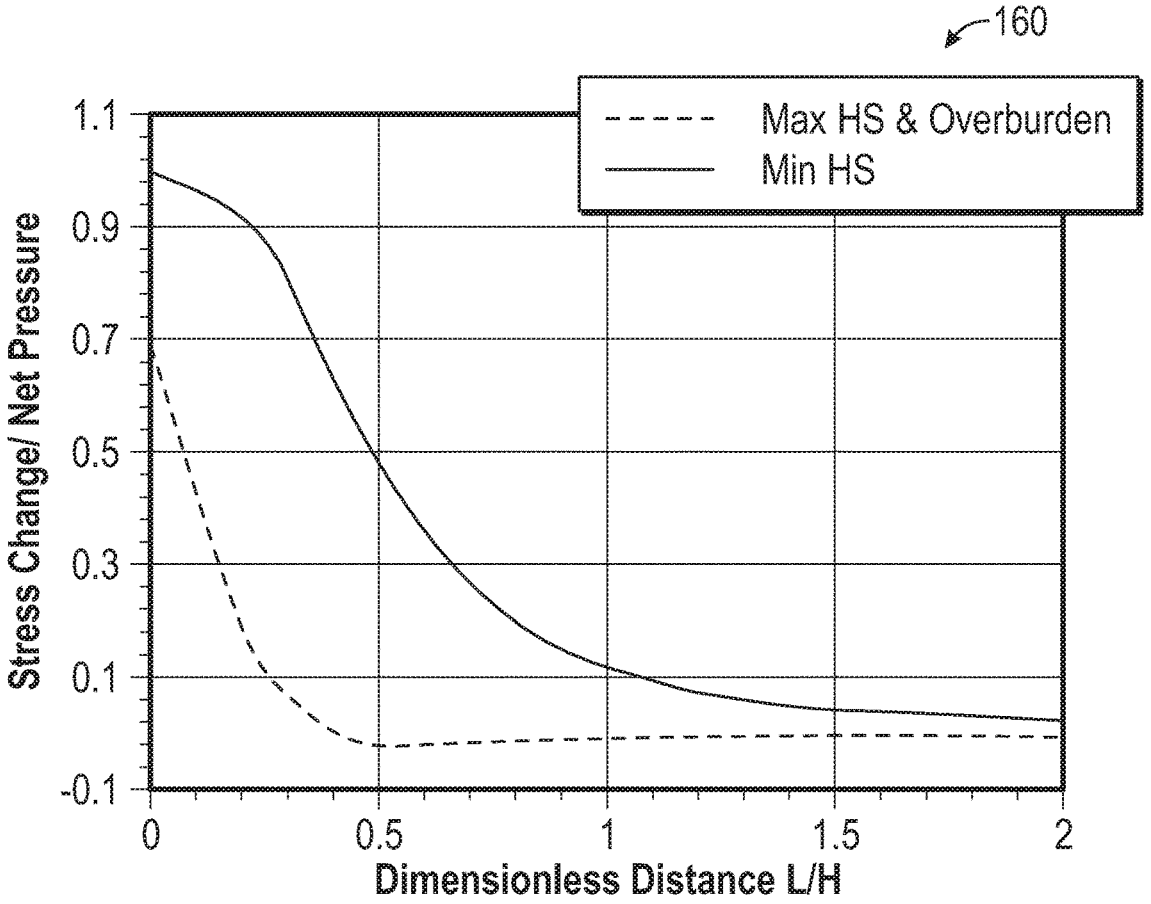
FIG. 10 illustrates a graph depicting data indicative of dimensionless variation in stress versus dimensionless distance in a penny shaped crack, in accordance with an example embodiment.

FIG. 10 illustrates a graph 160 depicting data indicative of dimensionless variation in stress versus dimensionless distance in a penny shaped crack, in accordance with an example embodiment.

Sneddon and Elliott (1946) introduced a solution for semi-infinite fractures, which he assumes are rectangular with limited height and infinite length. He also assumes that the widths of such fractures are extremely small compared to their heights and lengths. His solution is presented in FIG. 4. For each principal stress, the change in stress over net pressure is plotted versus the distance perpendicular to the fracture plane normalized by the fracture height. The change in the minimum horizontal stress is greater than the change in the maximum horizontal stress and the change in the overburden stress.

Figure 11:
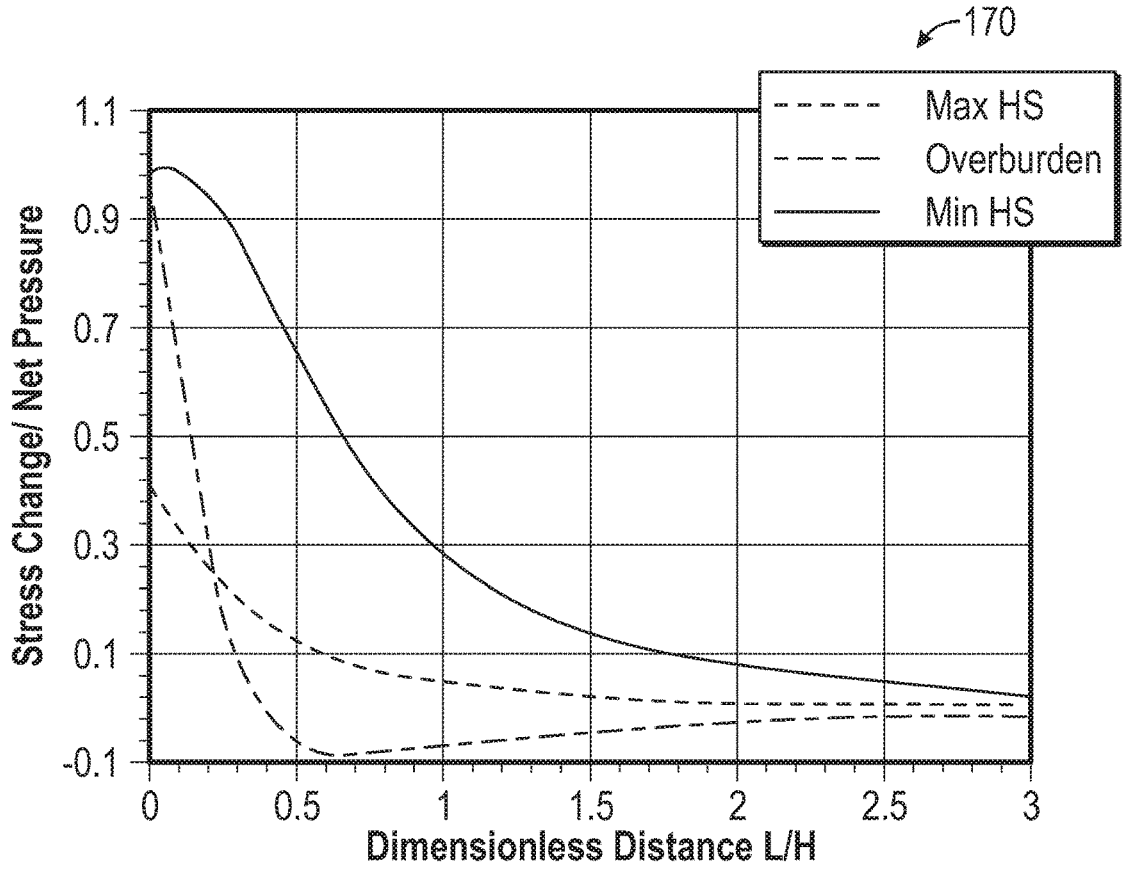
FIG. 11 illustrates a graph depicting data indicative of dimensionless variation in stress versus dimensionless distance in a semi-infinite fracture, in accordance with an example embodiment.

FIG. 11 illustrates a graph 170 depicting data indicative of dimensionless variation in stress versus dimensionless distance in a semi-infinite fracture, in accordance with an example embodiment. Note that Green and Sneddon (1950) studied stress changes around elliptical fractures in elastic mediums. Elliptical shapes are closer to the shapes of actual planar hydraulic fractures. FIG. 5 shows the changes in stress distribution caused by the presence of an elliptical fracture. The changes in stress follow the same trend as do the changes caused by a semi-infinite fracture. For each principal stress, the change in stress over net pressure is plotted versus the distance perpendicular to the fracture plane normalized by the fracture height (see FIG. 9).

Figure 12:
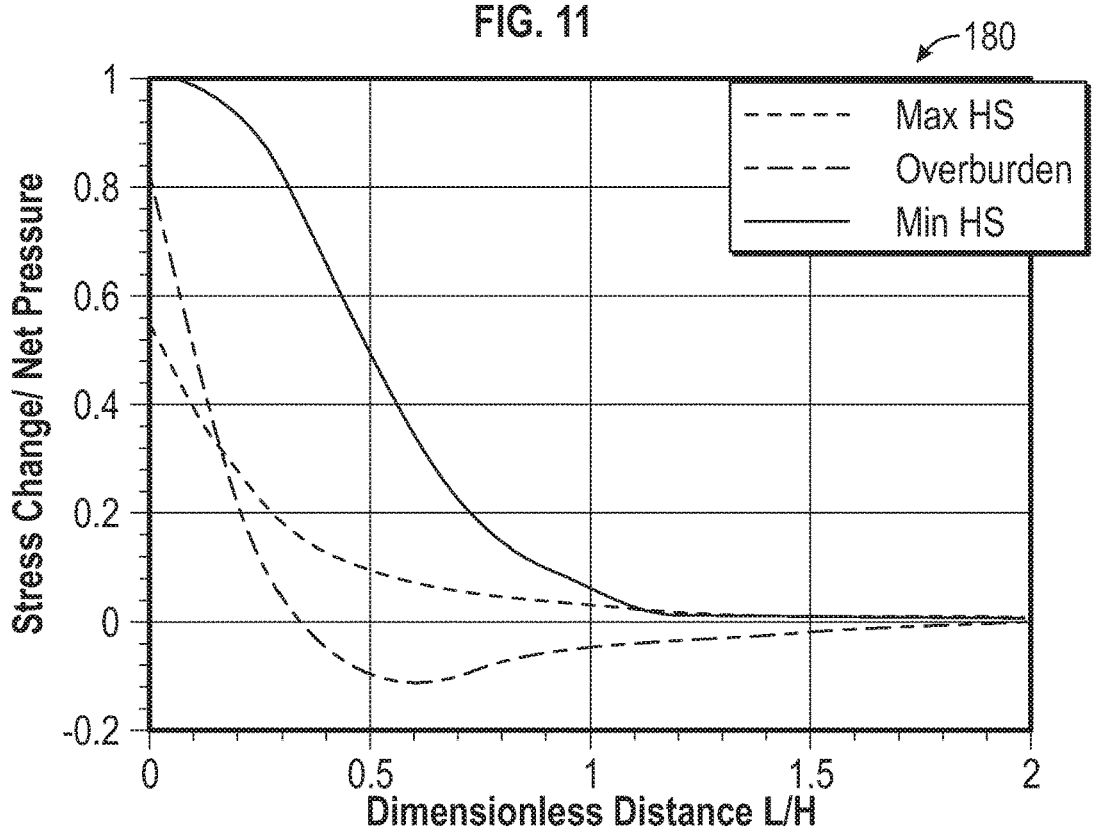
FIG. 12 illustrates a graph depicting data indicative of dimensionless variation in stress versus dimensionless distance in an elliptical fracture, in accordance with an example embodiment.

FIG. 12 illustrates a graph 180 depicting data indicative of dimensionless variation in stress versus dimensionless distance in an elliptical fracture, in accordance with an example embodiment. The magnitude of the minimum horizontal stress is increased by the compression in the formation caused by increases in fracture dimensions. Because increases in fracture widths are especially pronounced, increases in minimum horizontal stress are larger than increases in other principal stresses. When a fracture is ballooned, its net pressure increases until the difference between the horizontal stresses is minimized, after which point the minimum horizontal stress becomes the maximum horizontal stress.

Figure 13:
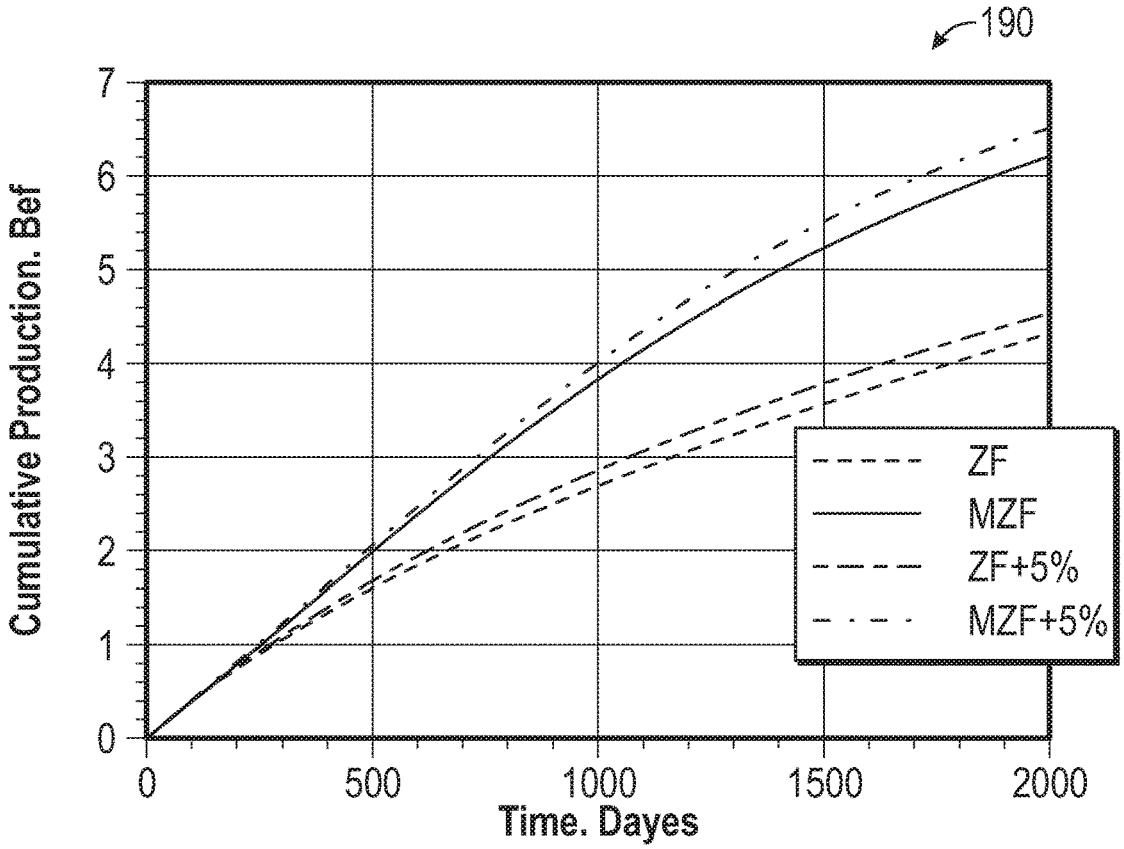
FIG. 13 illustrates a graph depicting data indicative of the effect of fracture placement on total production (zipper frac, zipper frac plus 5%, modified zipper frac and modified zipper frac plus 5%), in accordance with an example embodiment.

Rafiee (2012) used a simulation based on a typical hydraulic fracturing treatment at Barnett shale to compare zipper frac with modified zipper frac. Table 1 summarizes the hydraulic fracturing treatment data. Graph 190 in FIG. 13 depicts data demonstrating simulation results for cumulative production rates of zipper frac and modified zipper frac over a sample period 2000 days. A 5% increase with Optimized Modified Zipper Frac is assumed.

An optimistic projection assumes a 5% increase in cumulative production by OMZF over MZF. A pessimistic projection assumes a 5% increase in cumulative production by OMZF over ZF (i.e., see graph 190 in FIG. 13).

Graph 190 of FIG. 13 generally illustrates data indicative of the effect of fracture placement on total production (zipper frac, zipper frac plus 5%, modified zipper frac and modified zipper frac plus 5%), in accordance with an example embodiment.

TABLE 1

| Barnett shale properties for a typical fracturing treatment | |
|---|---|
| Fracture length | 492 ft |
| Fracture height | 197 ft |
| Net pressure | 500 psi |
| Minimum horizontal stress | 4900 psi |
| Original stress anisotropy | 100 psi |
| Overburden stress | 7000 psi |
| Pore pressure | 3900 psi |
| Young's module | $6.53 \times 10^6$ psi |
| Poisson's ratio | 0.2 |
| Coefficient of friction | 0.6 |

Figure 14:
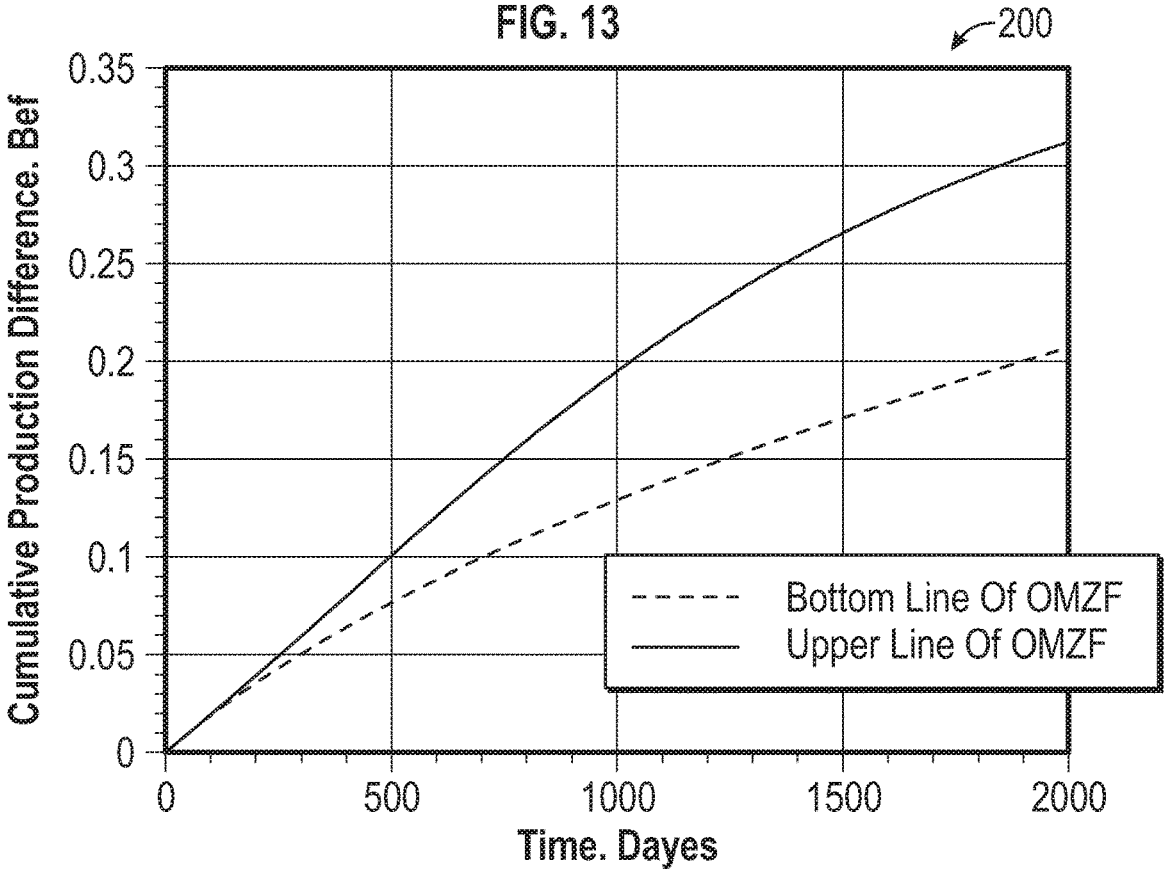
FIG. 14 illustrates a graph depicting data indicative of cumulative production difference, Bcf (zipper frac plus 5%, and modified zipper frac plus 5%), in accordance with an example embodiment.

FIG. 14 illustrates a graph 190 depicting data indicative of cumulative production difference, Bcf (zipper frac plus 5%, and modified zipper frac plus 5%), in accordance with an example embodiment. The cumulative increase in production yielded by OMZF after one year is estimated to be between 0.061 bcf and 0.07 bcf. If natural gas is priced at 3 USD per 1,000 cubic feet, then OMZF will yield between 188,000 and 217,000 additional USD per well in the first year. The cumulative increase in production yielded by OMZF after five years is estimated to be between 0.2 bcf and 0.3 bcf (630,000 USD to 910,000 USD).

Figure 15:
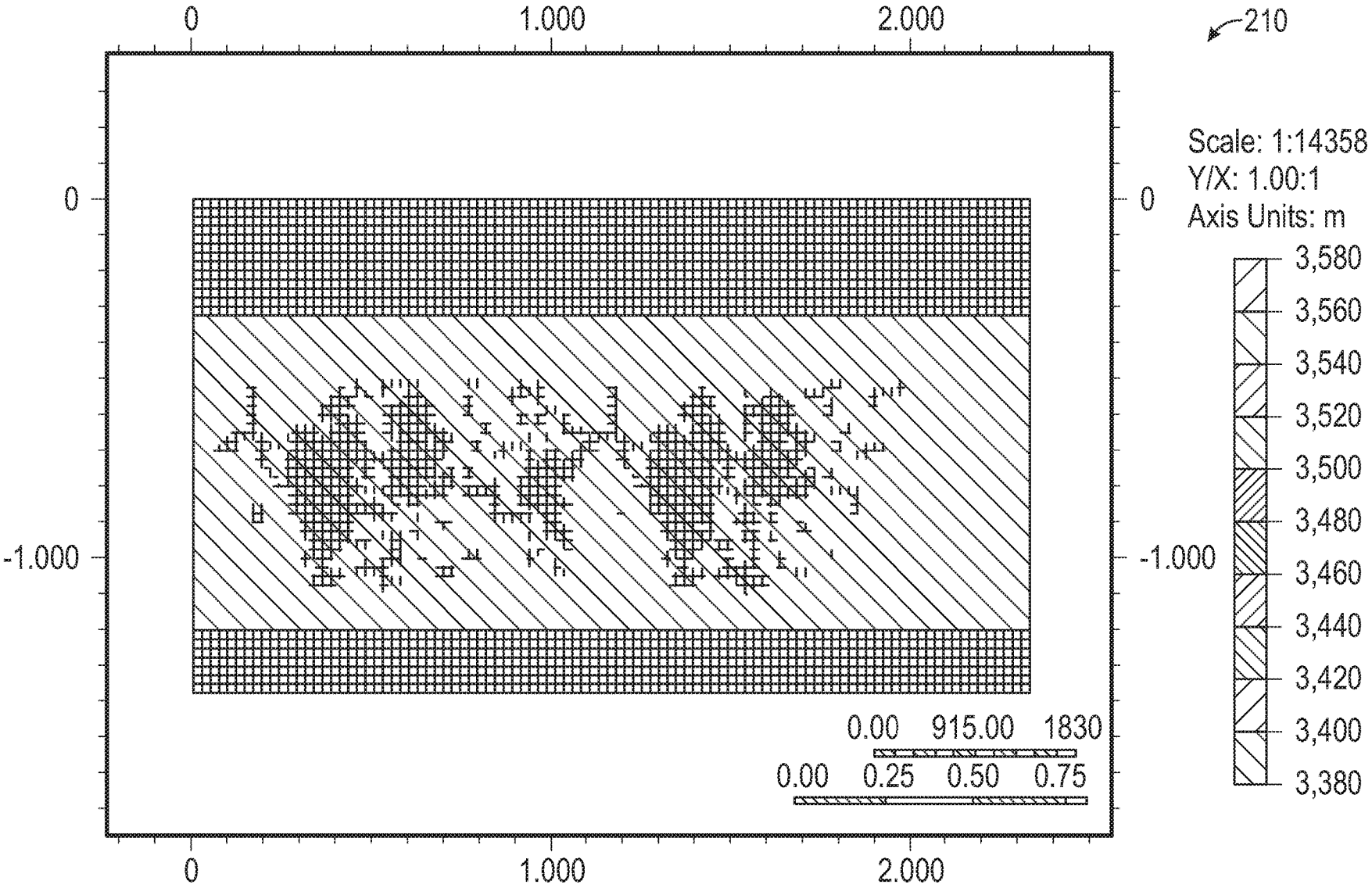
FIG. 15 illustrates a graph depicting data indicative of a shale gas reservoir model top view (SRV), in accordance with an example embodiment.

FIG. 15 illustrates a graph 210 depicting data indicative of a shale gas reservoir model top view (SRV), in accordance with an example embodiment. Note that the dual permeability model has dimensions of 2,325 meters (length), 1,375 meters (width) and 300 meters (thickness) and grid blocks of 93*55*3 (Table 1). The dual permeability model is generated in CMG IMEX and models SRVs to examine the effect of increasing near wellbore complexity and overall permeability on the total production rate of an example organic shale gas reservoir.

TABLE 2

| Model Dimensions | |
|---|---|
| Grid size | 93 * 55 * 3 |
| Grid dimension (X direction) | 93 * 25.0 meter |
| Grid dimension (Y direction) | 55 * 25.0 meter |
| Grid dimension (Z direction) | 3 * 100.0 meter |

Under original SRV conditions, the cumulative production after one year is 1.5 bcf. When the SRV's permeability is increased by MZF, the cumulative production increases to 1.53 bcf. When the SRV's permeability is increased by OMZF, the cumulative production reaches 1.6 bcf. Gas prices in the past five years ranged from 3 to 5 USD for 1 million British thermal units (MMBtu), or roughly 1,000 cubic feet. The minimum extra money gained by increasing complexity is 100,000 USD per one well for one year. Any increased production resulting from this work will help the petroleum industry to meet its ever-increasing demand.

Based on the foregoing, it can be appreciated that defined fracability and hydraulic fracture geometry are keys to optimizing multistage fracturing design. No single equation to quantify fracability and brittleness has been agreed upon. Fracability and resulting hydraulic fracture geometry, however, can be quantified using stress anisotropy and the brittleness indices of organic shale and tight reservoir formations. The major disadvantage of MZF is that it does not attain the stress shadow magnitude necessary to achieve maximize near wellbore complexity. MZF is optimized, therefore, by calculating the horizontal stresses and the mechanical properties of the target zone then ballooning fractures to reach this magnitude of stress shadowing.

The magnitude of the minimum horizontal stress is increased by the compression in the formation caused by increases in fracture dimensions. Because increases in fracture widths are especially pronounced, increases in minimum horizontal stress are larger than increases in other principal stresses. When a fracture is ballooned, its net pressure increases until the difference between the horizontal stresses is minimized, after which point the minimum horizontal stress becomes the maximum horizontal stress.

Using stress shadowing to increase an SRV's complexity and overall permeability is a good approach to increase recovery from unconventional reservoirs. Though Texas Two-Step and Modified Zipper Frac are good examples of this approach, the effect can be maximized through Optimized Modified Zipper Frac. Like Zipper Frac, OMZF decreases the operation cycle time significantly by allowing two teams (plug and perf and fracturing) to work simultaneously. OMZF requires a slightly longer cycle time than zipper frac. But, if fracturing two stages at a time, it will require more preparation and more horsepower. In this scenario, the near wellbore complexity will increase, and the operation efficiency will decrease (longer cycle time). Because ballooning fracture stages to achieve the desired net pressure and fracture dimensions may require fluids with higher viscosity and additional time, OMZF may needs extra operational expenses, to apply OMZF in the field, an estimate of maximum horizontal stress magnitude should be known to design for the required stress shadows magnitude required to optimize complexity. Wellbore failure analysis is needed for few vertical wells in the area.

Complex Toe-to-Heel Flooding (CTTHF)

The disclosed embodiments also involve a new completion strategy that can be implemented for increasing hydrocarbon recovery from both conventional and unconventional reservoirs. Different embodiments can be implemented for both types of reservoirs. The paper that includes this disclosure technique presents a simulation study, which is conducted to confirm the feasibility of the Complex Toe-to-Heel Flooding (CTTHF) technique by comparing it to 9 spots waterflood and Toe-to-Heel Flooding. The results of the study show that, sand formation is a favorable candidate of CTTHF, especially when it has good porosity, permeability and large formation thickness. Also, CTTHF has more advantages over conventional waterflooding and Toe-to-Heel flooding. Then, the simulation for the organic shale reservoir confirm that the cyclic inflation of injection fractures will increase hydrocarbon recovery. This increase can be maximized by injecting a slug of HCl, CO2 or Methane into the producing fractures while hydraulic fracturing the well.

For organic shale reservoir, or unconventional reservoirs, nano-darcy permeability currently precludes the field application of all proposed methods to increase hydrocarbon recovery by gas or liquid flooding and this disclosed technique avoids this limitation by manipulating stress dependent permeability. When trying to recover hydrocarbons from shale the disclosed technique begins with hydraulic fracturing of the horizontal section of well. A packer is then set and sealed a short distance from the toe and functions as a divide between the two horizontal sections. The portion between the heel and the packer is allocated for "producing fractures," which draw hydrocarbons from the formation. The portion between the toe and the packer is allocated for "ballooning fractures," into which are injected cyclic batches of a high viscous fluid. The ballooned fractures increase the horizontal stress gradient, squeezing additional hydrocarbons out of the formation by opening the shale micro fractures for longer periods of time. The disclosed technique also includes optimization for the injection schedule and a method for changing the location of ballooning fractures.

For sand reservoirs, a conventional reservoir, the design is implemented by first drilling horizontal wells parallel to the minimum horizontal stress direction and spaced to increase flood efficiency. The toes are placed on the same plane and the perforations close to those toes are used to inject a high viscous batch, which forms a non-permeable barrier along the reservoir. A proper plug is set to separate this barrier from the rest of the horizontal section. The remaining section is then perforated, and a suitable packer is set and sealed at a designed distance from the plug. The perforations between the plug and the packer are used for flood injection, and the perforations between the packer and the heel are used in production. Whenever the flooding material to hydrocarbon ratio increases significantly, the packer is pulled a designed distance back to the heel. The hydrocarbon is produced through the annulus, produced through the dual tubing, or produced by any other convenient technique.

Figure 16:
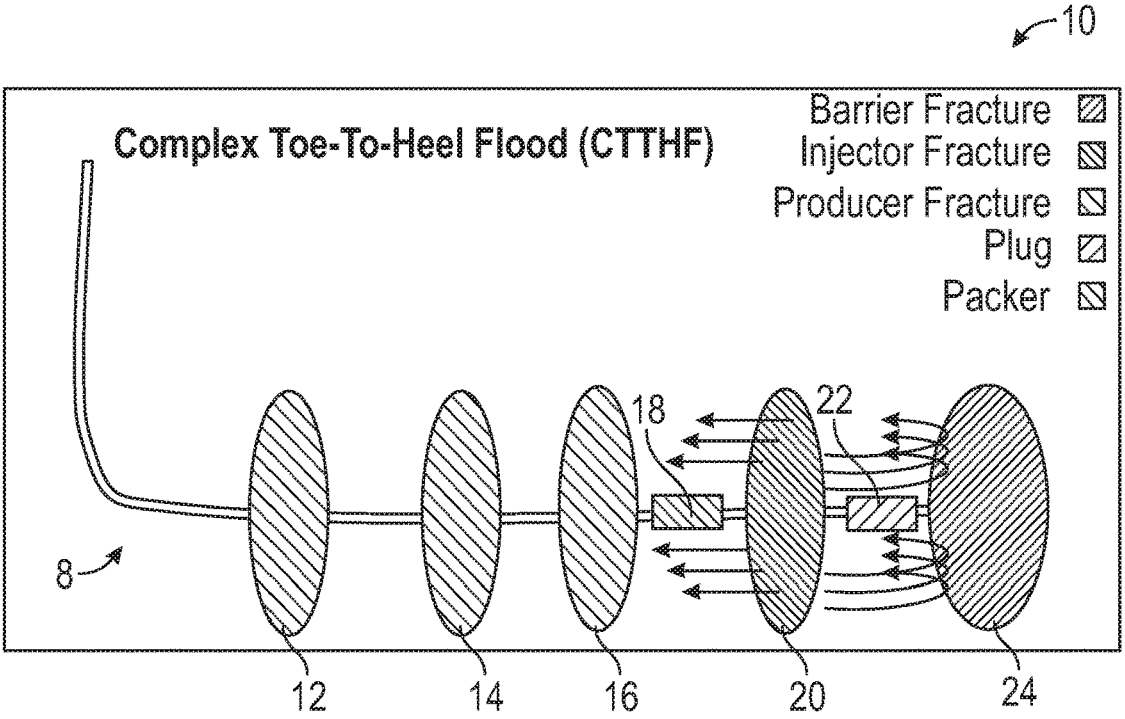
FIG. 16 illustrates a schematic diagram depicting a horizontal well in the context of a Complex Toe-to-Heel Flooding (CTTHF) system for use with conventional reservoirs, in accordance with an example embodiment.

FIG. 16 illustrates a schematic diagram depicting a horizontal well 8 in the context of a Complex Toe-to-Heel Flooding (CTTHF) system 10 for use with conventional reservoirs, in accordance with an example embodiment. The diagram 10 shown in FIG. 16 depicts the horizontal well 8 with respect to producer fractures 12, 14, and 16. A packer 18 is situated between the producer fracture 16 and an injector fracture 20. Additionally, a plug 22 is located between a barrier fracture 24 and the injector fracture 20.

Note that as utilized herein the term "packer" can refer to device that can be run into a wellbore with a smaller initial outside diameter that then expands externally to seal the wellbore. The packer 18 packer can employ flexible, elastomeric elements that expand. The two most common forms are the production or test packer and the inflatable packer. The expansion of the former may be accomplished by squeezing the elastomeric elements (somewhat doughnut shaped) between two plates, forcing the sides to bulge outward. The expansion of the latter is accomplished by pumping a fluid into a bladder, in much the same fashion as a balloon, but having more robust construction. Production or test packers may be set in cased holes and inflatable packers are used in open or cased holes. They may be run on wireline, pipe or coiled tubing. Some packers are designed to be removable, while others are permanent. Permanent packers are constructed of materials that are easy to drill or mill out.

The term "packer" as utilized herein can also refer to a downhole device capable of being used in almost every completion isolate the annulus form the production conduit, enabling controlled production, injection or treatment. Thus, in some example embodiments, the packer 18 may be implemented as a packer assembly incorporates that a means of securing the packer 18 against a casing or liner wall, such as a slip arrangement, and a means of creating a reliable hydraulic seal to isolate the annulus, typically by means of an expandable elastomeric element. Packers are classified by application, setting method and possible retrievability.

Figure 17:
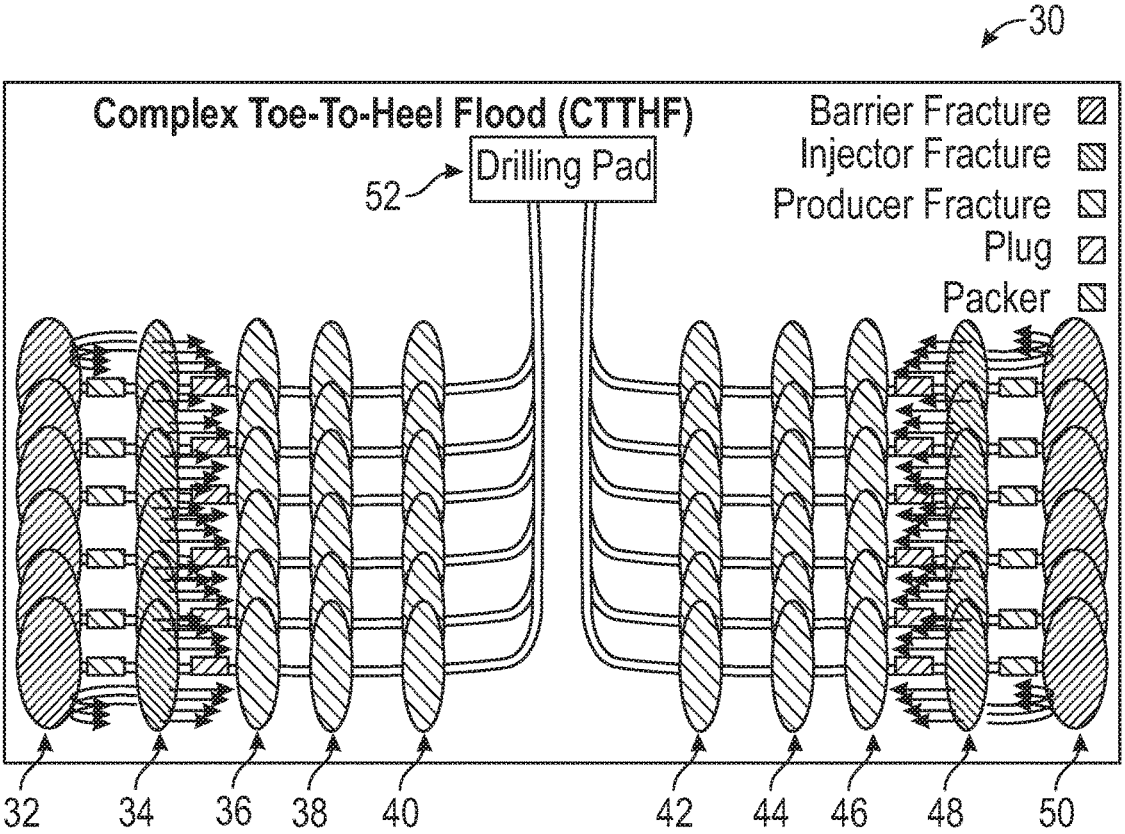
FIG. 17 illustrates a schematic diagram of a CTTHF system for use with conventional reservoirs, in accordance with an example embodiment.

FIG. 17 illustrates a schematic diagram of a CTTHF system 30 for use with conventional reservoirs, in accordance with an example embodiment. In the example embodiment depicted in FIG. 17 a group of barrier fractures 32 is shown to the left of a group injector fractures 34, which in turn is shown to the left of groups of producer fractures 36, 38, and 40. A group of producer fractures 42, 44, 46 is shown to the left of a group of injector fractures 48, which in turn as shown as left of group of producer fractures 50. A drilling pad 52 is also shown toward the top central portion of FIG. 17.

Figure 18:
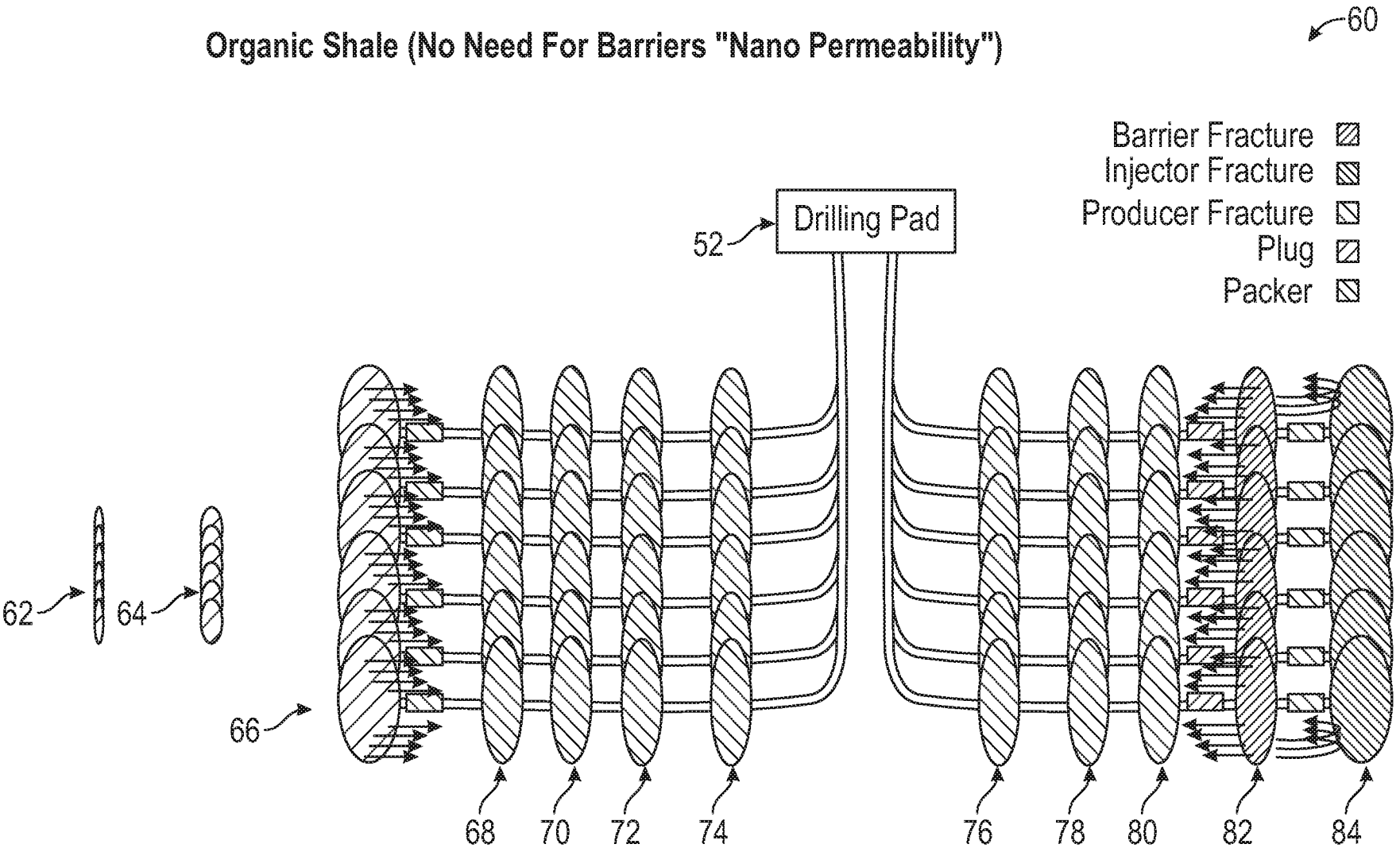
FIG. 18 illustrates a schematic diagram of a CTTHF system for use with nonconventional reservoirs, in accordance with an example embodiment.

FIG. 18 illustrates a schematic diagram of a CTTHF system 60 for use with nonconventional reservoirs, in accordance with an example embodiment. Note that in FIGS. 2-3 some similar parts are shown, which are indicated by identical reference numerals. For example, the drilling pad 52 of FIG. 17 is also shown in the arrangement depicted in FIG. 18. The drilling pad 52 is shown approximately between and above an organic shale area (generally to the left of the drilling pad 52) and a sandstone area (generally to the right of the of the drilling pad 52. The organic shale area includes a group of barrier fractures 66 located generally to the left of groups of producer fractures 68, 70, 72, and 74. Stress shadowing is also indicated with respect to the barrier fractures 66. A deflate 62 and an inflate 64 are show at the far left of the configuration depicted in FIG. 18. The sandstone area generally includes groups of producer fractures 76, 78, and 80 located to the right of a group of injector fractures 82. A group of barrier fractures 84 is shown to the right of the injector fractures 82. The embodiment shown in FIG. 18 can improve hydrocarbon production by cyclic inflation deflation of some fractures to stress shadow the producer fractures and improve production by stress dependent permeability (such as in shale gas).

CTTHF is thus a short distance flooding technique developed by the present inventors for sandstone formations. CTTHF is generally applied on horizontal wells and requires at least one barrier and injector hydraulic fracture, but also can incorporate at least one method to control early water production. The design aspects of CTTHF are discussed herein, including the design of barrier fracture, injector fracture, and the produced water control methods. Technical and economic evaluations for ranking different design setups are also discussed and presented herein.

Note that an advanced commercial reservoir simulator with a hydraulic fracturing module was used to simulate different CTTHF setups and reservoir conditions to set the reservoir selection criteria and proper design methodology. In an experimental simulation, Toe-to-Heel Waterflooding was considered as a base case. Sensitivity studies for barrier fracture and injector design are discussed in greater detail with respect to FIGS. 19-29. Moreover, sensitivity studies for hydraulic fractures spacing, the number of barrier fractures, and batch injection scheduling, and changing packer location have been performed.

When CTTHF is applied in high permeable sandstone formation, early water production is expected, except a produced water control method can be used. The disclosed example embodiments include feasibility conditions for each produced water control technique. In addition, a methodology for candidate reservoir selection, design of barrier and injector fractures has been developed and is discussed herein. Note that multiple fluid systems can be used to create a barrier to seal a pre-determined zone. CTTHF offers a better reservoir management approach.

A novelty of the disclosed CTTHF approach involves providing multiple options for produced water control that maximizes the produced oil and minimizes water production. CTTHF's produced water control approach thus can allow some reservoirs to actually increase production.

As discussed previously, in conventional waterflooding, water is injected via a vertical well and oil is produced via a second vertical well some distance from the first well. Sweep efficiency is critical for a waterflooding project to be successful, but it is reduced by water channeling due to reservoir heterogeneity and water/oil segregation, which is due to gravity and the density contrast between water and oil. The negative effects of these phenomena are aggravated by thick pay zones and unfavorable water/oil mobility ratios. A traditional method for overcoming these difficulties is to use polymers, surfactants, micro-foams, or other chemicals. Note that the term "pay zone" as utilized herein generally refers to the reservoir that is producing oil or gas within a particular wellbore.

A different approach to tackling these problems is to CTTHF, which is a short-distance waterflooding method. Instead of looking for ways to make the mobility ratio more favorable, CTTHF reduces its importance while taking advantage of the gravity segregation effect. CTTHF was introduced and developed by Texas Tech University of Lubbock, Tex. and is an enhanced version of Toe-to-Heel Waterflooding, which was developed by the Alberta Research Council of Canada. FIGS. 1 and 2 show schematics of TTHW and CTTHF, respectively.

Figure 19:
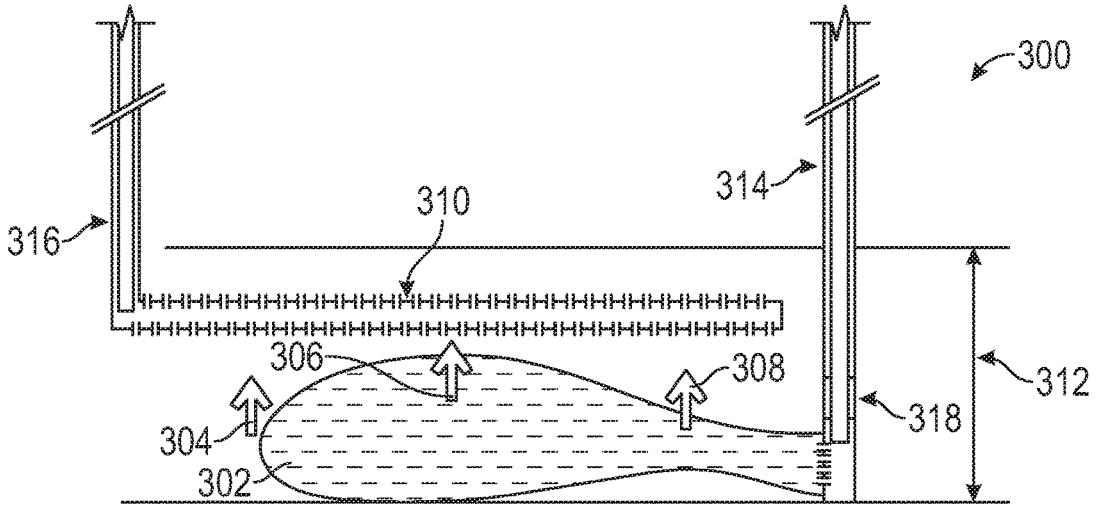
FIG. 19 illustrates a schematic diagram of a modified Toe-to-Heel Waterflooding (TTHW) configuration.

FIG. 19 illustrates a schematic diagram of a modified TTHW system 300, in accordance with an example embodiment. As shown in FIG. 19, the TTHW system 300 includes both vertical wells 314 and 316, and a horizontal well 310. The direction of oil extraction is indicated in FIG. 19 by arrows 304, 306, and 308, with respect to the water 310. A pay zone 312 is shown with respect to the horizontal well 310 and the water 302. A packer 318 is depicted in FIG. 19 with respect to the vertical well 314. The packer 318 is a production packer, which functions as a component of the completion hardware of the vertical well 314 used to provide a seal between the outside of the production tubing and inside casing, liner, or wellbore wall.

Figure 20:
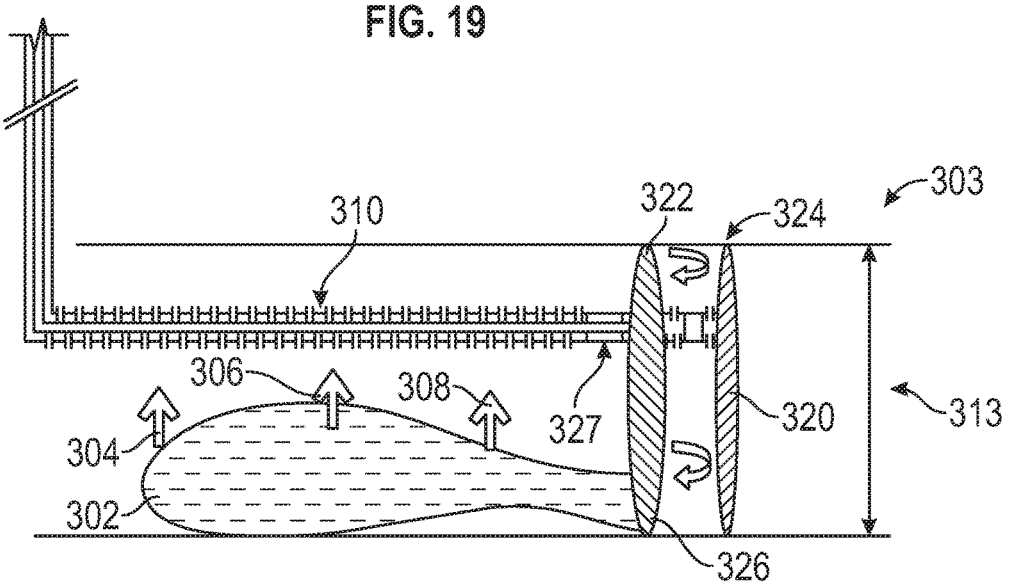
FIG. 20 illustrates a schematic diagram of another CTTHF system, in accordance with an example embodiment.

FIG. 20 illustrates a schematic diagram of a CTTHF system 303, in accordance with an example embodiment. Note that in FIGS. 19-21 some identical or similar parts are indicated by identical reference numerals. For example, the flow of oil (i.e., oil extracted via horizontal well 310) is indicated in FIG. 20 by reference numerals 304, 306, and 308 in a manner similar to that shown in FIG. 19. The horizontal well 310 is shown with respect to the arrows 304, 306, and 308 and with respect to the water 302. An injector frac 322 is shown in a generally narrow oval shape with respect to a barrier frac 320. A packer 327 is also shown located in the horizontal well 310 and to the left of the injector frac 322. A plug 324 is also located in the horizontal well 310 between the injector frac 322 and the barrier frac 320. The pay zone 313 is also shown in FIG. 20.

Figure 21:
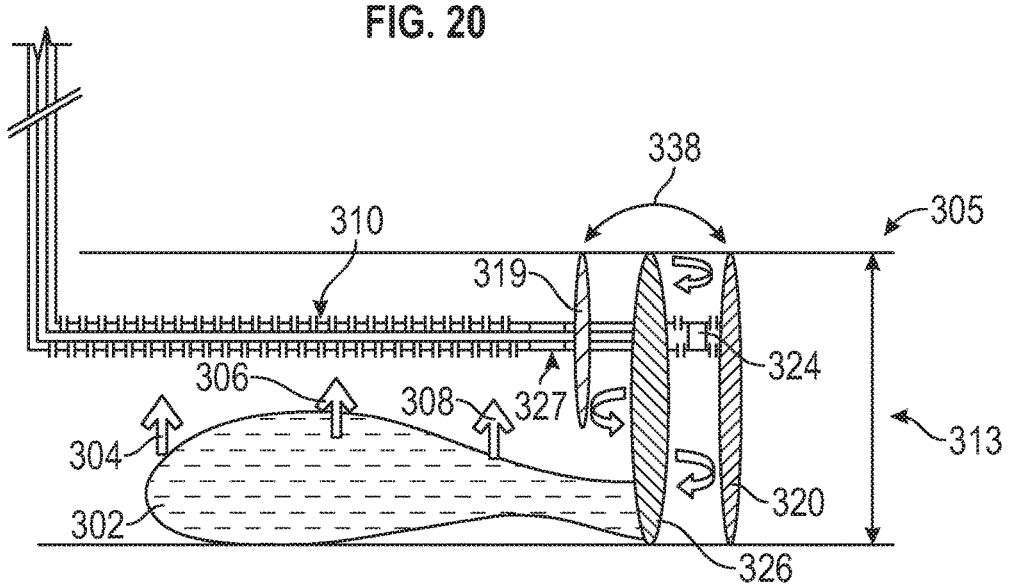
FIG. 21 illustrates a schematic diagram of a CTTHF system with multiple barriers used for water production control, in accordance with another example embodiment.

FIG. 21 illustrates a schematic diagram of a CTTHF system 303 with multiple barriers 319 and 324 used for water production control, in accordance with an alternative example embodiment. As shown in FIG. 21, an additional barrier 319 is shown located to the left of the injector frac 326. Thus, barrier fracs 338 are shown in FIG. 21 including at least the barriers or barrier fracs 319 and 320.

Thus, like TTHW, CTTHF relies upon on oil/water segregation due to gravity. For this reason, properly designing CTTHF wells requires considering reservoir properties (like permeability and porosity) and oil properties (like density and viscosity). In CTTHF, the vertical injectors used in TTHW are replaced by injector hydraulic fractures. At least one barrier fracture is also included to increase the efficiency of the injector hydraulic fracture. CTTHF maintains the same advantages as TTHW, but its water production control is better, its operation efficiency is higher, and its total expense is lower.

CTTHF offers a number of advantages. First, CTTHF enables greater ultimate oil recovery than other techniques. Second, CTTHF requires significantly fewer wells to produce a reservoir than does TTHW (more economic). Third, CTTHF does not require vertical injectors, making CTTHF significantly less expensive than conventional approaches. Finally, CTTHF is compatible with multiple water-cut control techniques such as packer location change, multiple barrier fractures, and cyclic batch injection.

As discussed previously, the disadvantages of CTTHF are limited. For example, CTTHF can only be applied to reservoirs with specific properties under specific conditions (see the criteria and conditions of TTHW and CTTHF). Second, without water-cut control, CTTHF may produce more water than TTHW.

It should be appreciated that while TTHW requires the drilling of a vertical injector well—a vertical injector well of an average depth (e.g., 6,000 ft.) can cost 3 to 5 million USD—CTTHF requires only a barrier and an injector fracture, which combined cost approximately 0.5 to 0.7 million USD on average. In addition, CTTHF produces less water than does TTHW and thus requires less handling of produced water. For these reasons, even though CTTHF requires additional everyday operations, workover operations, and completion equipment, the total cost of CTTHF is much less than the total cost of TTHW.

CTTHF can be successfully applied to reservoirs that meet the criteria listed below. These criteria are based on the results of limited field tests, laboratory tests, and numerical simulations of these tests that have been done for TTHW and/or CTTHF. A candidate reservoir should meet the following criteria:

1. It must have no initial gas cap.
2. It must have no extensive fracturing (either natural or induced).
3. Its formation type should be unconsolidated sand or sandstone.
4. Its pay thickness should be greater than 6 m (~20 ft.).
5. Its oil viscosity at reservoir conditions should be less than 2,000 mPa·s (2,000 cp).
6. Its oil density at surface conditions should be less than 980 kg/m$^3$.
7. Its vertical permeabilities to horizontal permeabilities should be greater than 0.25.
8. Its horizontal permeabilities should be greater than 200 mD.
9. Its vertical permeabilities should be greater than 50 mD.
10. Its water cut should be less than 80%.

The last three criteria can be relaxed if the permeability increases with depth (e.g., in fluvial depositions) or there is streak of high permeability at the bottom of the pay.

Regarding the concept of water-cut control, when CTTHF is applied, there are four different options for controlling water production. The first option is to move the packer heel-side when needed (e.g. when the water-cut increases). The second option is to inject and produce in designed batches (i.e. to periodically inject for a designed period of time then stop and produce for a designed period of time). The third option is to use at least one ICD (Inflow Control Device) and inflow valves. The fourth option is to create multiple barriers heel-side from the injector fracture to delay the intrusion of water into the producing perforations. One or a combination of these water-cut control techniques can be used during the life of a well.

Note that an evaluation field test by AITF and Enerplus Corporation (2010) and lab work and a simulation study by AITF (2011) compared TTHW with inverted nine-spot waterflooding. Each confirmed the superior efficiency of TTHW. The following section describes a new simulation study in which a commercial reservoir simulator was used to compare CTTHF and TTHW. Table 3 below presents the main properties of the Medicine Hat Glauconitic C Reservoir, which is located in Alberta, Canada. It should be appreciated that the various parameters and results discussed below and herein are presented for general illustrative and exemplary purposes only and are not considered limiting features of values of the disclosed embodiments.

TABLE 3

Medicine Hat Glauconitic C reservoir main properties.

| | |
|---|---|
| Formation | Sandstone—Glauconitic |
| Average pay thickness | 30 ft. |
| Depth | 3000 ft. |
| Lateral length | 5000 ft. |
| Porosity | 22%-25% |

TABLE 3-continued

Medicine Hat Glauconitic C reservoir main properties.

| | |
|---|---|
| Permeability | 600 md |
| Current oil saturation | ~63% (Soi = 68%) |
| Viscosity (live oil at BPP) | 400 to 1000 cp @ 79° F. (res. temp) |
| Oil gravity | 12° to 16° API |
| Initial pressure | 1476 psi |
| Bubble point pressure (BPP) | 798 psi |
| Current pressure | 435 psi |
| OOIP | 258 × 10$^6$ bbl. |

To compare the oil productions and water productions of different arrangements of TTHW (i.e., see FIG. 22) and CTTHF (i.e., see FIG. 23), six different well setups were simulated. Case 1 shown in FIG. 22 simulates TTHW with a vertical injector 364 at the toe of a horizontal producer 350. Case 2 shown in FIG. 22 simulates TTHW with a vertical injector 370 in the middle zone between the toes of two adjacent horizontal producers. Case 3 shown in FIG. 23 simulates CTTHF in which one or more ICVs 378, 380, and 382 are used to control water production. Case 4 shown in FIG. 23 simulates CTTHF in which multiple barriers 402, 406, and 410 are used to control water production. Case 5 shown in FIG. 23 simulates CTTHF in which the location of the packer is changed to control water production. Case 6 shown in FIG. 23 simulates CTTHF in which cyclic batch injection is used to control water production.

Two example injection rates are used in each case: 500 bbl./day and 1,000 bbl./day. For simplicity, the maximum liquid production rates were constrained so that they were equal to the injection rates. It was assumed that the reservoir had no initial water at the start of the flooding project.

Figure 22:
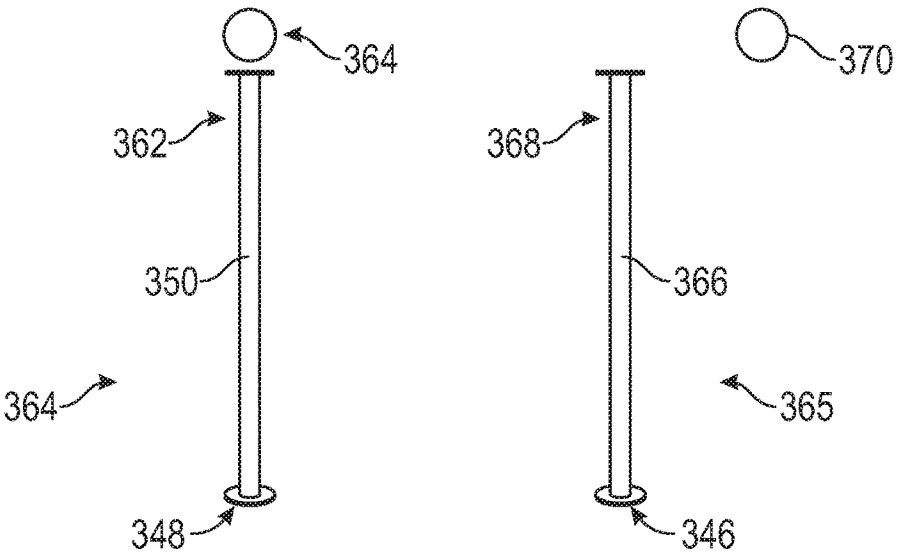
FIG. 22 illustrates schematic diagrams of a TTHW arrangement or system with a vertical injector at the toe of a horizontal producer (case 1) and a TTHW system with a vertical injector in the middle zone between the toes of two adjacent horizontal producers (case 2), in accordance with varying example embodiments.

FIG. 22 thus illustrates schematic diagrams of a TTHW arrangement or system 364 with the vertical injector 364 at the toe 362 of a horizontal producer 350 (i.e., case 1) and a TTHW system 365 with the vertical injector 370 located in the middle zone between the toes of two adjacent horizontal producers (i.e., case 2), in accordance with varying example embodiments. Note that in case 1, a heel 348 is shown with respect to the horizontal producer 350. In case 2, a heel 346 is shown with respect to the horizontal producer 366.

Figure 23:
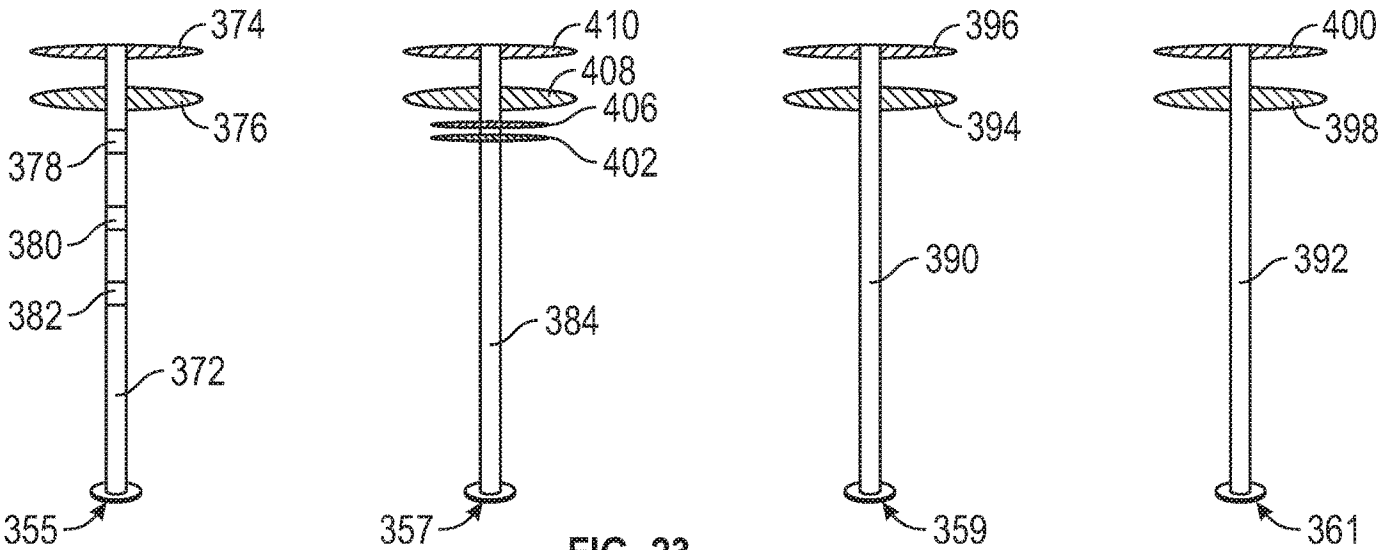
FIG. 23 illustrates schematic diagrams of a CTTHF system using ICVs (case 3), a CTTHF system using multiple barrier fractures (case 4), a CTTHF system using packer location change (case 5), and a system CTTHF using batch injection (case 6), in accordance with varying example embodiments.

FIG. 23 illustrates schematic diagrams of a CTTHF system using ICVs (case 3), a CTTHF system using multiple barrier fractures (case 4), a CTTHF system using packer location change (case 5), and a system CTTHF using batch injection (case 6), in accordance with varying example embodiments.

In case 3 illustrated in FIG. 23, the horizontal producer 372 includes one or more ICV's 378, 380, and 382. A heel 355 is shown in case 3 with respect to the horizontal producer 372, and an injector fracture 376 is also shown with respect to a barrier fracture 374. An ICV (Inflow Control Valve) such as ICV 378, 380, and/or 382 is an active component used to partially or completely choke off water flowing into a well completion. ICVs can be installed along the reservoir section of the completion, with each valve typically separated from the next via a packer. Each valve can be controlled from the surface to maintain flow conformance and, as the reservoir depletes, to stop unwanted fluids from entering the wellbore. A permanent downhole cable containing electric and hydraulic conduits is used to relay commands from the surface to the valves. ICVs are the most efficient water production control technique, but they are also the most expensive. One of the main advantages of ICVs is that they can be operated without shutting down the well.

In case 4 shown in FIG. 23, a heel 357 is shown with respect to the producer 384. Barrier fractures 402, 406 and 410 are also shown with respect to an injector fracture 408. In the example of case 4, one or multiple non-permeable hydraulic fractures such as fractures 402 and 406 can be created heel-side of the injector frac 408 to block the inflow of water and delay its intrusion into the producing zone. Some of the main disadvantages of creating multiple barrier fractures are that this approach cannot be accomplished without shutting down the well, which can be expensive, and is generally not as efficient as using ICVs.

Case 5 shown in FIG. 23 depicts a change in the packer location of the horizontal producer 390, along with an injector fracture 394 and a barrier fracture 396. Changing the packer location is one technique for controlling water production. First, the packer is set an appropriate distance from the injector frac 394 to separate the injection portion from the production portion. Then, when the water cut starts to increase, the well or producer 390 can be shut down for few hours to pull the packer heel-side a designed distance. This process is repeated until the packer comes very close to the heel 359. Changing the packer location is an economic technique, but not as efficient as using ICVs. One of the main disadvantages of changing the packer location is that it cannot be accomplished without shutting down the well/producer 390.

Case 6 illustrated in FIG. 23 depicts the case of a batch injection technique for a producer 392 along with an injector fracture 398 and a barrier fracture 400. In this technique, a batch of flooding water is injected over a period of time during which oil is not produced. Then, oil is produced without injecting water. This increases the chance that gravity will cause the water to settle to the bottom of the reservoir and push the oil upward towards the producing zone. Batch injection is an economic technique, but not as efficient as using ICVs. One of the main disadvantages of batch injection is that it requires oil production to be stopped.

Figure 24:
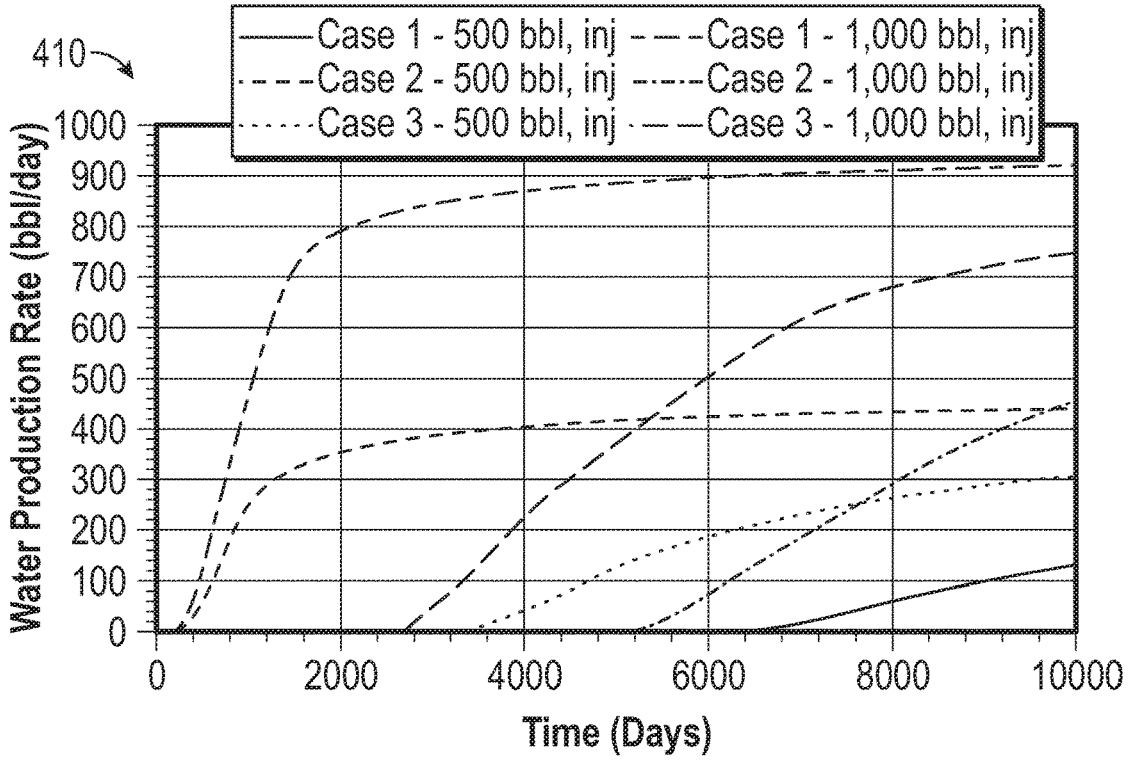
FIG. 24 illustrates a graph depicting data indicative of water production rate versus time for CTTHF and TTHW using injection rates of 500 bbl./day and 1,000 bbl./day, in accordance with an example embodiment.

FIG. 24 illustrates a graph 410 depicting data indicative of water production rate versus time for CTTHF and TTHW using injection rates of 500 bbl./day and 1,000 bbl./day, in accordance with an example embodiment. The graph 410 shown in FIG. 24 presents the water production rate for cases 1-3.

Figure 25:
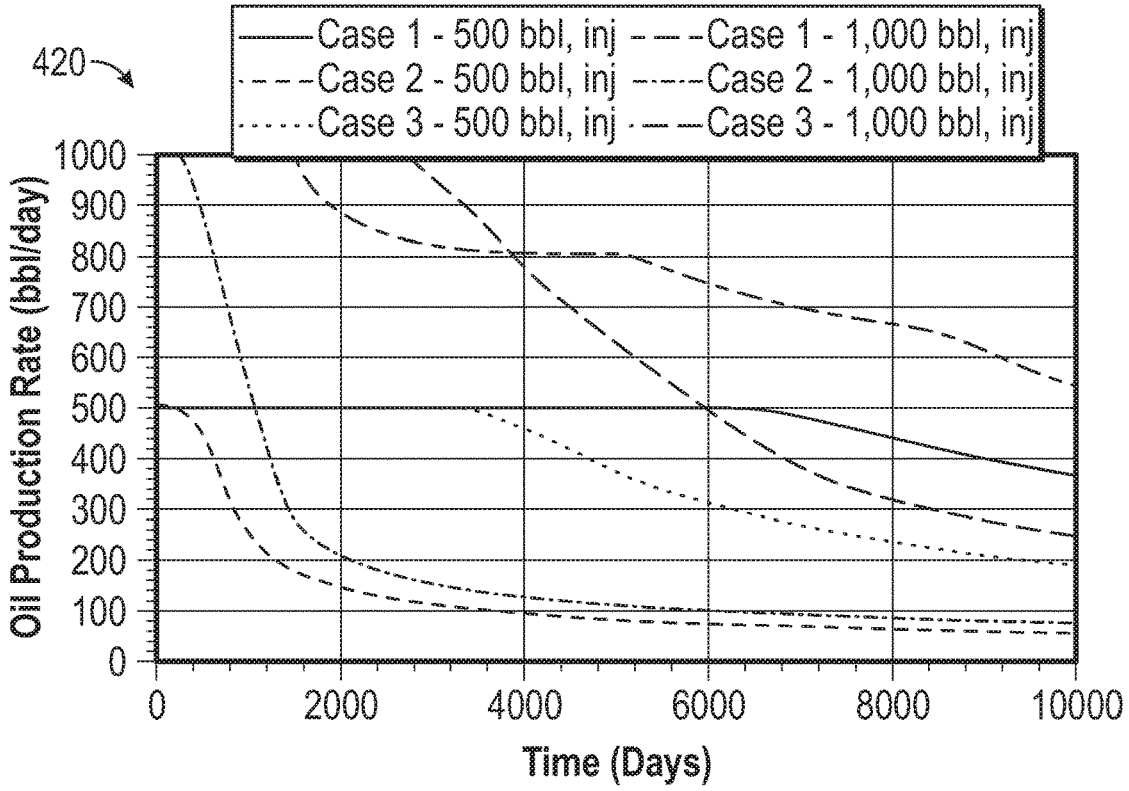
FIG. 25 illustrates a graph depicting data indicative of oil production rate versus time for CTTHF and TTHW using injection rates of 500 bbl./day and 1,000 bbl./day, in accordance with an example embodiment.

FIG. 25 illustrates a graph 420 depicting data indicative of oil production rate versus time for CTTHF and TTHW using injection rates of 500 bbl./day and 1,000 bbl./day, in accordance with an example embodiment. The Graph 420 shown in FIG. 25 presents the oil production rate for cases 1-3.

Figure 26:
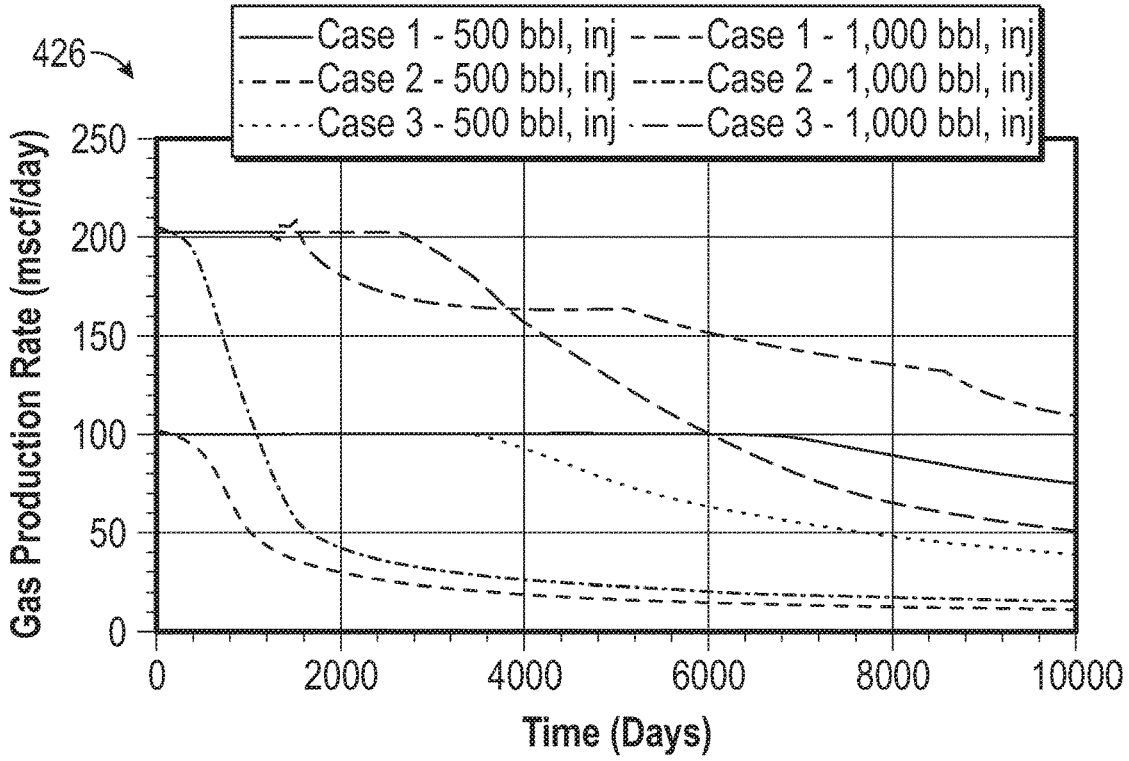
FIG. 26 illustrates a graph depicting data indicative of gas production rate versus time for CTTHF and TTHW for injection rates of 500 bbl./day and 1,000 bbl./day, in accordance with an example embodiment.

FIG. 26 illustrates a graph 426 depicting data indicative of gas production rate versus time for CTTHF and TTHW for injection rates of 500 bbl./day and 1,000 bbl./day, in accordance with an example embodiment. FIG. 26 presents the gas production rate for cases 1-3. FIG. 26 thus presents the oil production rate for each case. The effects of water control on the oil production rates in cases 1-3 are also clear (i.e., for CTTHF).

As shown in graph 410 of FIG. 4, during the two CTTHF runs, the ICVs were used to restrict the producing zone, limiting the production of injected water for a period of time. Other water control techniques however, are also valid. In cases in which the 1,000 bbl./day injection rate was used, water control was applied for 5,200 days, beginning on the first day of production. In cases in which the 500 bbl./day injection rate was used, water control was applied for 6,400 days, beginning on the first day of production. In all cases, water control was stopped after the final day to reveal what its effect had been on water production; water production increased significantly and very quickly, revealing that the water control techniques had been critical to minimizing water production. It is clear from the simulation results presented in FIGS. 24, 25, and 26) that CTTHF limited water production more efficiently and stabilized oil production for a longer period of time than did the other techniques.

Figure 27:
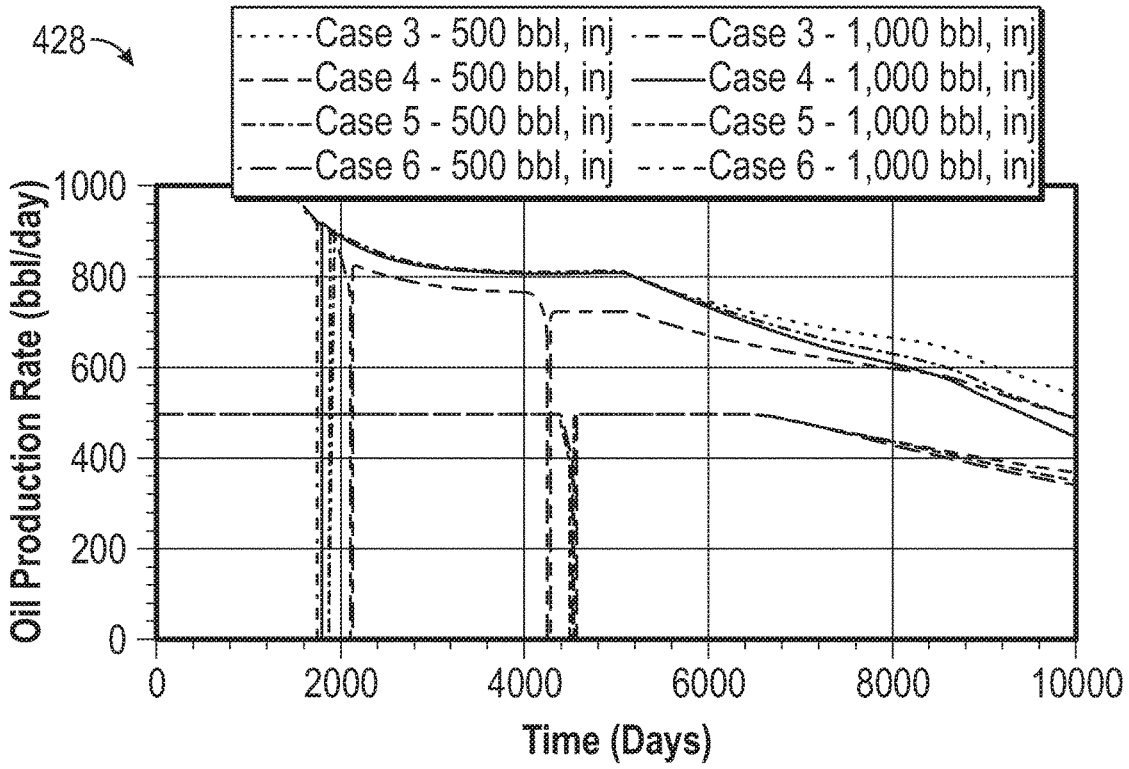
FIG. 27 illustrates a graph depicting data indicative of oil production rate versus time for CTTHF (Cases 3-6) using injection rates of 500 bbl./day and 1,000 bbl./day, in accordance with an example embodiment.

FIG. 27 illustrates a graph 428 depicting data indicative of oil production rate versus time for CTTHF (Cases 3-6) using injection rates of 500 bbl./day and 1,000 bbl./day, in accordance with an example embodiment. The graph 428 shown in FIG. 27 generally indicates gas production for cases 1-3. In each case, the reservoir pressure was below the bubble point pressure. The dissolved gas was released from the oil as the reservoir pressure decreased.

Figure 28:
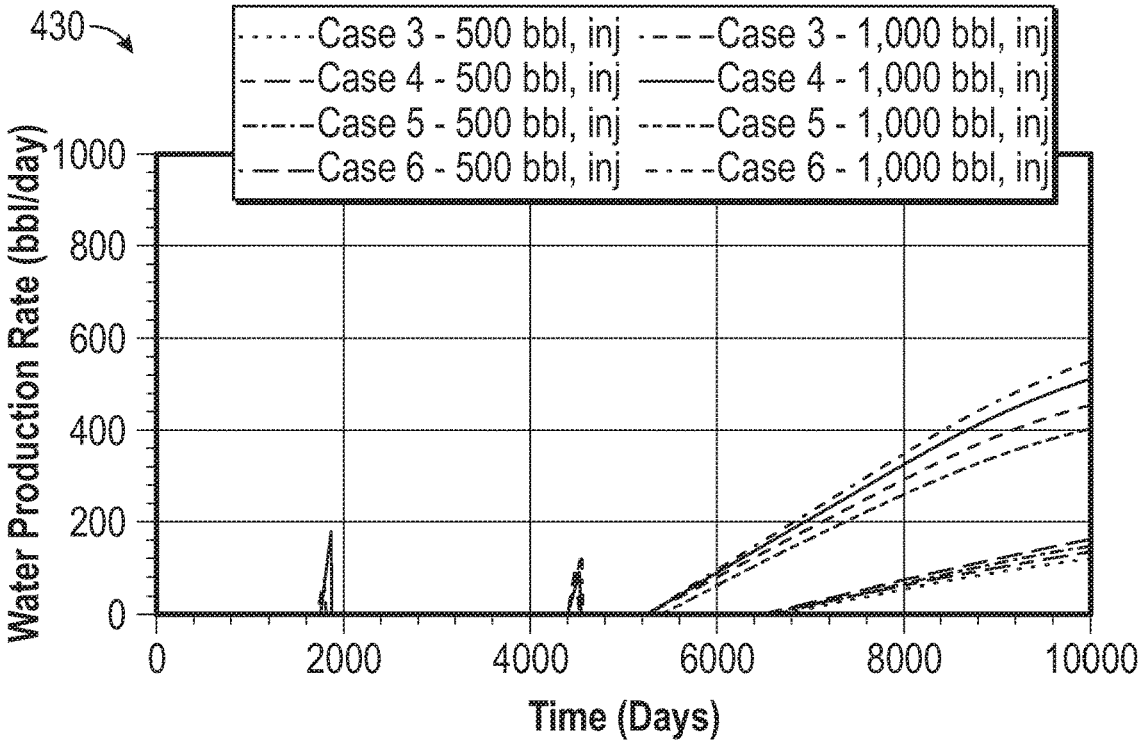
FIG. 28 illustrates a graph depicting data indicative of water production rate versus time for CTTHF (Cases 3-6) using injection rates of 500 bbl./day and 1,000 bbl./day, in accordance with an example embodiment.

FIG. 28 illustrates a graph 430 depicting data indicative of water production rate versus time for CTTHF (Cases 3-6) using injection rates of 500 bbl./day and 1,000 bbl./day, in accordance with an example embodiment. Graph 430 thus presents the oil production for cases 3-6. In cases 3-6 the ICV (case 3), multiple barrier fractures (case 4), packer location change (case 5), and designed batch injection (case 6) are applied as water production control.

Figure 29:
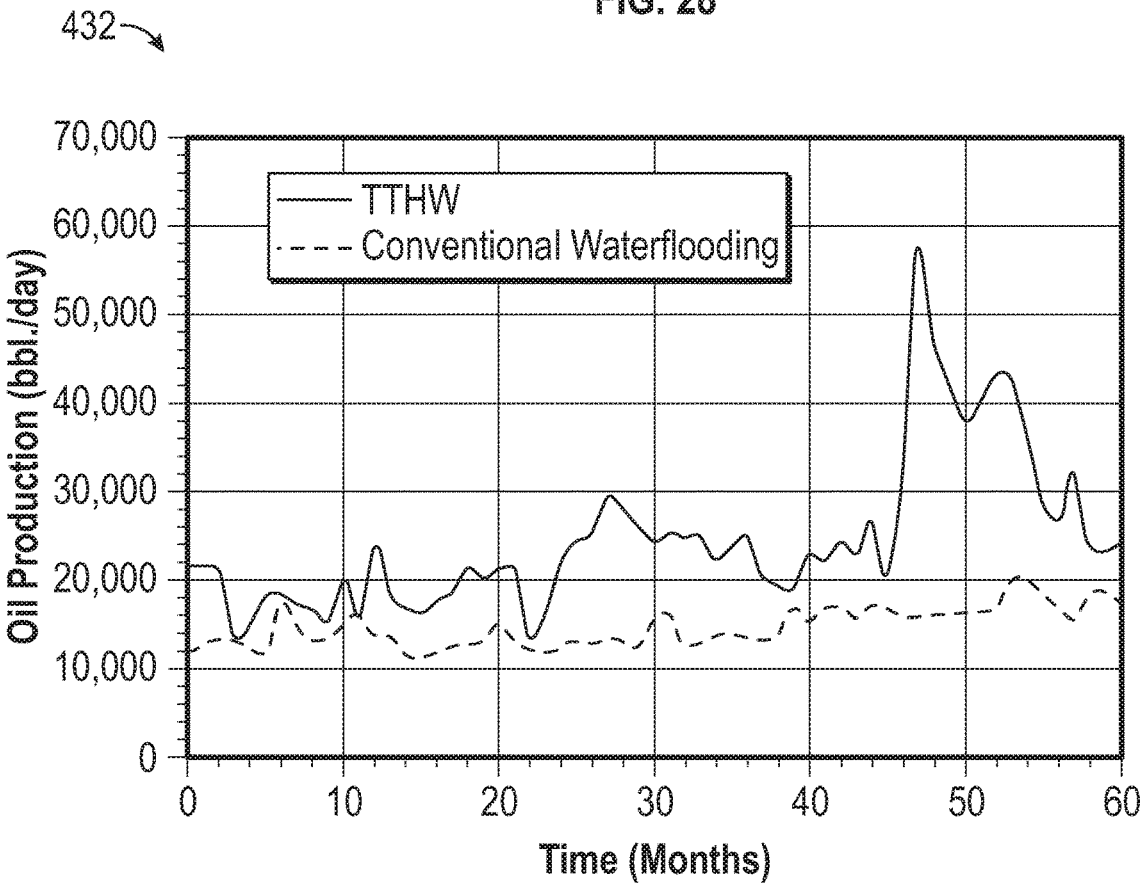
FIG. 29 illustrates a graph depicting data indicative of the statistical comparison of performance of TTHW and conventional waterflooding horizontal producers in the Medicine Hat Glauconitic C (Alberta, Canada)

FIG. 29 illustrates a graph 432 depicting data indicative of the statistical comparison of performance of TTHW and conventional waterflooding horizontal producers in the Medicine Hat Glauconitic C (Alberta, Canada). Graph 432 presents the water production for cases 3-6. In cases 3-6 the ICV (case 3), multiple barrier fractures (case 4), packer location change (case 5), and designed batch injection (case 6) are applied as water production control.

The main advantage of CTTHF over conventional waterflooding and TTHW is that it provides a variety of options to control water production and is thus applicable to most sandstone formations. Note that toe-to-Heel Waterflooding has been field tested, and its viability has proven. In a field test performed between 2001 and 2007 by AITF and Enerplus Corporation (2010), TTHW yielded higher cumulative oil production rates over 60 months of production than did 9-spot waterflooding, even though 124 wells (42 vertical water injectors and 82 vertical producers) were used in the 9-spot waterflooding and only 28 wells (10 vertical injectors and 18 horizontal producers) were used in the TTHW. As FIG. 29 shows, the horizontal producers used in the TTHW performed better throughout the entire 60 months than did the horizontal producers used in the conventional waterflooding. Due to the limitation on data presented on the reference, it is not clear the reason of some spikes in oil production rate. It is speculated that this may be due to a certain amount of open/shut wells or workover operations performed over some wells.

Although CTTHW has not been field tested yet, simulations show that CTTHF would yield even better production rates and greater oil recoveries than does TTHW.

CTTHF can replace TTHWs vertical injector with at least two transverse hydraulic fractures placed at the toe of the horizontal lateral. The first fracture functions as a non-conductive barrier and is used better manage the influx of injected water and to create a small difference in water pressure ($\Delta P$) between itself and the injector fracture. This small $\Delta P$ encourages water to settle below the oil due to its higher density and to spread across the bottom of the producing well. As it does so, it pushes the oil upward toward the producing section. The second fracture functions as an injector fracture, serving the same function as TTHWs vertical injector well. Oil can be produced via any convenient technique, including dual tubing and producing from the annulus.

Because CTTHF's barrier fracture focuses injected water toward the heel, CTTHF cannot be efficiently applied unless water production control techniques are employed. Without such techniques, CTTHF produces more water than TTHW. These techniques include, but are not limited to, changing the packer location, adding more barriers heelward from the injector side, injecting in batches (injecting for a designed period of time then producing for a designed period of time), and using inflow control devices/inflow control valves.

ICVs are the most efficient water production control technique, but they are also the most expensive. One of the main advantages of ICVs is that they can be operated without shutting down the well.

A highly conductive injector fracture is critical to the successful application of CTTHF. Designing for proppant settling is very important because proppant settling ensures that injector fractures are very thin and relatively nonconductive at the top and fat and very conductive at the bottom. Controlling the injection rate is also critical to applying CTTHF successfully: the slower the rate (within a designed range), the better the segregation of oil and water by gravity.

Predicting the location of the water front using reservoir simulations is important to designing water production control techniques. For every CTTHF reservoir, the results of simulations should recommend one or a combination of water control techniques.

CTTHF increases more the oil recovery of an oil reservoir under the mentioned selection criteria than other short distance flooding techniques such as TTHW. Monitoring the pressures of the production tubes, the injection tubes, and the annulus is important in tracking malfunctions. Additionally, produced water can be re-injected into the reservoir as a part of the flooding operation design.

The disclosed embodiments offer preferred and alternative fracturing approaches. For example, the disclosed non-permeable barrier embodiment can result in an enhanced sweep efficiency by focusing the flooding material into an exact volume of the reservoir. In addition, the disclosed embodiments offer improved reservoir management practice for sand reservoirs, and changing the location of the packer facilitates minimization of the production of the flooding material. The disclosed approaches have also been proven to be actually field applicable while increasing hydrocarbon recovery over conventional approaches. Potential applications of the disclosed embodiments include sand and organic shale reservoirs.

Additional Discussion Regarding OZF (Optimized Zipper Frac)

Returning now to OZF, as discussed previously OZF is a fracturing technique developed for organic shale reservoirs that maximizes near-wellbore complexity and, thus, overall permeability and hydrocarbon recovery. This technique covers all aspects of OZF design, including the optimum properties and volumes of fluids for ballooning fractures and the optimum stress shadow magnitude to be generated within a given zone before it is fractured. In addition, OZF presents sensitivity studies into the ballooning of fractures by increasing the volumes or changing the properties of injected fluids. Moreover, OZF includes the use of well spacing, perforation clusters, stage spacing, and fracturing schedule.

To generate a design methodology for OZF, an advanced commercial reservoir simulator with a hydraulic fracturing module was used to simulate different completion strategies for a variety of organic shale sweet-spots, each of which was described in a data set imported from a different shale play. This simulator was also used to calculate the ballooned fracture dimensions needed to generate the optimum stress shadow for fracturing a given reservoir zone. It is also used to optimize the well spacing, stage spacing, and fracturing schedule.

The results affirm the feasibility of OZF. Although a large proportion of the simulated horizontal wells required fluids with higher-than-normal slick-water viscosities or larger-than-normal fluid volumes per frac stage, OZF is more economical than Zipper Frac (ZF) because it does not require that the entire horizontal section be fractured and it allows higher production rates and greater hydrocarbon recovery. Because stress shadows can cause imbalances in the horizontal stress magnitudes when only two wells are simultaneously completed using OZF, this paper advocates completing three wells at a time to avoid asymmetric fracture growth. The results confirm that OZF is a better completion strategy to plan for future re-fracturing than other strategies. A methodology of re-fracturing candidate evaluation is developed and presented.

As indicated previously, OZF maintains the benefits and avoids the disadvantages of ZF, Alternate Fracturing (AF), and Modified Zipper Frac (MZF). Moreover, OZF is operationally simple and more feasible than these techniques. By increasing hydrocarbon recovery without increasing costs, OZF can help producers to efficiently meet the ever-increasing demand for energy.

Figure 30:
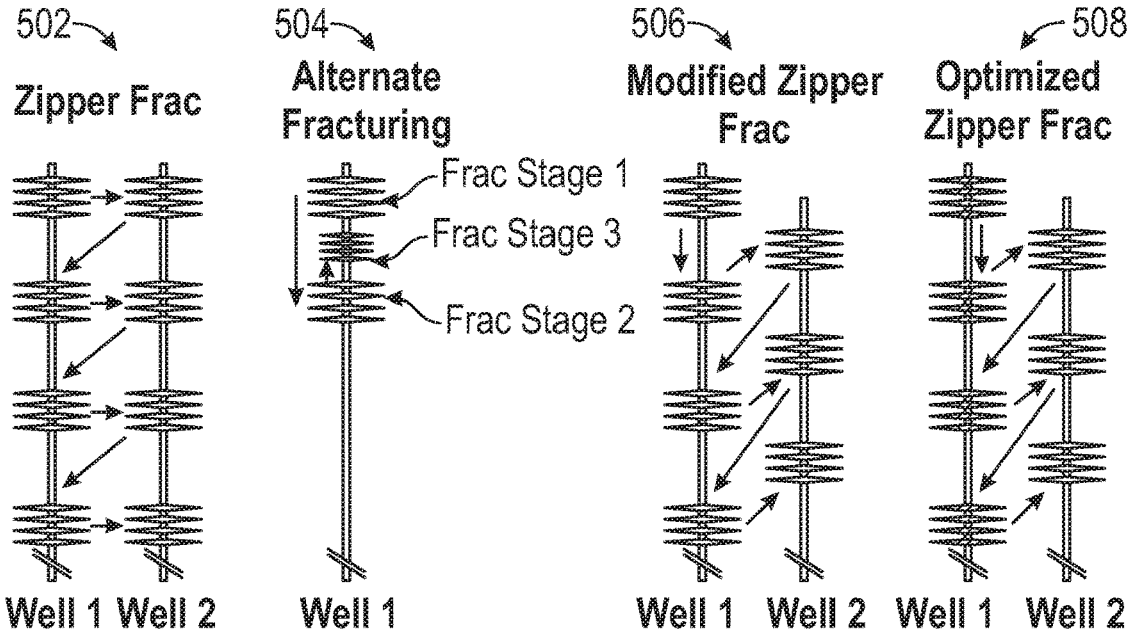
FIG. 30 illustrates schematic diagrams depicting a Zipper frac, alternating fracturing, a modified zipper frac, and an optimized zipper frac, in accordance with the disclosed embodiments.

FIG. 30 illustrates schematic diagrams depicting a Zipper frac 502, alternating fracturing 504, a modified zipper frac 506, and an optimized zipper frac 508, in accordance with the disclosed embodiments. Zipper fracturing has been adopted by companies in recent years as a method for completing horizontal wells in organic shale plays. Instead of hydraulically fracturing one well at a time, the zipper method simultaneously fractures multiple wells, which are drilled in tight spacing from a single pad site. This makes it a multi-well completion method. It earns its name from the zipper-like configuration of the fracture stages of the wells (i.e., see FIG. 30).

A stage in one well is hydraulically fractured while a second stage in a second well is prepared by using a wireline to perform a plug and perf operation. This allows two teams to work simultaneously and allows a service company can do 6 to 8 frac stages a day instead of 3.5 to 4 stages a day. In this way, it shaves days off the time it takes to complete a multi-well pad, saving companies tens of millions of dollars per year while accelerating the development of their well inventories.

Figure 31:
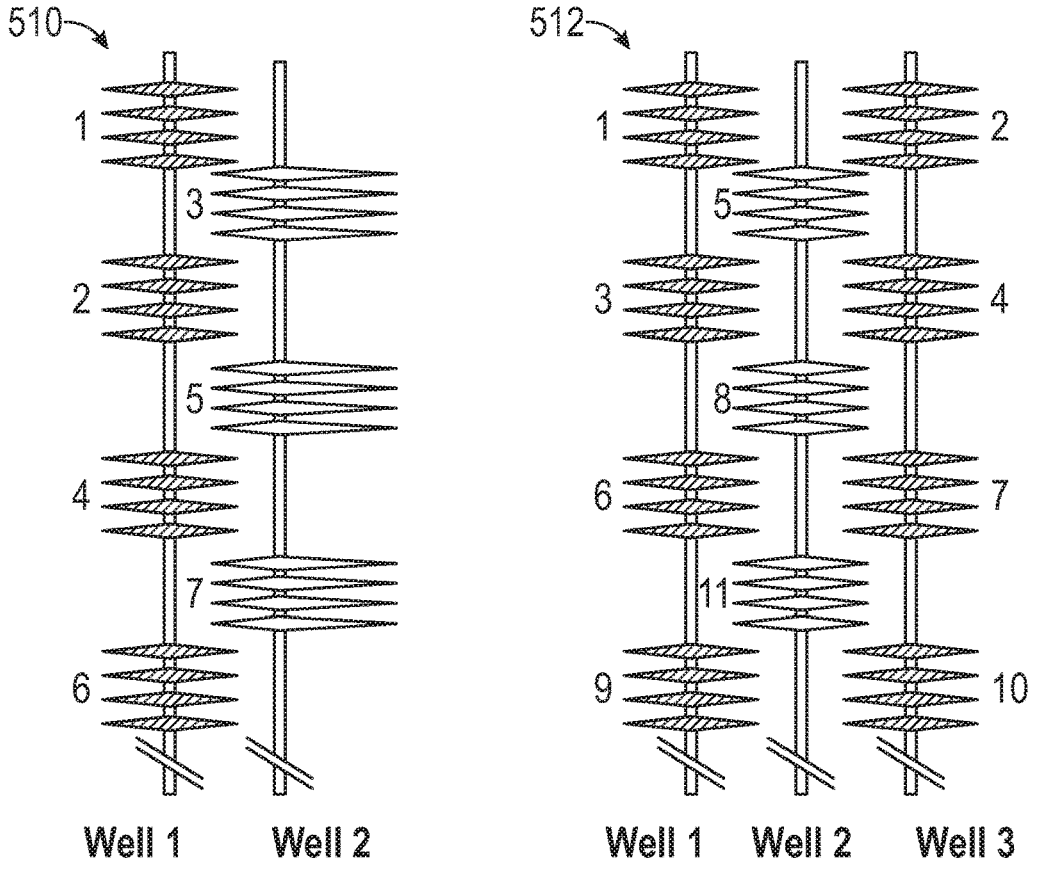
FIG. 31 illustrates schematic diagrams demonstrating two wells completed at a time and three wells completed at a time, in accordance with an example embodiment.

FIG. 31 illustrates schematic diagrams demonstrating a configuration 510 in which two wells are completed at a time and a configuration 512 in which three wells are completed at a time, in accordance with an example embodiment. Modified zipper frac (see FIG. 30) was developed in 2012 by Texas Tech University researchers Rafiee, Soliman, and Pirayesh. A few years before, Soliman et al. had developed a precursor method, called alternating fracturing, which was also designed to create more complex fracture networks (see FIG. 30). In alternating fracturing, one well is fractured at a time: first a fracture is created, then another fracture is created a designed distance from the first, and then a third fracture is created between the first two. The first two fractures minimize the horizontal stress anisotropy between them, enabling the third fracture to produce a more complex fracture network. Although alternate fracturing succeeded in minimizing the horizontal stress anisotropy, it faced too many operational complexities. It can be done, but it is very complicated.

Modified zipper fracturing maintains the advantages of alternate fracturing but is easily implemented. Like alternate fracturing, modified zipper fracturing uses stress shadowing to minimize the stress anisotropy, creating more complexity and near-wellbore permeability. By incorporating the zig-zag pattern of zipper fracturing, however, it eliminates alternate fracturing's operational complexities and allows the pumping and plug-and-pert teams to work simultaneously, thereby reducing the operation cycle time.

Optimized zipper frac (OZF) optimizes the stress shadow magnitude to maximize near-wellbore complexity by ballooning selected fractures. The optimum stress shadow in is estimated, and then the fracturing treatment, including ballooned fractures, is designed. Fluid volume, proppant volume, and fluid viscosity are the three most critical parameters in designing ballooned fractures because enable the desired stress shadow magnitude to be achieved in the right amount of time. FIG. 31 shows a schematic of optimized zipper frac (OZF) and the effect of ballooning two stages (stages 1 and 2, for example) on the staggered stage on the adjacent well (stage 3). On OZF, three wells are completed at a time to avoid asymmetric fracture growth (see FIG. 31).

A study was performed to confirm the viability of OZF. A reservoir model simulating properties of a sweet-spot in the Eagle Ford shale play (see Table 4) is built using a commercial software program that can calculate near-wellbore complexities and overall permeabilities from a large number of parameters, including horizontal stress anisotropies.

Eagle Ford shale play completions are almost exclusively horizontal wells with multiple fracture stages. Horizontals featured an average of 14 frac stages early in the development of the play, but this average has recently increased to 20 frac stages. The average stage now uses approximately 260,000 lbm of proppant and 11,000 bbl of fluid. Most treatments use slick-water, sometimes with a crosslinked gel tail-in. Proppants used typically include 100 mesh, 40/70, and 30/50. For some wells, a proppant with a mesh size of 20/40 or 16/30 is tailed in. Most wells use sand, with a minority using resin-coated sand or low-strength ceramic (IHS, 2011).

TABLE 4

Summary of the reservoir properties used in the simulation study.

| | |
|---|---|
| Shale play | Sweet-spot from the Eagle Ford |
| Pay zone | 12,800 ft.-13,000 ft. |
| Min horizontal stress (psi) | 9,500 |
| Min horizontal stress direction | 57 degrees from the north |
| Max horizontal stress (psi) | 10,800 |
| Overburden stress (psi) | 13,000 |
| Youngs modulus (psi) | 6,000,000 |
| Poisson's ratio | 0.22 |
| Average permeability | 1000 nano-darcy |
| Pore pressure gradient (psi/ft) | 0.7 |
| Reservoir pressure (psi) | 9,000 |
| Volume of clay | 20%-30% |
| TOC | 5%-7% |
| Well spacing | 275 ft. |

Nine different cases were examined. In case 1 (FIG. 32), a zipper frac setup is applied to three horizontal wells. In cases 2-9, an optimized zipper frac setup is applied to three horizontal wells with the same reservoir parameters as used in case 1 (FIGS. 33-40).

Figure 32:
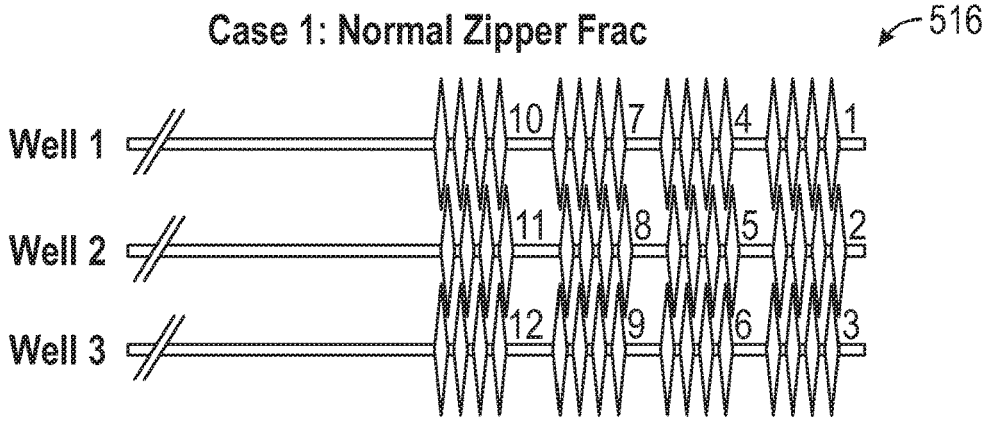
FIG. 32 illustrates a schematic diagram of normal zipper frac setup (Case 1), in accordance with an example embodiment.
Figure 33:
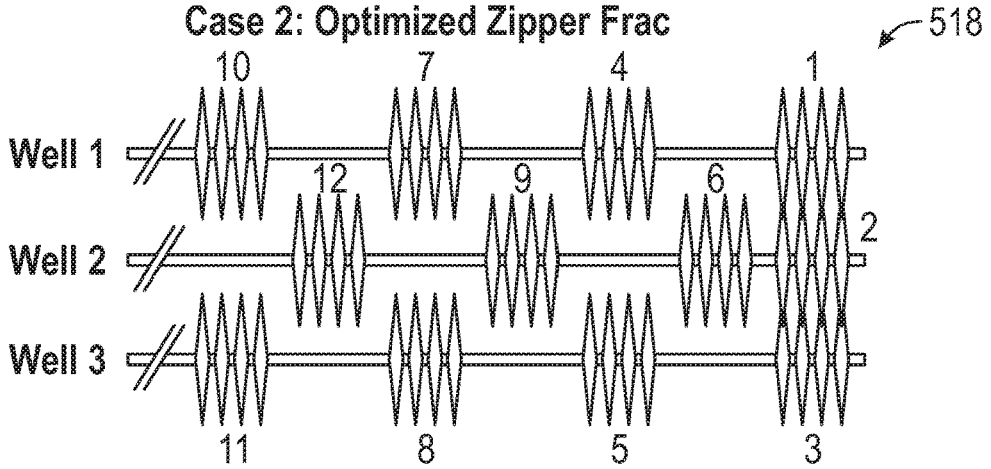
FIG. 33 illustrates a schematic diagram of an optimized zipper frac setup (Case 2), in accordance with an example embodiment.

FIG. 32 illustrates a schematic diagram of a normal zipper frac setup 516 (Case 1), in accordance with an example embodiment. FIG. 33 illustrates a schematic diagram of an optimized zipper frac setup 518 (Case 2), in accordance with an example embodiment. In case 2 (FIG. 33), the total fluid volume, fluid viscosity, and proppant concentration used are identical as in case 1, but the number of stages and the pattern of the stages is different. Stage volume increased from 11,000 bbl./stage, as in case 1 (FIG. 32), to 22,000 bbl./stage to keep the total fluid volume identical.

Figure 34:
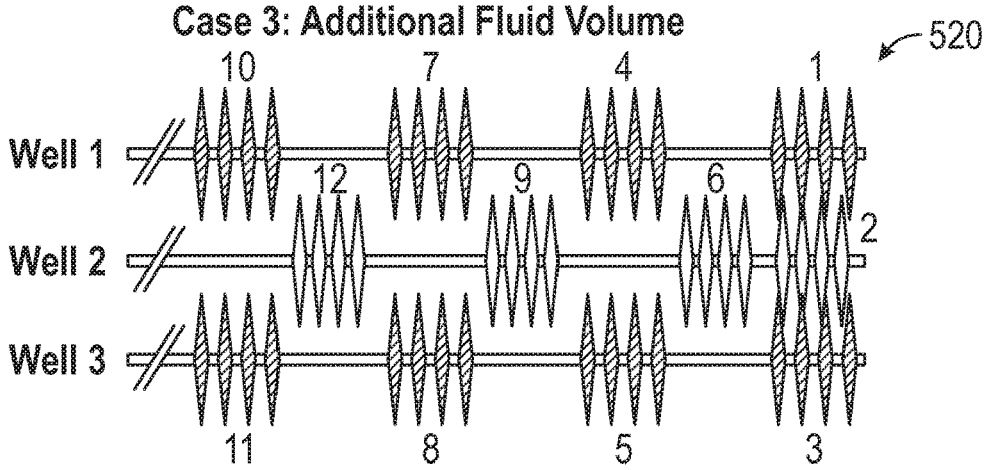
FIG. 34 illustrates a schematic diagram of an optimized zipper frac setup with additional fluid volume for frac stages in wells 1 and 3 (Case 3), in accordance with an example embodiment.

FIG. 34 illustrates a schematic diagram of an optimized zipper frac setup 520 with additional fluid volume for frac stages in wells 1 and 3 (Case 3), in accordance with an example embodiment. In case 3 (FIG. 34), the volume of the fluid injected into the fracture stages in wells 1 and 3 is increased from 22,000 bbl./stage, as in case 2, to 27,000 bbl./stage.

Figure 35:
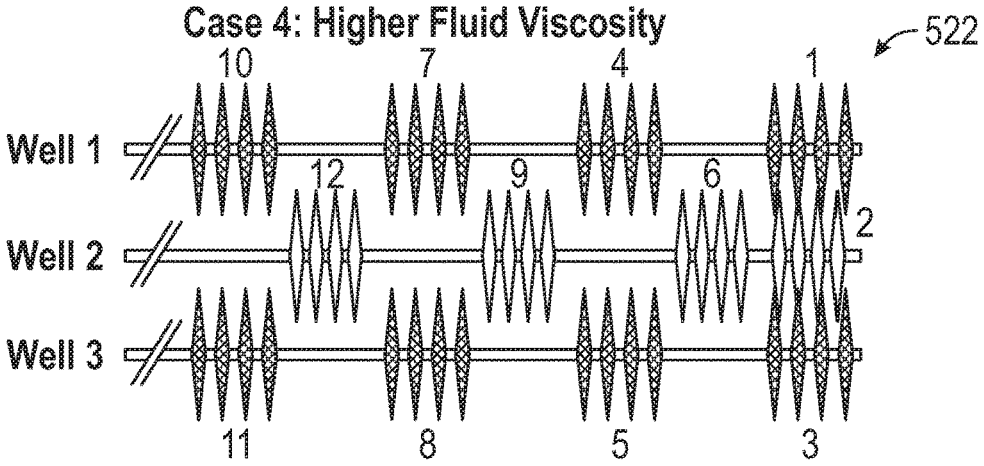
FIG. 35 illustrates a schematic diagram of an optimized zipper frac setup with high fluid viscosity for frac stages in wells 1 and 3 (Case 4), in accordance with an example embodiment.

FIG. 35 illustrates a schematic diagram of an optimized zipper frac setup 522 with high fluid viscosity for frac stages in wells 1 and 3 (Case 4), in accordance with an example embodiment. In case 4 (FIG. 35), the viscosity of the fluid injected into the fracture stages in wells 1 and 3 is increased from 3 cp., as in case 2, to 20 cp.

Figure 36:
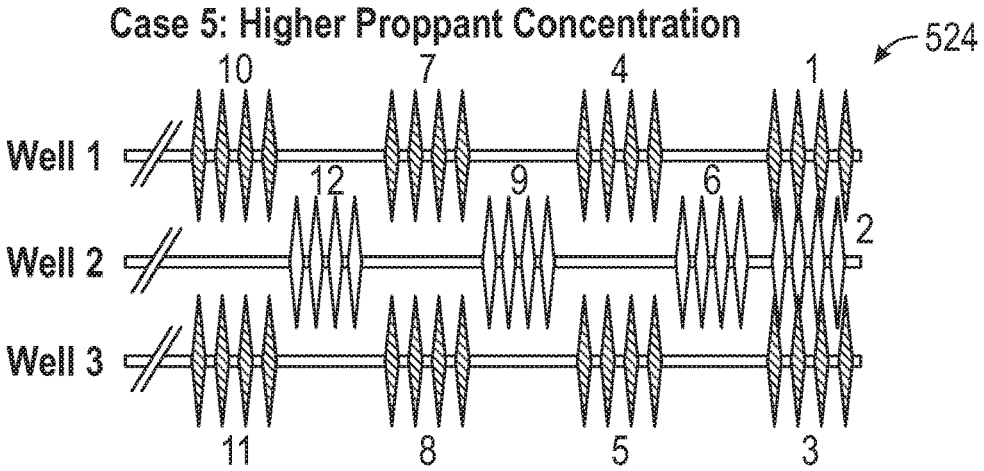
FIG. 36 illustrates a schematic diagram of an optimized zipper frac setup with high proppant concentration for frac stages in wells 1 and 3 (Case 5), in accordance with an example embodiment.

FIG. 36 illustrates a schematic diagram of an optimized zipper frac setup 524 with high proppant concentration for frac stages in wells 1 and 3 (Case 5), in accordance with an example embodiment. In case 5 (FIG. 36), the concentration of the proppant injected into the fracture stages in wells 1 and 3 is increased from 260,000 lbm, as in case 2, to 300,000 lbm.

Figure 37:
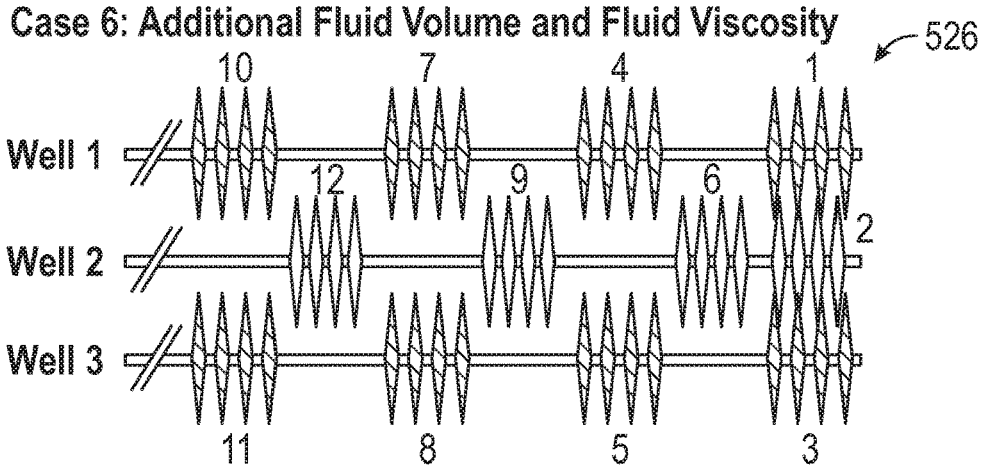
FIG. 37 illustrates an optimized zipper frac setup with additional fluid volume and fluid viscosity for frac stages in wells 1 and 3 (Case 6), in accordance with an example embodiment.
Figure 38:
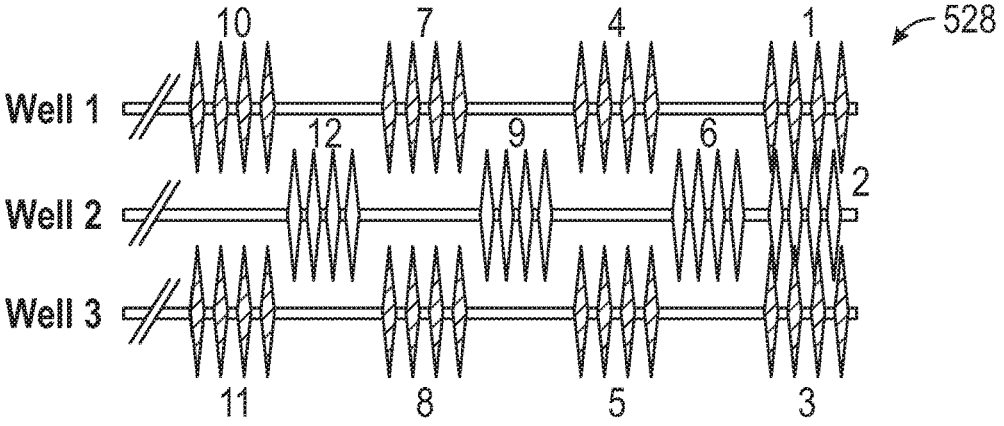
FIG. 38 illustrates an optimized zipper frac setup with additional fluid viscosity and proppant concentration for frac stages in wells 1 and 3 (Case 7), in accordance with an example embodiment.
Figure 39:
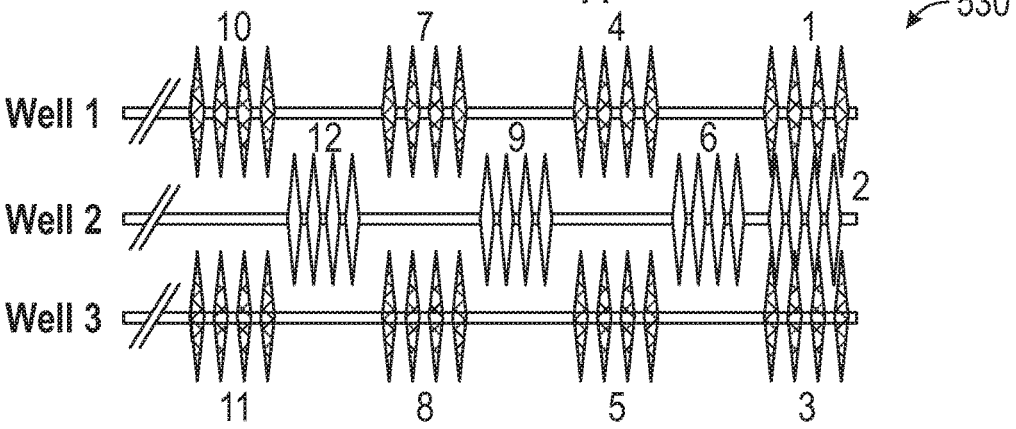
FIG. 39 illustrates an optimized zipper frac setup with additional fluid volume and proppant concentration for frac stages in wells 1 and 3 (Case 8), in accordance with an example embodiment.
Figure 40:
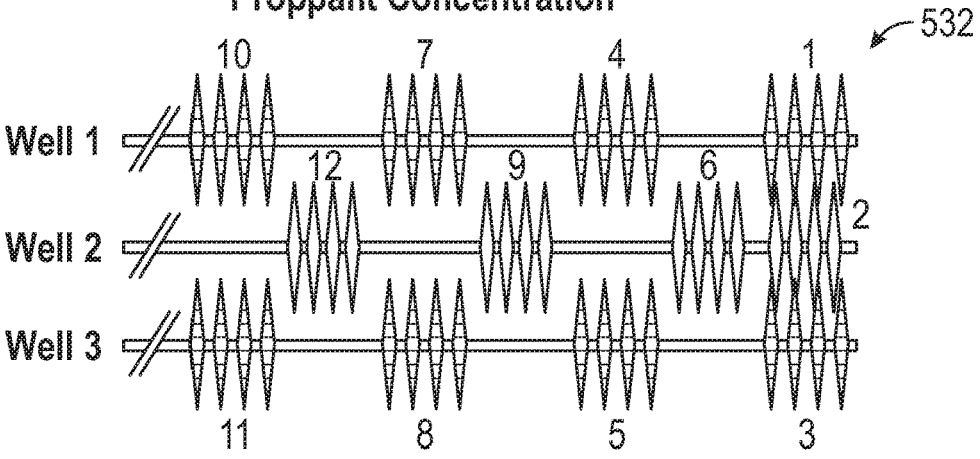
FIG. 40 illustrates an optimized zipper frac setup with additional fluid volume, fluid viscosity, and proppant concentration (Case 9), in accordance with an example embodiment.

FIG. 37 illustrates an optimized zipper frac setup 526 with additional fluid volume and fluid viscosity for frac stages in wells 1 and 3 (Case 6), in accordance with an example embodiment. FIG. 38 illustrates an optimized zipper frac setup 528 with additional fluid viscosity and proppant concentration for frac stages in wells 1 and 3 (Case 7), in accordance with an example embodiment. FIG. 39 illustrates an optimized zipper frac setup 530 with additional fluid volume and proppant concentration for frac stages in wells 1 and 3 (Case 8), in accordance with an example embodiment. FIG. 40 illustrates an optimized zipper frac setup with additional fluid volume, fluid viscosity, and proppant concentration (Case 9), in accordance with an example embodiment.

The parameters were changed individually in cases 2-5 and together in different combinations in cases 6-9. The same proppant concentration is used in case 6 (FIG. 37) as in case 2, but the volume of the injected fluid and the fluid viscosity are increased from 22,000 bbl./stage to 27,000 bbl./stage and from 3 cp. to 20 cp., respectively. In case 7 (FIG. 38), the same volume of injected fluid is used as in case 2, but the fluid viscosity and the proppant concentration are increased from 3 cp. to 20 cp. and from 260,000 lbm/stage to 300,000 lbm/stage, respectively. In case 8 (FIG. 39), the same fluid viscosity is used as in case 2, but the volume of the injected fluid and the proppant concentration are increased from 22,000 bbl./stage to 27,000 bbl./stage and from 260,000 lbm to 300,000 lbm, respectively. In case 9 (FIG. 40), the volume of the injected fluid, the fluid viscosity, and the proppant concentration are increased over case 2 from 22,000 bbl./stage to 27,000 bbl./stage, from 3 cp. to 20 cp., and from 260,000 lbm/stage to 300,000 lbm/stage, respectively.

Figure 41:
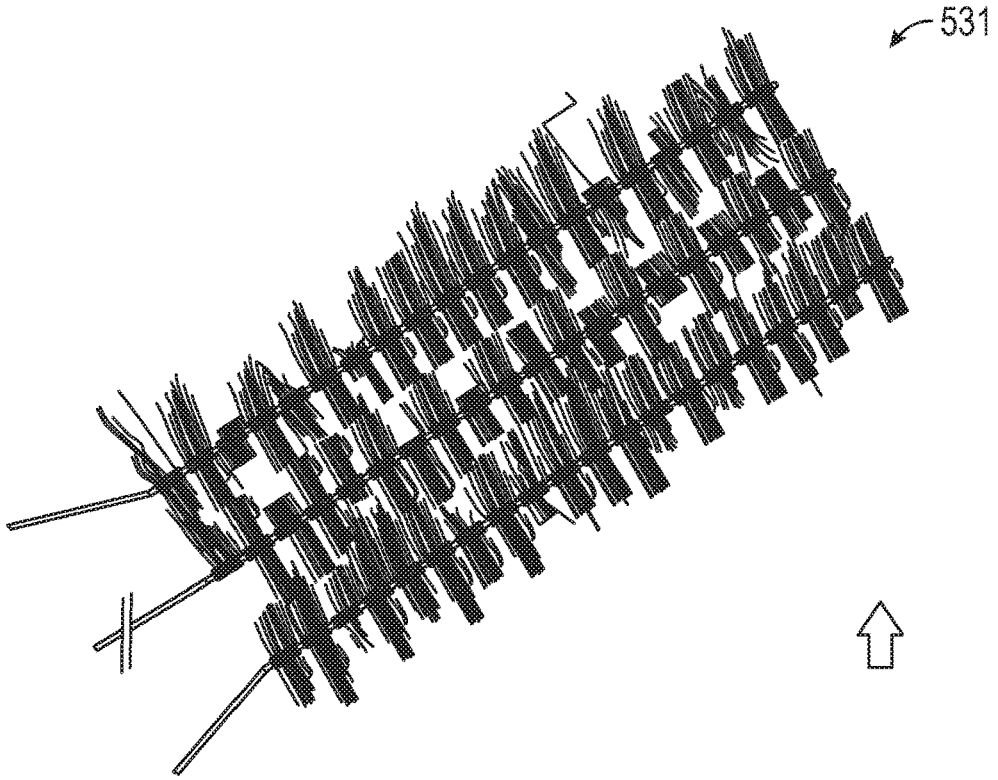
FIG. 41 illustrates a schematic diagram of a normal zipper frac setup (Case 1), in accordance with an example embodiment.
Figure 42:
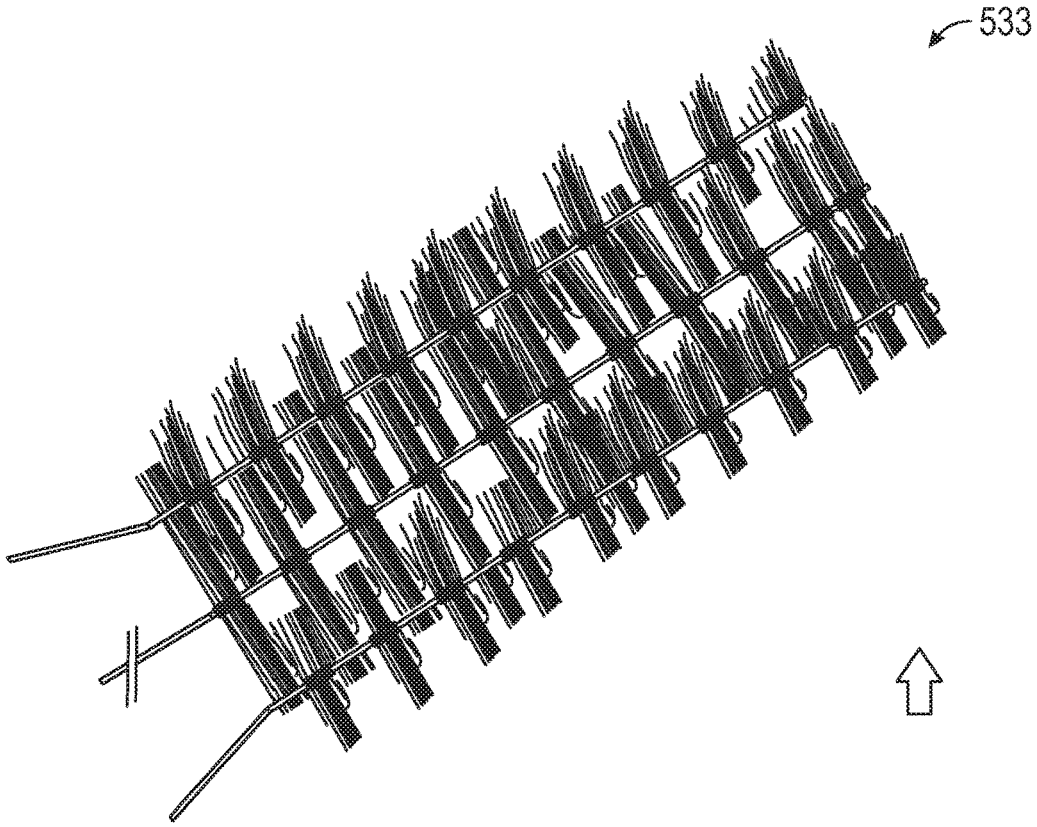
FIG. 42, illustrates a schematic diagram of an optimized zipper frac setup (Cases 2-9), in accordance with an example embodiment.

FIG. 41 illustrates a schematic diagram of a normal zipper frac setup 531 (Case 1), in accordance with an example embodiment. FIG. 42, illustrates a schematic diagram of an optimized zipper frac setup 533 (Cases 2-9), in accordance with an example embodiment. The zipper frac model features three laterals of 5000 ft (FIG. 41), with 20 stages per lateral. For each stage, the fluid volume is 11,000 bbl., the slick-water viscosity is 3 cp., and the proppant concentration is 260,000 lbm/stage.

The optimized zipper frac model features three laterals of 5000 ft (FIG. 42). The outer laterals each have 10 stages and the middle lateral has 11 stages. For each stage, the fluid volume is 22,000 bbl., the slick-water viscosity is 3 cp., and the proppant concentration is 260,000 lbm/stage. In cases 3-9, the fluid volume, the fluid viscosity, and the proppant concentration are variously increased, as previously mentioned. The production rate and the cumulative production of the middle well (well 2) in each case were obtained.

Figure 43:
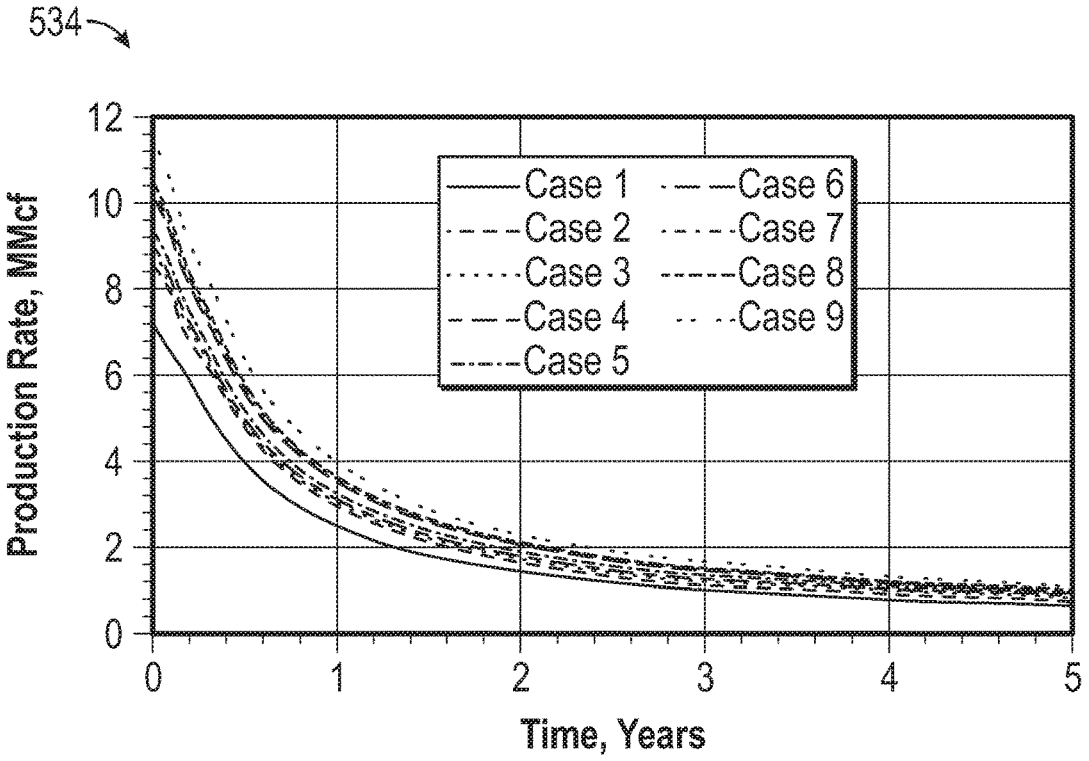
FIG. 43 illustrates a graph of production rates for nine simulated cases for five years, in accordance with an example embodiment.

FIG. 43 illustrates a graph 534 of production rates for nine simulated cases for five years, in accordance with an example embodiment. The graph 534 shown in FIG. 43 indicates the five years production rate for each of the nine cases. It is obvious that in each of the eight cases in which the optimized zipper frac setup was used (cases 2-9), the production rate was higher than the production rate with normal zipper frac setup (case 1). Moreover, when the injected fluid volume, fluid viscosity, and proppant concentration were all increased for wells 2 (case 9), the maximum production rate and the maximum production cumulative were obtained.

Figure 44:
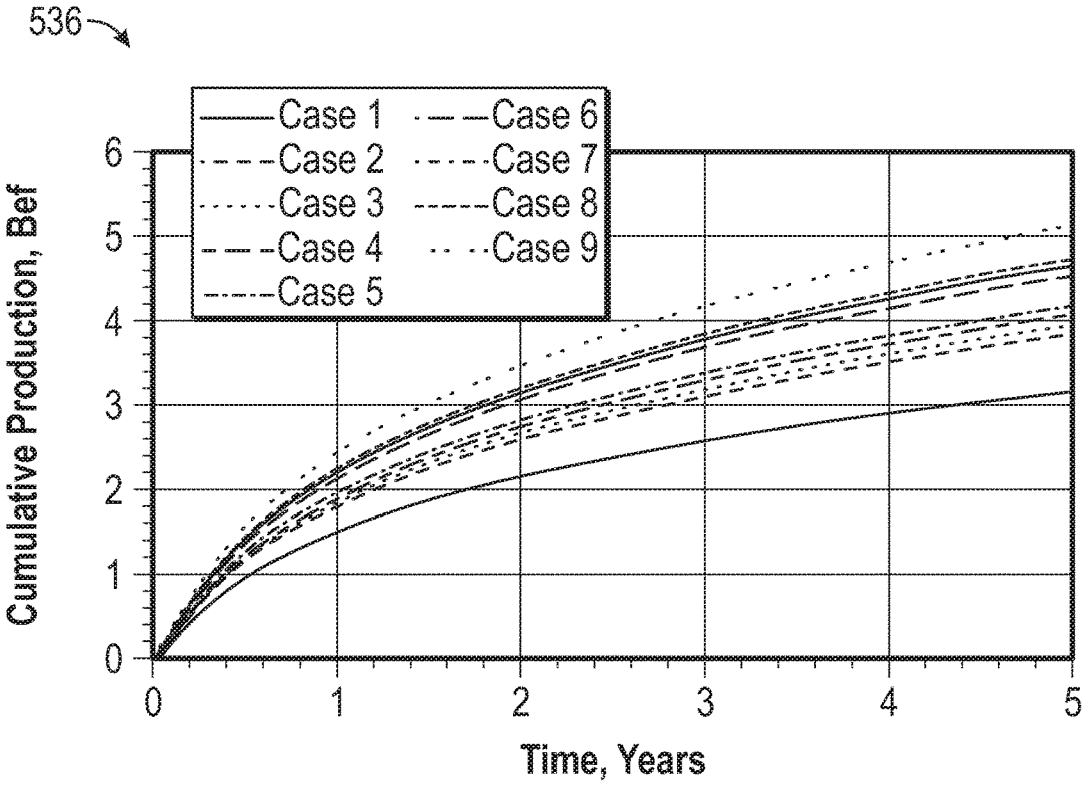
FIG. 44 illustrates a graph of cumulative production for nine simulated cases for five years, in accordance with an example embodiment.

FIG. 44 illustrates a graph 536 of cumulative production for nine simulated cases for five years, in accordance with an example embodiment. The values of the production rate of cases 2-5 are close and the same phenomenon for cases 6-8. This is because of the similarity of the stress shadows magnitude effect for these two groups of cases. Graph 536 of FIG. 44 shows the five years cumulative production for each of the nine cases. It is obvious that in each of the eight cases in which the optimized zipper frac setup was used (cases 2-9), the cumulative production was higher than the cumulative production in the zipper frac setup (case 1).

Regarding the economics of these scenarios, when the cumulative production in the zipper frac case is used as a baseline, the cumulative increases in cases 2-9 after five years of production are 0.67 Bcf (case 2), 0.79 Bcf (case 3), 0.9 Bcf (case 4), 1.02 Bcf (case 5), 1.38 Bcf (case 6), 1.5 Bcf (case 7), 1.57 Bcf (case 8), and 1.97 Bcf (case 9). Given an average price of natural gas of $3/1,000 Mcf, $2,014,274 additional dollars are generated in case 2, $2,358,654 additional dollars are generated in case 3, $2,703,034 additional dollars are generated in case 4, $3,047,415 additional dollars are generated in case 5, $4,132,213 additional dollars are generated in case 6, $4,486,925 additional dollars are generated in case 7, $4,723,399 additional dollars are generated in case 8, and $5,905,772 additional dollars are generated in case 9.

The expenses in cases 1 and 2 were almost identical because the volumes of injected fluid and the proppant weights were almost identical between them. The expenses were slightly higher in cases 3-9 than in cases 1 and 2, though no additional cost ever exceeded $500,000. These additional expenses were more than offset by the cumulative increases in production, however. Given an average price of $3 for 1000 scf, the revenue generated in cases 2-9 was 2-6 million USD.

Note that the one of the main objectives of this research is to use designed stress shadows to minimize the horizontal stress anisotropy. Doing so can change the behavior of the fractured formation from planar-fracture-dominant to complex-fracture-dominant, as is shown in FIG. 1.

The following section will explain why stress shadows increase the magnitude of the minimum horizontal stress to a greater degree than they do the maximum horizontal stress and the overburden. Sneddon (1946) and Sneddon and Elliot (1946) introduced solutions to calculate the stresses around semi-infinite, penny-shaped, and arbitrarily shaped fractures. In 1950, Green and Sneddon developed an analytical solution for elliptical fractures. The geometry of an elliptical fracture was shown previously in FIG. 9.

Warpiniski (2004) built upon the work of Green and Sneddon to introduce his own solution for the stress interference around fractures with elliptical geometries:

$$\sigma x-\sigma y=-8G1-2vr\partial 2\partial Z2+\partial 3\partial Z3 \quad (1)$$

$$\sigma x-\sigma y+2i\tau xy=32G\partial 2\partial z-21-2vr+Z\partial\partial z \quad (2)$$

$$\sigma z=-8G\partial 2\partial Z2+8GZ\partial 3\partial z3 \quad (3)$$

$$\tau xz+i\tau yz=16GZ\partial 3-z\partial Z2 \quad (4)$$

where σx is effective stress (in psi) in the x direction, σy is effective stress in the y direction, σz is effective stress in the z direction, τxy is shear stress in the xy plane, τxz is shear stress in the xz plane, τyz is shear stress in the yz plane, G is the shear modulus, Z (capital) is the coordinate axis normal to the fracture plane, Z (small) is a complex variable, it is a potential function, and vr is Poisson's ratio.

Figure 45:
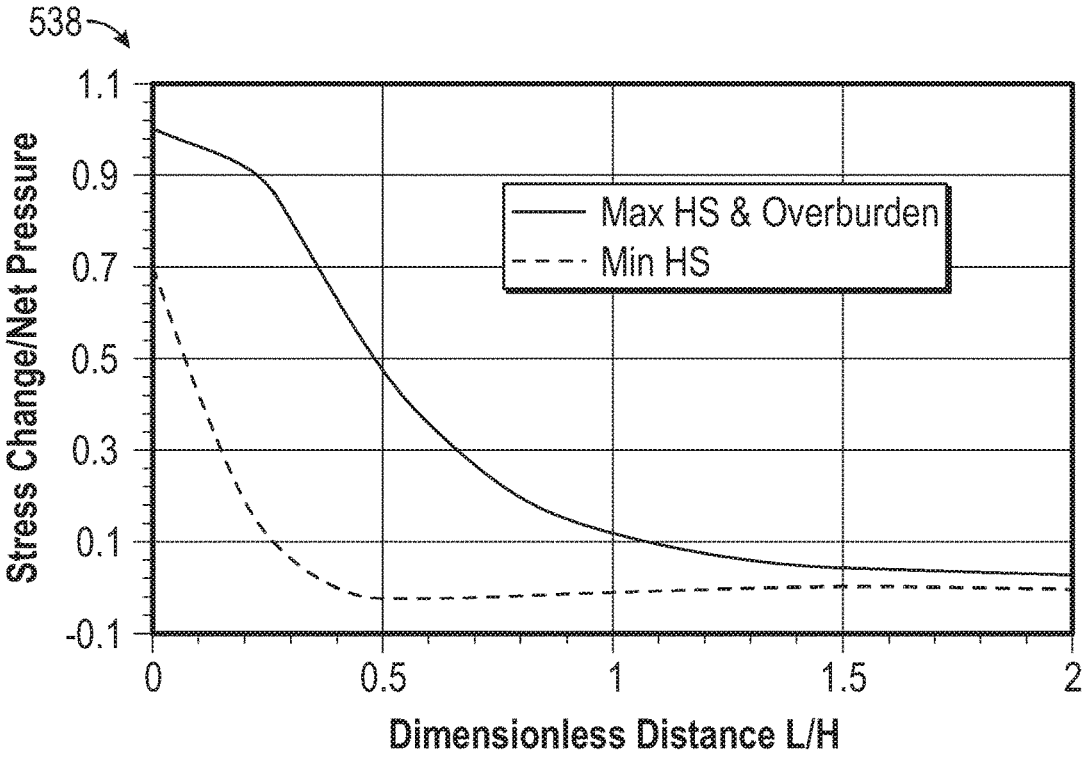
FIG. 45 illustrates a graph of dimensionless variation in stress versus dimensionless distance in a penny shaped crack, in accordance with an example embodiment.

FIG. 45 illustrates a graph 538 of dimensionless variation in stress versus dimensionless distance in a penny shaped crack, in accordance with an example embodiment.

Sneddon (1946) developed a solution to calculate the stresses around a penny-shaped fracture (FIG. 45). It is obvious from this solution that the magnitude of change to the minimum horizontal stress is always greater than the magnitude of change to both the maximum horizontal stress and the vertical stress. Because penny-shaped fractures are symmetrical, changes in stress along the line of symmetry in the direction parallel to the plane of the fracture (σx, σz) are equal. Stress shadowing has a much stronger impact on the minimum horizontal stresses of subsequent fractures than it does on their other principal stresses, especially when these fractures are close together (i.e. in short spacing). "Aspect ratio" refers to the ratio of fracture length (L) to fracture height (H).

Figure 46:
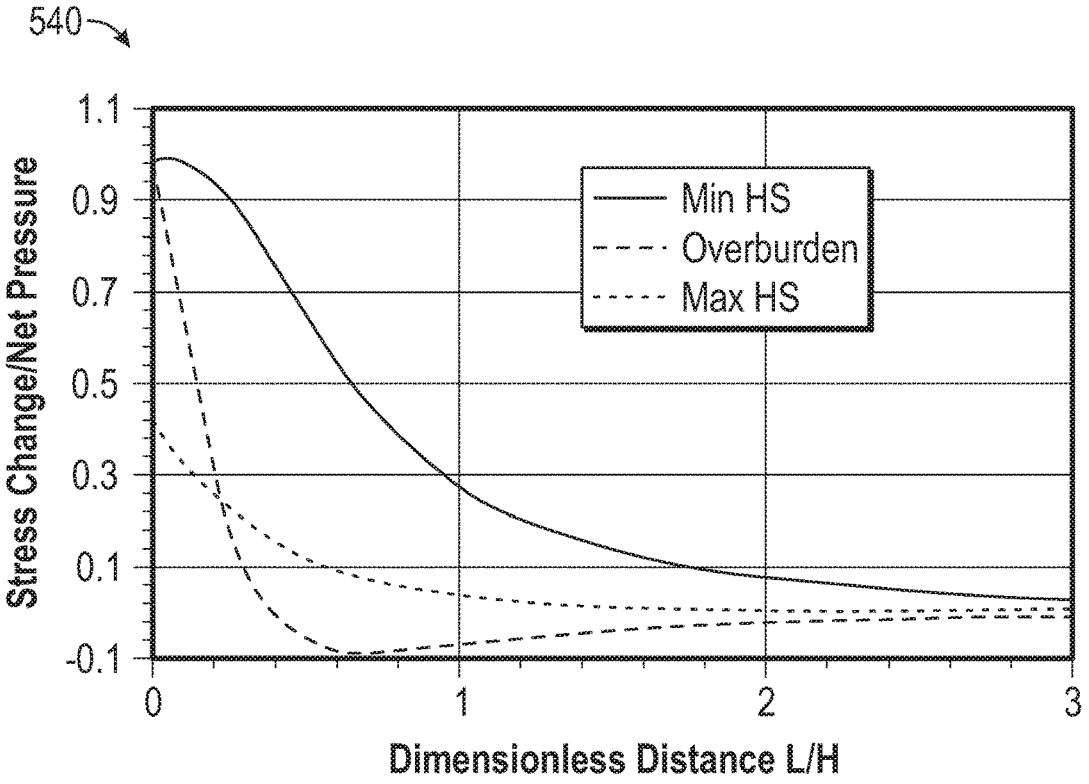
FIG. 46 illustrates a graph of dimensionless variation in stress versus dimensionless distance in a semi-infinite fracture, in accordance with an example embodiment.

FIG. 46 illustrates a graph 540 of dimensionless variation in stress versus dimensionless distance in a semi-infinite fracture, in accordance with an example embodiment. Sneddon and Elliott (1946) introduced a solution for semi-infinite fractures, which he assumes are rectangular with limited height and infinite length. He also assumes that the width of such fractures is extremely small compared to their height and length. His solution is presented in FIG. 46. For each principal stress, the change in stress over net pressure is plotted versus the distance perpendicular to the fracture plane normalized by the fracture height. The change in the minimum horizontal stress is greater than the change in the maximum horizontal stress and the change in the overburden stress.

Figure 47:
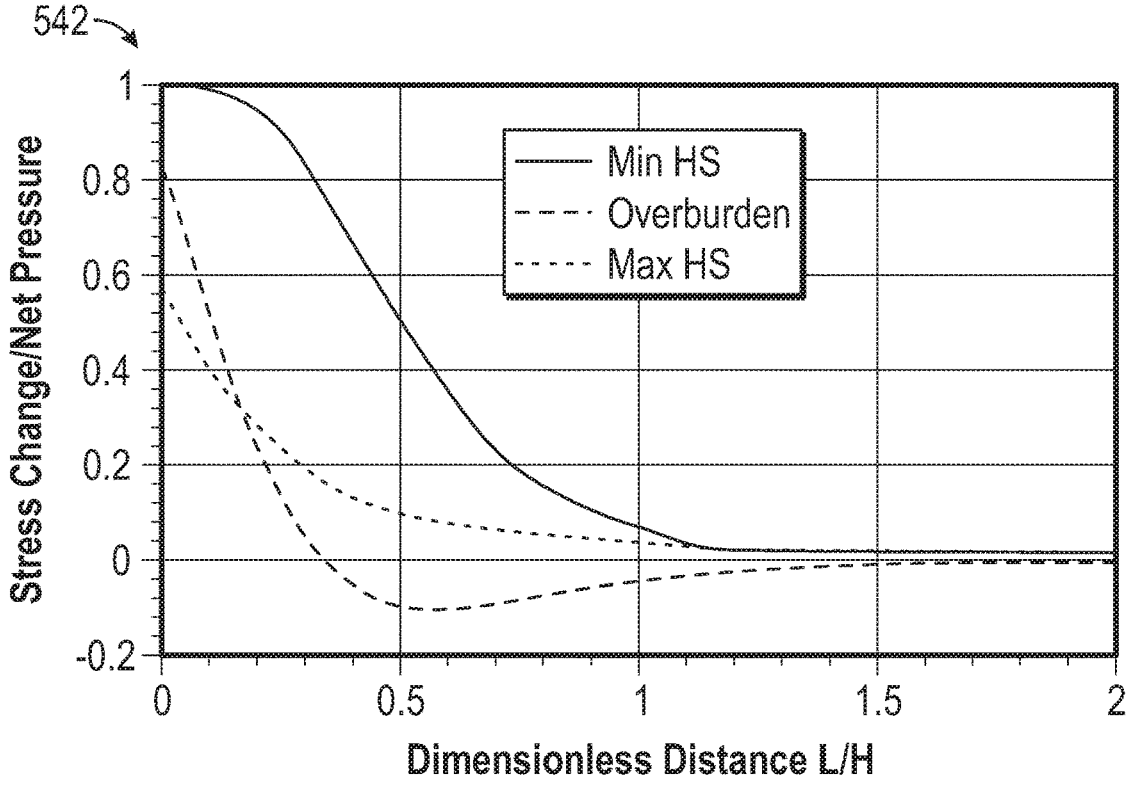
FIG. 47 illustrates a graph of dimensionless variation in stress versus dimensionless distance in an elliptical structure, in accordance with an example embodiment.

FIG. 47 illustrates a graph 542 of dimensionless variation in stress versus dimensionless distance in an elliptical structure, in accordance with an example embodiment. Green and Sneddon (1950) studied stress changes around elliptical fractures in elastic mediums. Most fracturing models assume that planar fractures have a roughly elliptical shape. FIG. 47 shows the changes in stress distribution caused by the presence of an elliptical fracture. The changes in stress follow the same trend as do the changes caused by a semi-infinite fracture. For each principal stress, the stress change over net pressure is plotted versus the distance perpendicular to the fracture plane normalized by the fracture height.

Figure 48:
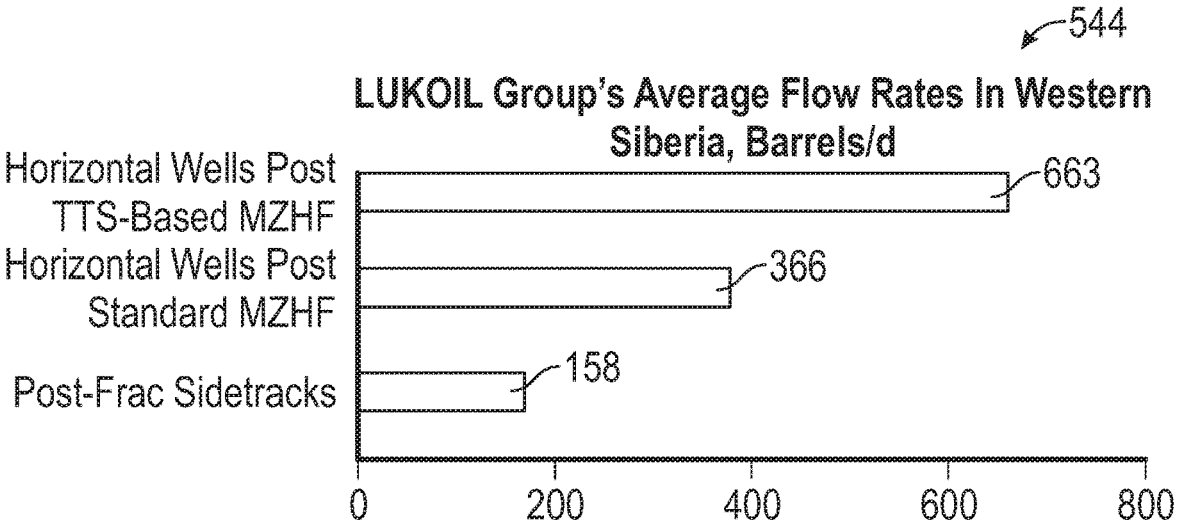
FIG. 48 illustrates a graph of the Texas Two Step versus other completion techniques, in accordance with an example embodiment.

FIG. 48 illustrates a graph 544 of the Texas Two Step versus other completion techniques, in accordance with an example embodiment. OZF and Alternate fracturing have the same scientific concept. OZF has not been field tested yet. However, alternate fracturing has been tested in Russia by Lukoil and Halliburton. LUKOIL was the first Russian company to implement Texas Two-Step (TTS) hydraulic fracturing technology on sidetracks. In its 2014 annual report, it claimed that technology enables multi-zone hydraulic fracturing (MZHF) to be carried out on a horizontal well in a certain order, thereby increasing flow rate. In 2013 and 2014, they drilled 8 horizontal wells in western Siberia using Texas Two-Step technology (Alternate fracturing). The horizontal wells that used TTS-based MZHF had flow rates that were four times higher than those that used frac sidetracks and two times higher than those that used standard MZHF (FIG. 48).

When a fracture is ballooned, the minimum horizontal stress increases to a greater degree than do the other principal stresses, producing a stress shadow that temporarily decreases the magnitudes of the horizontal stress anisotropies of nearby zones. If a nearby zone is fractured while this stress shadow lasts, the fracture will produce greater near-wellbore complexity and overall permeability than it otherwise would. Therefore, because optimized zipper frac balloons 4 frac stages surrounding a given zone before that zone is fractured, it produces more near-wellbore complexity and overall permeability than does normal zipper frac.

This supports the following conclusions:

1. Though OZF requires half the number of stages that zipper frac. does, it yields higher production rates and greater cumulative production.
2. When OZF is employed, increasing the concentration of the proppant and the volume and viscosity of the fluid injected into the frac stages along the boundary wells increases the overall production rate and recovery factor.
3. To generate the desired stress shadow and gain the desired near wellbore complexity and overall permeability, the net pressure inside the fractures and how that pressure is changing with time must be carefully monitored.
4. Although simulations confirm the viability of the OZF, field testing will be necessary for further evaluation.
5. Increasing the stage fluid volume needs extra tanks and frac fluids ready per stage. Increasing the viscosity, increases the friction and may result in reducing the injection rate.
6. The values of the production rate of cases 2-5 are close and the same phenomenon for cases 6-8. This is because of the similarity of the stress shadows magnitude effect for these two groups of cases.

Based on the foregoing, it can be appreciated that a number of example embodiments are disclosed herein. For example, in one embodiment, a system for recovering hydrocarbons via ballooned hydraulic fractures. Such a system can include an OZF (Optimized Zipper Frac) that recovers hydrocarbons, wherein the OZF is configured by an operational sequence comprising: initially creating a first stage of hydraulic fractures first created near a toe of a horizontal well; creating a second stage, wherein the second stage is ballooned on a same well at a designated distance from the first stage; creating a third stage along an adjacent well midway and staggered between the first stage and the second stages, and thereafter repeating the operational sequence.

In some example embodiments, the hydraulic fractures of the first stage of hydraulic fractures ca include fat-propped fractures. In another example embodiment, the first and second stages along a first well can be ballooned to produce a stress shadow strong enough to maximize a complexity of the third stage along a second well when the second well is fractured.

In still another example embodiment, the hydraulic fractures of the first stage of hydraulic fractures can include fat-propped fractures, and the first and second stages along a first well can be ballooned to produce a stress shadow strong enough to maximize a complexity of the third stage along a second well when the second well is fractured.

In yet another example embodiment, the OZF can be applied to the reservoir to maximize near-wellbore complexity and overall permeability and hydrocarbon recovery with respect to the reservoir. An example of such a reservoir is an organic shale reservoir.

In yet another example embodiment, a method for recovering hydrocarbons via ballooned hydraulic fractures can include steps or operations such as configuring an OZF (Optimized Zipper Frac) that recovers hydrocarbons, wherein the OZF is configured by an operational sequence comprising: initially creating a first stage of hydraulic fractures first created near a toe of a horizontal well; creating a second stage, wherein the second stage is ballooned on a same well at a designated distance from the first stage; creating a third stage along an adjacent well midway and staggered between the first stage and the second stages, and thereafter repeating the operational sequence.

In another example embodiment, a system for recovering hydrocarbons from a reservoir can be implemented. Such a system can include at least one horizontal well drilled initially parallel to a minimum horizontal stress direction of a horizontal section wherein the at least one horizontal well is spaced in the horizontal section to increase a flood efficiency; toes placed on a same plane that is perpendicular to the minimum horizontal stress direction; perforations located close to the toes to inject a high viscous batch to form a non-permeable barrier along the reservoir; a plug set to separate the non-permeable barrier from a remainder of the horizontal section, wherein the remainder of the horizontal section is perforated; and a packer that is set and sealed and located at a designated distance from the plug.

In some example embodiments, perforations between the plug and the packer can be used for fluid injection. In another example embodiment, perforations between the packer and a heel can be used in production. In addition, whenever a flooding material to hydrocarbon ratio increases, the packer can be pulled the designated distance back to the heel.

In yet another example embodiment, a method for recovering hydrocarbons from a reservoir, can be implemented. Such a method can include steps or operations such as, for example: initially drilling at least one horizontal well parallel to a minimum horizontal stress direction of a horizontal section wherein the at least one horizontal well is spaced in the horizontal section to increase a flood efficiency; placing toes on a same plane, which is perpendicular to the minimum horizontal stress direction; using perforations located close to the toes to inject a high viscous batch to form a non-permeable barrier along the reservoir; setting a plug to separate the non-permeable barrier from a remainder of the horizontal section; perforating the remainder of the horizontal section; and setting and sealing a packer at a designated distance from the plug.

It will be appreciated that variations of the above-disclosed and other features and functions, or alternatives thereof, may be desirably combined into many other different systems or applications. It will also be appreciated that various presently unforeseen or unanticipated alternatives, modifications, variations or improvements therein may be subsequently made by those skilled in the art, which are also intended to be encompassed by the following claims.

What is claimed is:

1. A system for recovering hydrocarbons via hydraulic fractures, said system comprising:

an OZF (Optimized Zipper Frac) that recovers hydrocarbons, wherein said OZF is configured by an operational sequence comprising:

initially creating a first stage of hydraulic fractures first created near a toe of a horizontal well, wherein said first stage is ballooned;

creating a second stage, wherein said second stage is ballooned on a same well at a designated distance from said first stage;

creating a third stage of non-ballooned hydraulic fractures along an adjacent well midway and staggered between said first stage and said second stages, and thereafter repeating said operational sequence.

2. The system of claim 1 further comprising:

using stress shadowing to minimize stress anisotropy.

3. The system of claim 1 wherein said first and second stages along a first well are ballooned to produce a stress shadow strong enough to maximize a complexity of said third stage along a second well when said second well is fractured.

4. The system of claim 1 wherein repeating said operational sequence further comprises:

repeating said operational sequence until a whole horizontal section of the horizontal well is fractured.

5. The system of claim 1 wherein said OZF is applied to a reservoir to maximize near-wellbore complexity and overall permeability and hydrocarbon recovery with respect to said reservoir.

6. The system of claim 5 wherein said reservoir comprises an organic shale reservoir.

7. A method for recovering hydrocarbons via ballooned hydraulic fractures, said method comprising:

configuring an OZF (Optimized Zipper Frac) that recovers hydrocarbons, wherein said OZF is configured by an operational sequence comprising:

initially creating a first stage of hydraulic fractures first created near a toe of a horizontal well, wherein said first stage is ballooned;

creating a second stage, wherein said second stage is ballooned on a same well at a designated distance from said first stage;

creating a third stage of non-ballooned hydraulic fractures along an adjacent well midway and staggered between said first stage and said second stages, and thereafter repeating said operational sequence.

8. The method of claim 7 further comprising:

using stress shadowing to minimize stress anisotropy.

9. The method of claim 7 further comprising ballooning said first and second stages along a first well to produce a stress shadow strong enough to maximize a complexity of said third stage along a second well when said second well is fractured.

10. The method of claim 7 wherein repeating said operational sequence further comprises:

repeating said operational sequence until a whole horizontal section of the horizontal well is fractured.

11. The method of claim 7 wherein said OZF is applied to a reservoir to maximize near-wellbore complexity and overall permeability and hydrocarbon recovery with respect to said reservoir.

12. The method of claim 11 wherein said reservoir comprises an organic shale reservoir.

* * * * *